US010739078B2

(12) United States Patent
Markussen

(10) Patent No.: US 10,739,078 B2
(45) Date of Patent: Aug. 11, 2020

(54) HEAT EXCHANGER

(71) Applicant: A Markussen Holding AS, Narvik (NO)

(72) Inventor: Almar Markussen, Beisfjord (NO)

(73) Assignee: A Markussen Holding AS, Narvik (NO)

( * ) Notice: Subject to any disclaimer, the term of this patent is extended or adjusted under 35 U.S.C. 154(b) by 5 days.

(21) Appl. No.: 15/543,320

(22) PCT Filed: Jan. 15, 2016

(86) PCT No.: PCT/NO2016/050005
§ 371 (c)(1),
(2) Date: Jul. 13, 2017

(87) PCT Pub. No.: WO2016/114673
PCT Pub. Date: Jul. 21, 2016

(65) Prior Publication Data

US 2018/0003444 A1 Jan. 4, 2018

(30) Foreign Application Priority Data

Jan. 15, 2015 (NO) ..... 20150073

(51) Int. Cl.
*F28D 7/12* (2006.01)
*F28F 1/20* (2006.01)
(Continued)

(52) U.S. Cl.
CPC ..... *F28D 7/12* (2013.01); *F28D 1/0475* (2013.01); *F28D 7/085* (2013.01); *F28F 1/16* (2013.01);
(Continued)

(58) Field of Classification Search
CPC .. F28D 7/12; F28D 7/085; F28D 7/103; F28F 1/16; F28F 1/20; F28F 1/26; F28F 1/40;
(Continued)

(56) References Cited

U.S. PATENT DOCUMENTS 813,918 A 2/1906 Schmitz
1,048,186 A * 12/1912 Lomschakow ..... F22G 7/10 122/367.2
(Continued)

FOREIGN PATENT DOCUMENTS

AU 4313279 A 1/1980
BE 673093 A 5/1966
(Continued)

OTHER PUBLICATIONS

Festin, Moa, "International Search Report," prepared for PCT/NO2016/050005, dated Apr. 25, 2016, five pages.

*Primary Examiner* — Devon Russell
(74) *Attorney, Agent, or Firm* — Ross T. Robinson

(57) ABSTRACT

A heat exchanger for transferring heat between two fluids with different temperature includes a first heat exchange element having at least one core extending longitudinally through the heat exchange element. The at least one core defines a core cavity that is configured with an inlet port and an outlet port to receive a first fluid flowing therethrough. The heat exchange element includes ribs extending continuously substantially in parallel with the at least one core along the whole length of the core. The ribs extend radially outwardly from the core and are exposed to contact with a second fluid that flows along said ribs. Each rib is divided into at least two radially extending fins at a radial distance from the core. Each fin extends to a proximity of an outer casing surrounding the first heat exchanger element or a proximity of fins of an adjacent heat exchanger element.

13 Claims, 52 Drawing Sheets

(51) Int. Cl.

| | |
|---|---|
| ***F28D 7/08*** | (2006.01) |
| ***F28F 1/42*** | (2006.01) |
| ***F28F 1/40*** | (2006.01) |
| ***F28D 1/047*** | (2006.01) |
| ***F28F 1/16*** | (2006.01) |
| ***F28F 1/26*** | (2006.01) |

(52) U.S. Cl.
CPC ..... *F28F 1/20* (2013.01); *F28F 1/26* (2013.01); *F28F 1/40* (2013.01); *F28F 1/422* (2013.01); *F28F 2215/10* (2013.01); *F28F 2220/00* (2013.01); *F28F 2230/00* (2013.01); *F28F 2255/16* (2013.01); *F28F 2275/205* (2013.01)

(58) Field of Classification Search
CPC .... F28F 1/422; F28F 2220/00; F28F 2230/00; F28F 2255/16; F28F 2275/205; F28F 2210/10
USPC ..... 165/142, 160
See application file for complete search history.

(56) References Cited

U.S. PATENT DOCUMENTS

| | | | | | |
|---|---|---|---|---|---|
| 2,267,695 | A * | 12/1941 | Graham | F28D 7/12 | 165/142 |
| 2,659,452 | A * | 11/1953 | Gaydasch | G01N 25/142 | 165/110 |
| 2,729,433 | A | 1/1956 | Berg | | |
| 3,074,480 | A * | 1/1963 | Brown, Jr. | F28D 7/10 | 165/143 |
| 3,595,310 | A | 7/1971 | Burne et al. | | |
| 3,963,071 | A * | 6/1976 | Levin | F23D 11/44 | 165/142 |
| 4,162,702 | A * | 7/1979 | Andersson | F28D 7/08 | 165/142 |
| 4,657,074 | A * | 4/1987 | Tomita | F24H 3/065 | 165/179 |
| 5,365,750 | A * | 11/1994 | Greenthal | F25B 9/02 | 165/142 |
| 6,714,415 | B1 * | 3/2004 | Shah | H01L 23/467 | 165/185 |
| 7,487,824 | B2 * | 2/2009 | Lin | H01L 23/427 | 165/104.33 |
| 8,498,116 | B2 * | 7/2013 | Siracki | H01L 21/4882 | 361/710 |
| 9,252,073 | B2 * | 2/2016 | Yamashita | H01L 23/3672 | |
| 2007/0159798 | A1 * | 7/2007 | Chen | H01L 23/4006 | 361/700 |
| 2008/0094800 | A1 * | 4/2008 | Chen | F28F 1/20 | 361/704 |
| 2008/0121377 | A1 * | 5/2008 | Lin | F28D 15/02 | 165/104.33 |
| 2008/0295993 | A1 * | 12/2008 | Chen | H01L 23/427 | 165/80.3 |
| 2009/0071624 | A1 * | 3/2009 | Zhang | F28F 1/16 | 165/80.3 |
| 2009/0084520 | A1 | 4/2009 | Campagna et al. | | |
| 2009/0107853 | A1 | 4/2009 | Tan et al. | | |
| 2014/0000845 | A1 | 1/2014 | Vanderwees et al. | | |
| 2015/0013949 | A1 * | 1/2015 | Arnot | F28D 7/12 | 165/156 |

FOREIGN PATENT DOCUMENTS

| | | | | |
|---|---|---|---|---|
| BE | 1016887 | A3 * | 9/2007 | F28D 7/0041 |
| CN | 2867257 | Y | 2/2007 | |
| CN | 201184767 | Y | 1/2009 | |
| CN | 201229141 | Y | 4/2009 | |
| DE | 2615168 | A1 | 10/1977 | |
| DE | 2742877 | A1 | 3/1979 | |
| DE | 29510190 | U1 | 8/1995 | |
| EP | 0305702 | A1 | 3/1989 | |
| GB | 191126340 | A | 8/1912 | |
| GB | 371347 | A | 4/1932 | |
| GB | 637235 | A | 5/1950 | |
| GB | 1413913 | | 11/1975 | |
| IT | 7848277 | | 3/1978 | |
| JP | S61225580 | A | 10/1986 | |
| WO | WO-97000786 | A1 | 1/1997 | |
| WO | WO-201091178 | A1 | 8/2010 | |

* cited by examiner

HEAT EXCHANGER

FIELD OF THE INVENTION

The present invention relates to a heat exchanger, whereby a first fluid having a first temperature heats up or cools down a second fluid having a second temperature.

TECHNICAL BACKGROUND OF THE INVENTION

In general, heat exchangers are devices that transfer thermal energy between two fluids without direct contact between the two fluids. A primary fluid is typically directed through a fluid core of the heat exchanger while a secondary cooling or heating fluid is brought into external contact with the fluid core. In this manner, thermal energy may be transferred between the primary and secondary fluids through the walls of the fluid core.

The ability of the heat exchanger to transfer thermal energy between the primary and secondary fluids depends on, amongst other things, the surface available for the heat transfer and the thermal properties of the exchanger materials.

A vast number of various types of heat exchangers exist in the field. One of these is disclosed in U.S. 20090084520. This publication shows a heat exchanger comprising a plurality of hexagonal elongate elements, each of the elements having a central channel for a flow of a first fluid. Around the central channel, the elements comprises a metal foam, which can be of an open cell structure or a combination of an open cell structure and a closed cell structure. A second fluid flows through the metal foam.

A major disadvantage of this heat exchanger is that the metal foam provides a very high flow resistance to the flow of the second fluid.

Another known heat exchanger is GB 637235. This publication shows heat exchanger with heat exchanger elements that transfers heat between two fluids. The heat exchanger elements having ribs that extends radially outwardly from the core. Every second fin is divided into two ribs. The heat exchangers are put together so that the fins produce a honeycomb formation where a fluid can flow. The shape of the ribs and fins do not transfer the heat efficiently between the two fluids. The heat exchanger are equal and only shaped to fit a juxtaposed heat exchanger element. The shape is not fitted to the outer casing surrounding the heat exchanger element. There are some empty space between the casing and ribs/fins of the heat exchanger element which results in uneven heating or cooling of the fluid. The honeycomb formation are also less efficient to transfer heat since there are a large space between the fins and ribs.

The publication CN201229141 shows a heat exchanger elements with ribs that divides into two radially extending fins, but the ribs and fins in this publication are not extending continuously in parallel with the core along the whole length of the core, instead they are helically arranged around the core. This will reduce the flow of the fluid through the heat exchanger element and require more energy to transport the fluid through the heat exchanger. The ribs are also arranged with some space between the ribs which also do not increase the efficiency of the heating or cooling.

None of the publications disclose a heat exchanger element where the inlet port and outlet port are arranged at the same end of the core, which provides a better heat transmission between the fluids.

Other known heat exchangers are shown in DE2742877, BE673093, IT7848277, U.S. Pat. Nos. 3,595,310, 2,729,433, US20090107853, EP305702, AU7943132, GB1413913, US20140000845 and WO201091178. However, common to these is that the flow of one of the fluids is restricted by elements of the heat exchanger. These restrictions increase the need of energy (pressure) to ensure a sufficient flow of the fluid.

Heat sinks are used in electronic system to cool for instance central processing units or graphic processors by dissipating heat into the surrounding medium. Heat sinks having fins that extend from its base and increase the area of heat transfer. The base and fins are in direct contact with the heat source for cooling of the electrical unit.

The heat exchanger according to the invention are not equivalent and not suitable for use in heat sinks for cooling central processing unit or similar electrical units. The heat sinks are much smaller to fit in the electronic device than the heat exchanger according to the invention. In the heat exchanger according to the invention, the heat is transferred from a fluid to another fluid to be used as a heating or cooling of a surrounding gas or a liquid.

SUMMARY OF THE INVENTION

Consequently, there is a need to provide a heat exchanger that ensures a high flow with a minimum of energy consumption to provide the flow. It is also a need to provide a heat exchanger where there is a minimum of loss of pressure difference with an increased flow rate.

Another advantage of the heat exchanger according to the invention is that the surface area of the heat-exchanging element is higher, which results in a more efficient heat transfer. The ribs and fins of the heat exchanger element is adapted to fill the entire cross-sectional area of the heat exchanger so that there are no voids between the heat exchanger elements or the casing and the heat exchanger elements. The heat exchanger elements have a compact structure where the heat transferring area is as great as possible. The heat could thereby be transferred evenly from the first fluid to the second fluid throughout the whole heat exchanger.

A pipe with an inclined opening at the free end will provide better heat transfer to the inner surface of the core. The inclined surface results in a cavitation at the pipe outlet which will lead to turbulence in the fluid towards the inner surface of the core. The turbulence will result in better and more efficient heat transfer from the fluid to the core.

The fins and the ribs have substantially the same thickness in along the radial distance from the core. This provides a better and also more even heat transfer from the ribs/fins to the second fluid throughout the whole heat exchanger.

The material of the heat exchanger causes less incrustation. The exchanger elements are also easier to clean because it can be done by a high-pressure washer. A smooth surface of the ribs/fins is also advantageous in that the fluid can flow through the heat exchanger with a minimum of obstacles. The element could also be made by extrusion. This provides easier production of the elements.

The heat exchanger can be construed by one heat exchanger element or several heat exchanger elements assembled together. This makes the heat exchanger flexible in various use.

The heat exchanger could also have ribs arranged on the inner surface of the core, This provides a greater heat transfer surface to/from the fluid in the core to the surface of the core.

The objective of the invention is achieved by a heat exchanger for transferring heat between two fluids with different temperatures. The heat exchanger comprises a first heat exchange element, said first heat exchange element having at least one core extending longitudinally through the heat exchange element, said at least one core defining a core cavity, said cavity being configured with an inlet port and an outlet port to receive a first fluid flowing there through, said heat exchange element having ribs extending continuously substantially in parallel with the at least one core along the whole length of said core, said ribs extending radially outwardly from the core and being exposed to contact with a second fluid, flowing along said ribs.

The heat exchanger is distinctive in that each said rib is divided into at least two radially extending fins, at a radial distance from the core, each said fin extends to a proximity of an outer casing surrounding said first heat exchanger element or a proximity of fins of an additional heat exchanger element, said additional heat exchanger element being arranged adjacent to said first heat exchanger element, said inlet port and said outlet port being coupled to said core at the same end of the core.

Preferable embodiment of the heat exchanger are defined in the dependent claims, to which reference is made.

BRIEF DESCRIPTION OF THE DRAWINGS

FIGS. 6 and 7 are viewed from opposite end portions.

FIG. 35-37 shows the embodiment with a centre exchange element not restricted by a cylindrical outer element attached to the centre exchange element, the centre heat elements as described in FIG. 16-18 may be used in this embodiment of the invention.

FIG. 38-39 shows the centre heat exchange element with a cylindrical outer element fixedly connected to the centre heat exchanger. In FIG. 39 the heat exchange element form an integrated part of the outer cylinder. I FIG. 40-46 shows an embodiment of the present invention where the centre heat exchange element of FIG. 38-39 is arranged in a duct.

FIGS. 47-50 show another embodiment of the heat exchanger where the heat exchanger comprising a centre heat exchanger element and a plurality of external heat exchange element. The heat exchanger is arranged inside a duct adapted to transfer heat between two fluids.

DETAILED DESCRIPTION OF THE INVENTION

Figure 1:
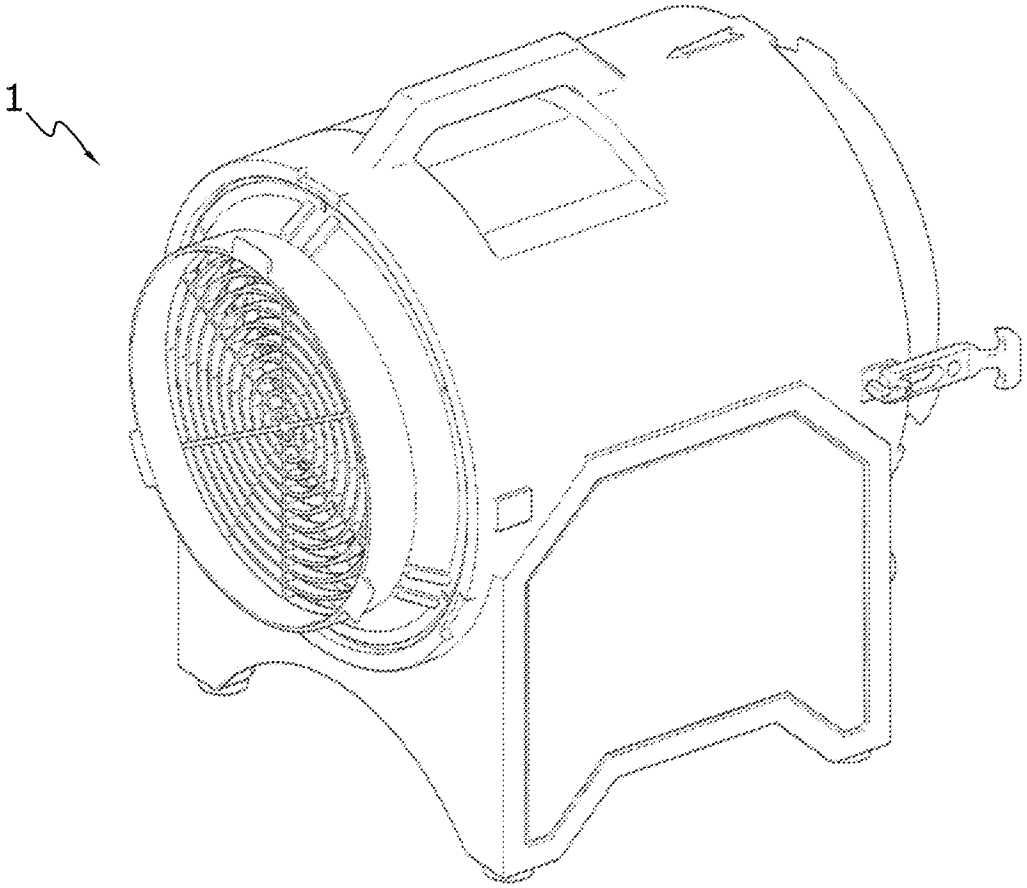
FIG. 1 shows a principle drawing of one embodiment of a heat exchanger according to the invention.

FIG. 1 illustrates a heat exchanger 1. It facilitates transfer of thermal energy between two or more fluids. The fluids may include liquid, gasses or any combination of liquid and gases. For example, the fluids may include air, exhaust, oil, coolant, water or any other fluid known in the art. The heat exchanger may be used to transfer thermal energy in any fluid systems, such as for example, an exhaust and/or air cooling system, a radiator system, an oil cooling system, a condenser system or any other type of fluid system known in the art.

Figure 2:
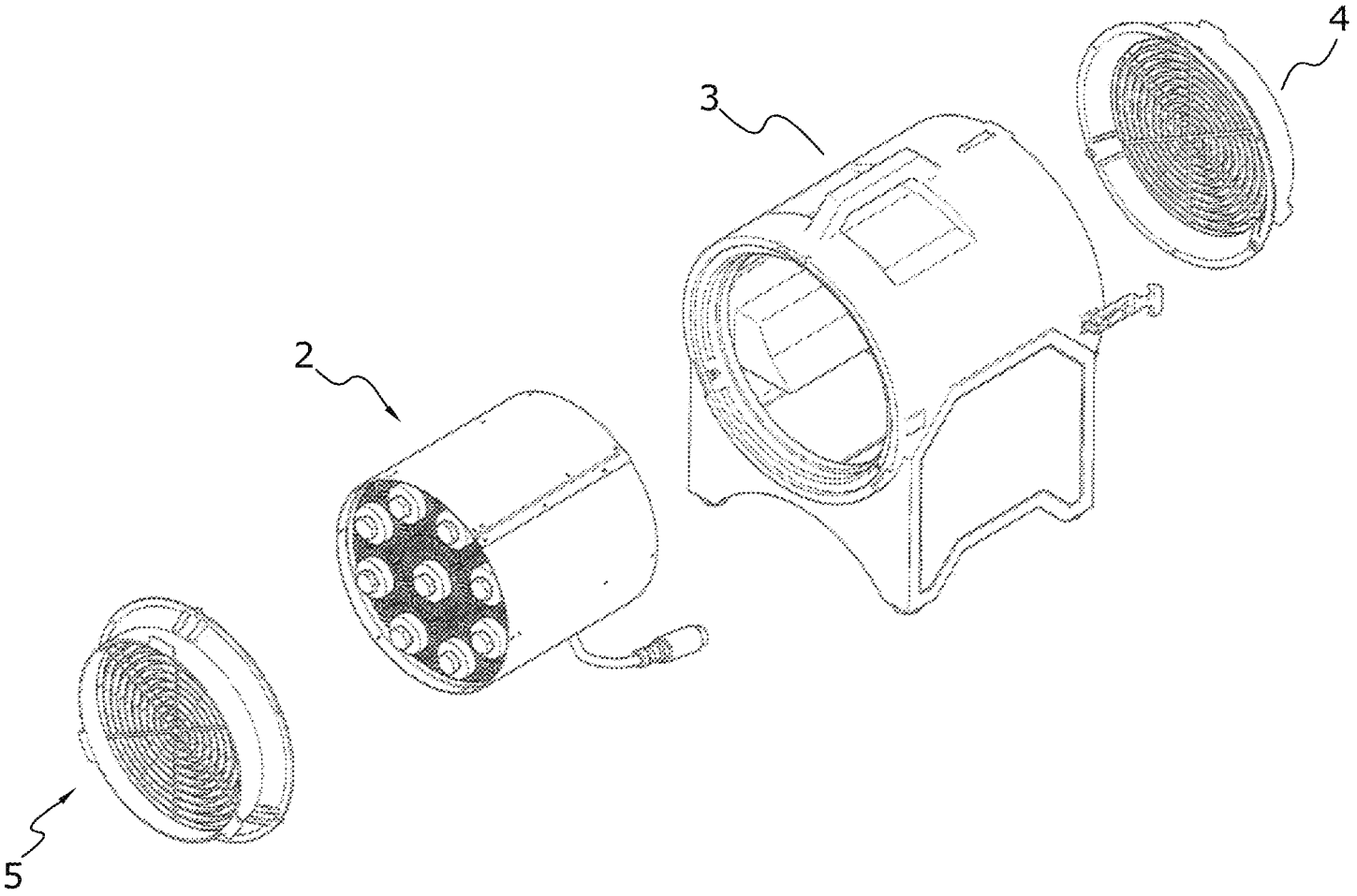
FIG. 2 shows in elevated view the main parts part of the heat exchanger shown in FIG. 1 shown in an exploded view.

FIG. 2 shows a partially exploded, elevated view of the heat exchanger according to one embodiment of the invention. The heat exchanger 1 comprising a housing 3. This housing 3 is shown cylindrically shaped but it could also have other shapes, like a rectangular shape.

A heat exchanger 2 according to the embodiment of the invention is arranged within the housing 3. At both ends of the housing 3, there are arranged lattices 4, 5 to provide protection for the heat exchanger.

Figure 3:
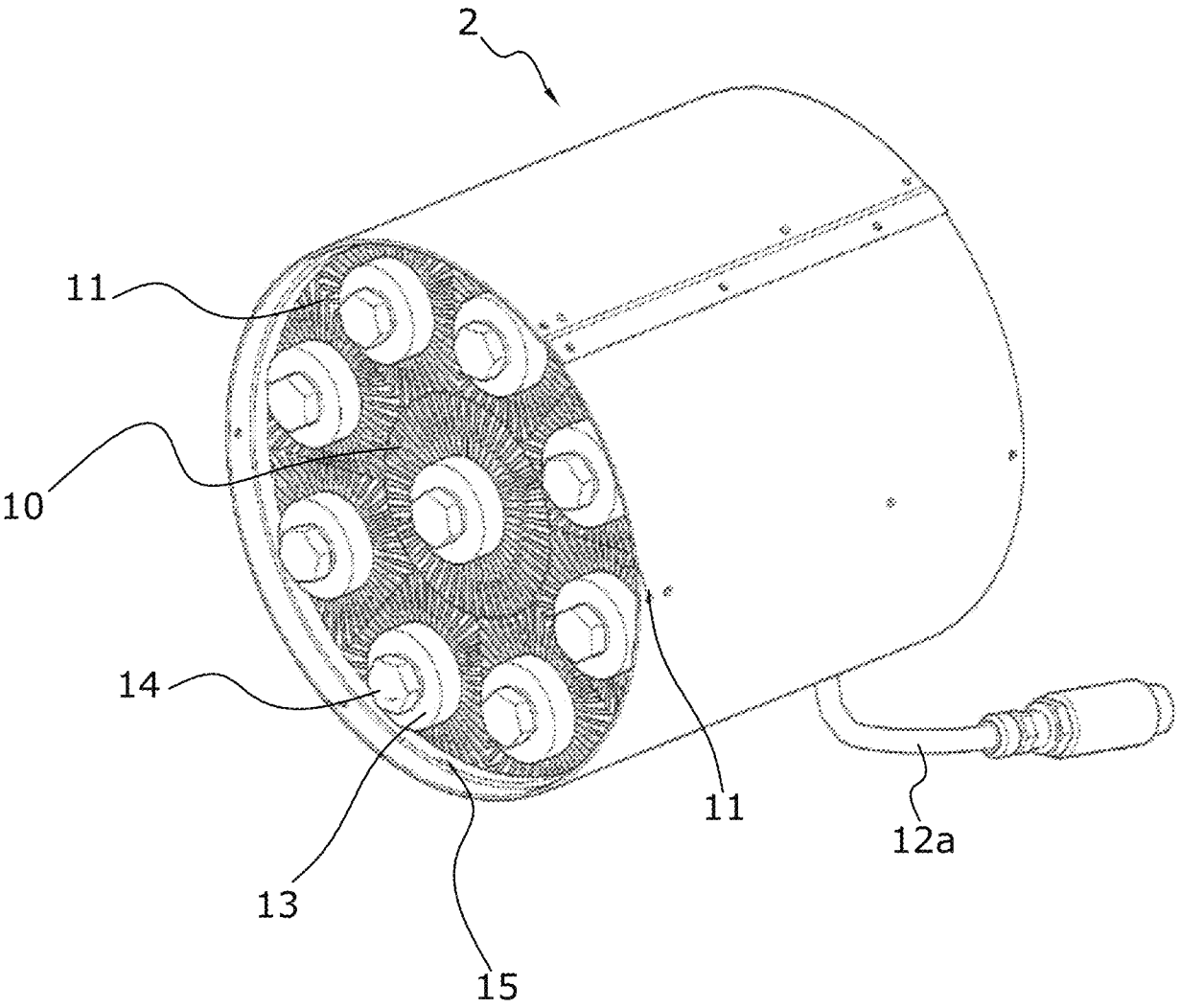
FIG. 3-FIG. 4 shows the assembled heat exchange elements from the embodiment from FIG. 1, viewed from opposite end portions of the heat exchange element.

FIG. 3 discloses the heat exchanger 2 according to the invention in greater detail. The heating element 2 comprises a plurality of heat exchange elements 10, 11. Each heat exchange element 10, 11 has a core defining a core cavity 20, 21 in the centre of each of the heat exchange elements 10, 11. The core cavity 20, 21 extends in the longitudinal direction of the heating element 2 with opening in both ends of the core cavity 20, 21. The ends are further defined as a first end 20*a*, 21*a* (see also FIG. 10) of the core and a second end 20*b*, 21*b* of the core cavity 20, 21. The cores 20, 21 are sealed with a first plug 22 in the first end 20*a*, 21*a* and a second plug 13 at a second end of each of the respective cores 20, 21. The cores 20, 21 are adapted to be filled with heating agent or alternatively a coolant depending on the purpose of the heat exchanger.

FIG. 3 further shows a centre heat exchange element 10 defining the centre of the heat exchanger 2 and a plurality of external heat exchange element 11 located adjacent or in proximity of the centre heat exchange element 10.

At least one ring 15 is extending around the heat exchange elements to lock the heat exchange elements 10, 11 together. The ring 15 is best shown in FIGS. 5-9. In these figures, there are illustrated two rings 15 extending around the heat exchange elements at each end of the heating element 2.

There is also shown a casing 16 extending around the periphery of the heat exchange elements 11.

Figure 4:
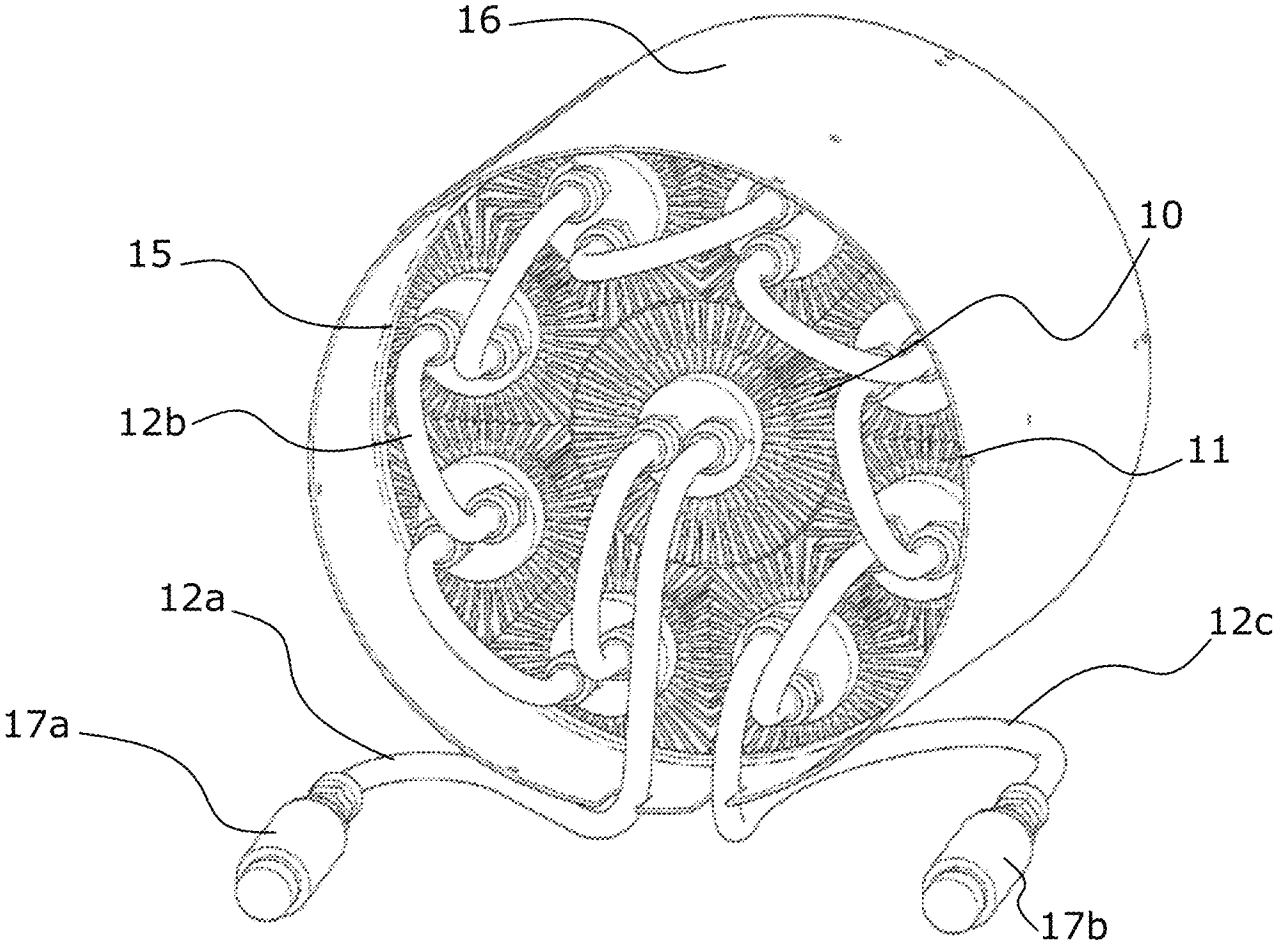

FIG. 4 discloses the heating elements 2, viewed from the opposite side than FIG. 3. There are a plurality of pipes or tubes 12*a*, 12*b*, 12*c* arranged between the cores 20, 21 in order to establish a fluid communication between the cores 20, 21. The pipe or tubes 12*a*, 12*b*, 12*c* could also be arranged so that the cores are coupled in parallel configuration instead of the serial configuration shown. This will be described later.

An inlet pipe or tube 12*a* forms the link between the supply source (not shown) of the heating fluid and the inlet of the first end 21*a* of the centre core cavity 21 in the centre heat exchange element 10. The free end of the pipe or tube 12*a* preferably has a male sleeve coupling 17*a* for quick and easy connection with the supply source. This connection is preferably drip-free.

The connection could be a quick release coupling both to the supply tube or supply pipe and to the discharge tube or discharge pipe.

There is another pipe or tube 12*b* extending between a first end 21*a* of the centre core cavity 21 and a first end 20*a* of the external core cavity 20. In addition, there are similar pipe or tubes 12*b* extending between two lateral external cores 20 of the external heat exchange elements 11 as shown in FIG. 4.

Different configurations for the connection between the heat exchange elements 10,11 are shown in FIGS. 25-31. It is also possible to make the heat exchanger 2 in one element with several core cavities 20, 21. This is described below.

The outlet pipe or tube 12*c* is in one end coupled to the first end 20*a* of an external core cavity 20 and the other end is adapted to be connected to a device for receiving the fluid flowing through the core cavity and which is to be heated or cooled.

The free ends of the outlet pipe or tubes are adapted to be connected to arrangements for supply of fluid and discharge of fluid from the core. For instance, the free ends of the outlet pipes of tubes 12*a*, 12*c* could be provided with quick release coupling for connecting with pipes of tubes attached to the supply/discharge arrangement. Other connection arrangement are also possible.

The inlet pipe 12*a* could optionally be arranged in connection with one of the external cores cavities 20 and the outlet pipe 12*c* could optionally be arranged in connection with the centre core cavity 21. Different arrangements of the Inlet and outlet pipe or tube to any of the external core cavity 20 or to the centre core cavity 21 are possible embodiments of the invention. The FIG. 4 shows just one possible arrangement.

Figure 31:
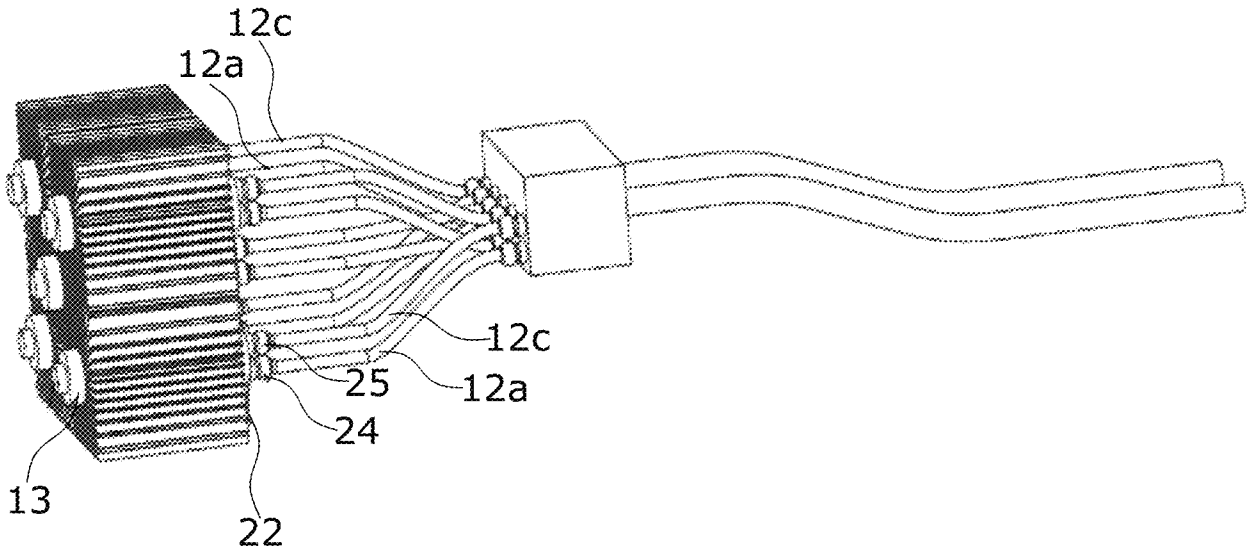

Another possible embodiment of the arrangement of the pipes 12*a*, 12*c* is that there are separate inlet pipes or tubes 12*a* and separate outlet pipes or tubes 12*c* to cores 20, 21 and that there is no fluid connection as pipe or tube 12*b* between the cores 20, 21. This is illustrated in FIG. 31.

Figure 5:
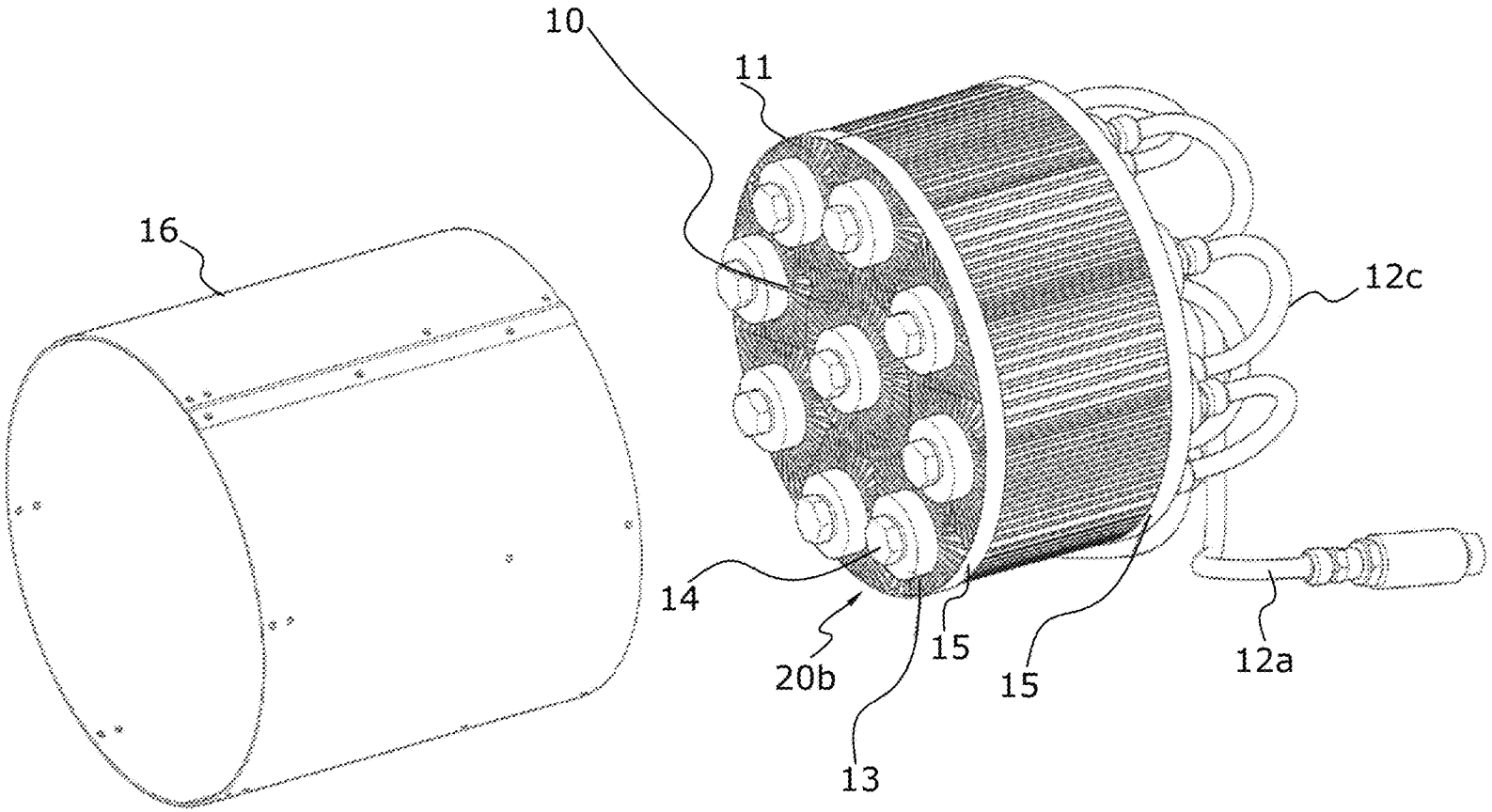
FIG. 5-7 shows the heat exchange elements without the casing.
Figure 6:
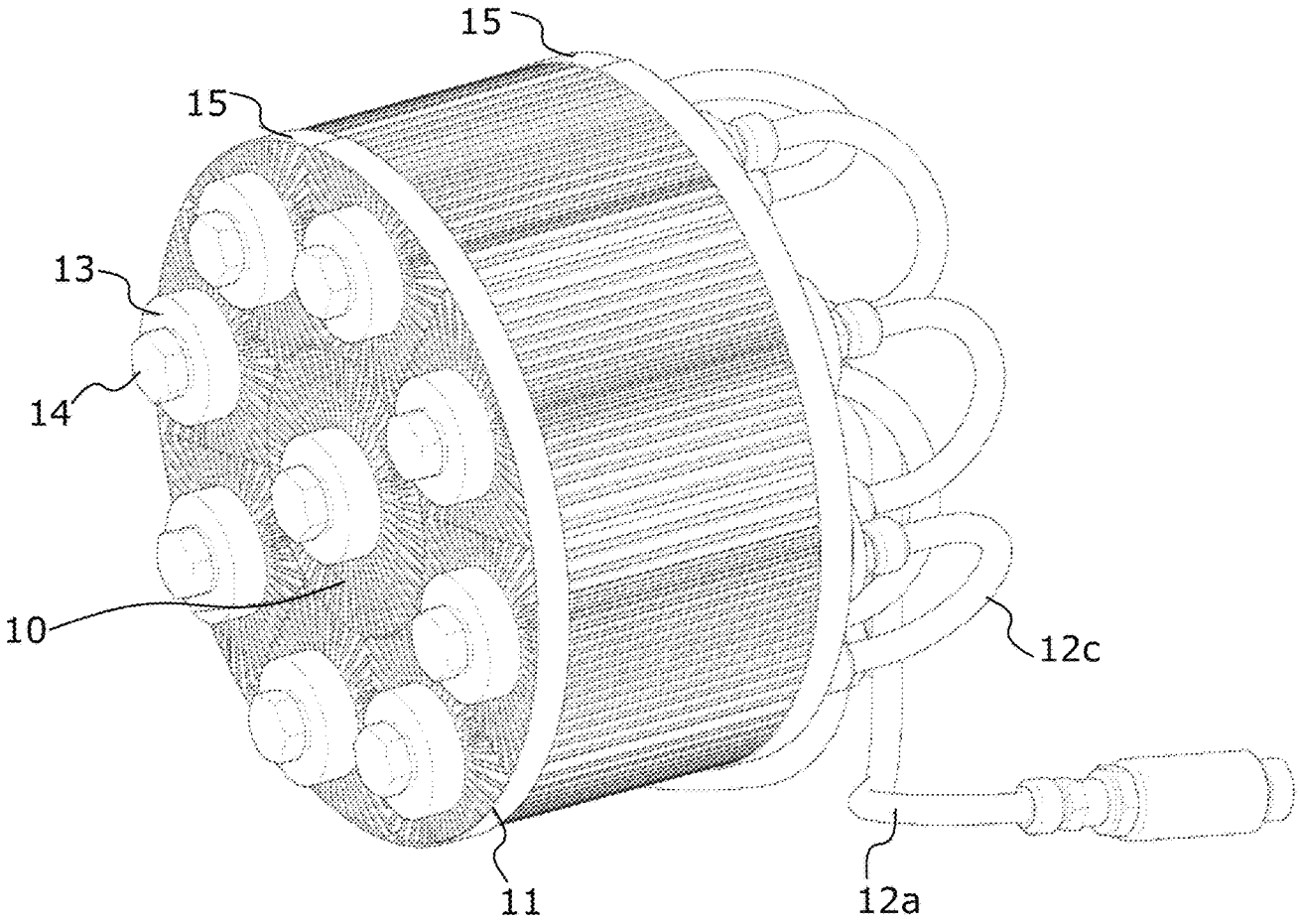
Figure 7:
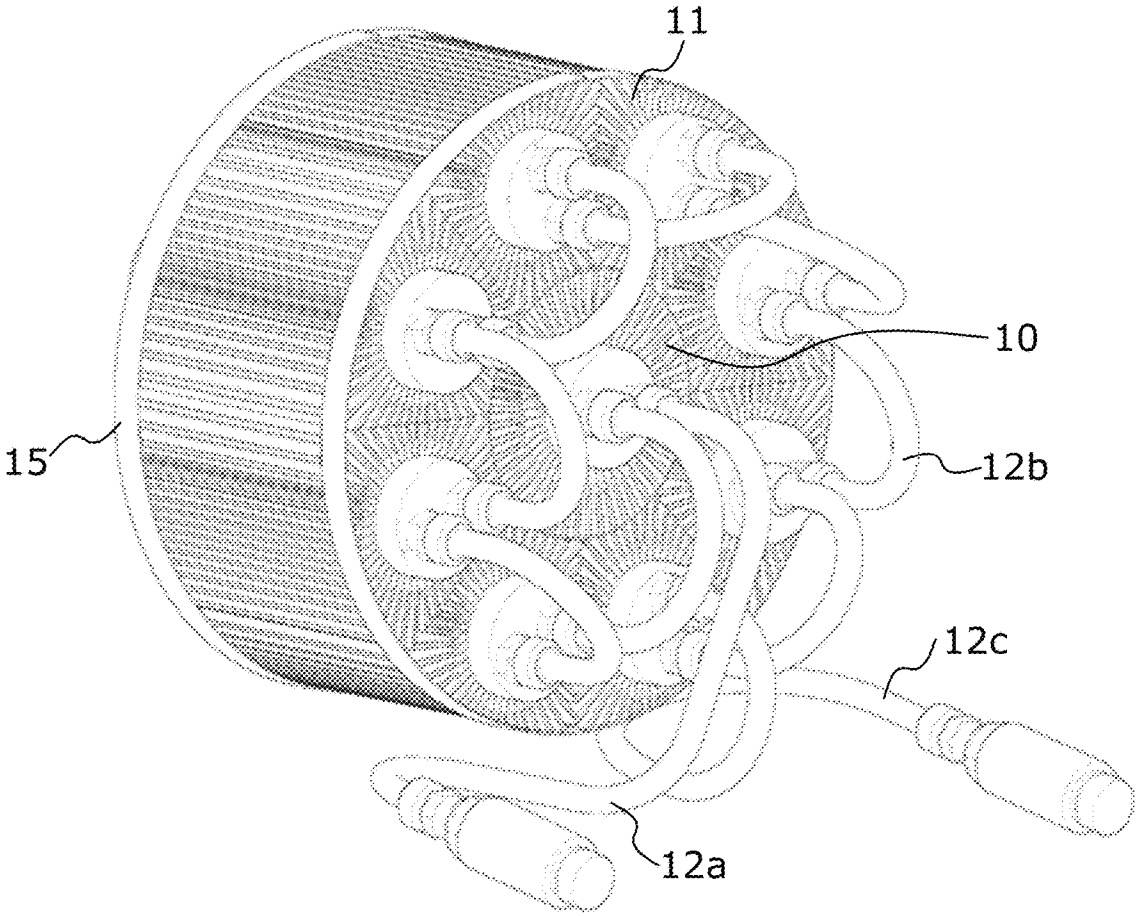

FIGS. 5, 6 and 7 shows the heating element 2 without the casing 16. The position of the rings 15 extending around the periphery of the external heat exchange elements 11 are shown in greater detail in this figure.

The heat exchanger are in FIGS. 5 and 6 viewed from the second, or front, side, i.e. the opposite side of the heating or cooling fluid inlet and outlet. The core cavities 20, 21 are in this second end sealed with second plugs 13 and screws 14. The second plug 13 has packer element 13*a* (see FIG. 12) that provide a sealing closure between the core cavity 20, 21 and the plug 13.

In FIG. 7 the heating element is viewed from the first end, i.e. the inlet and outlet side of the heating or cooling fluid.

Figure 8:
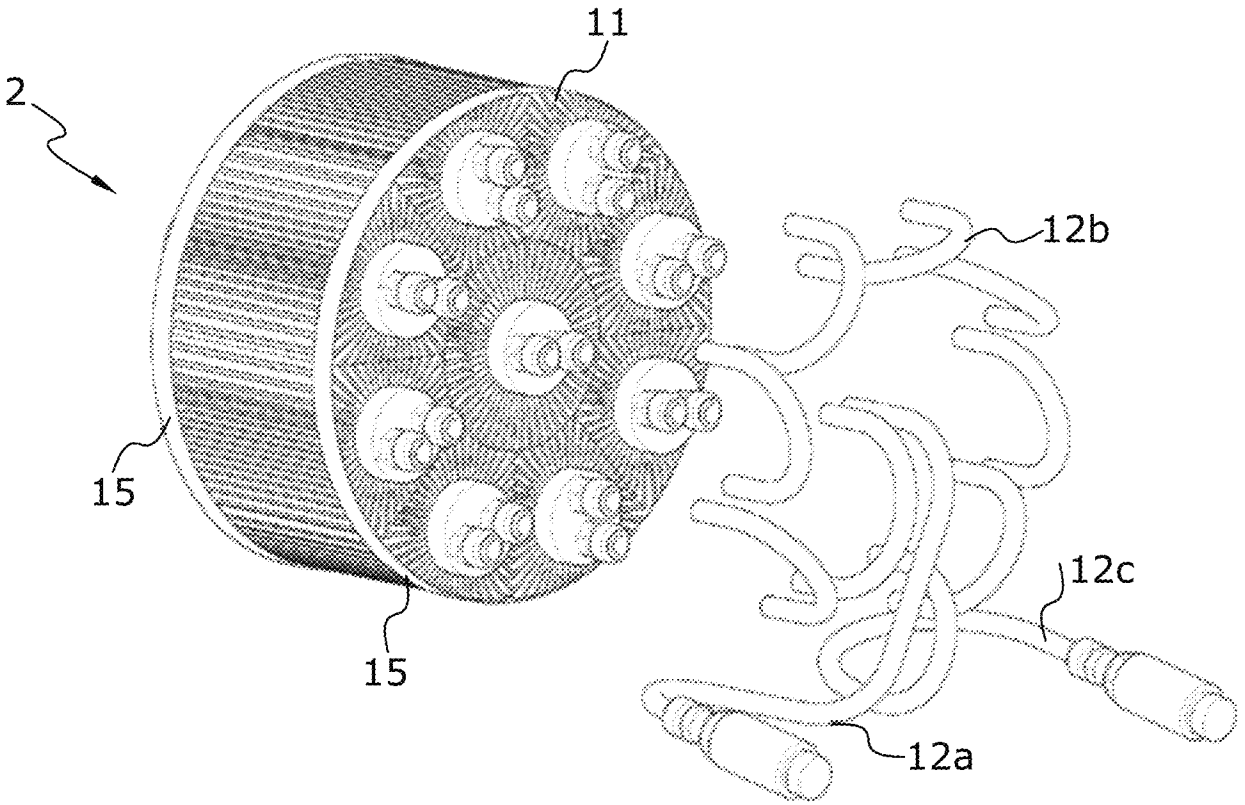
FIG. 8-9 shows an elevated view of the heating element without pipes or tubes.

FIG. 8 shows an elevated view of the heating element 2 where the pipes or tubes 12*a*, 12*b*, 12*c* are removed.

Figure 9:
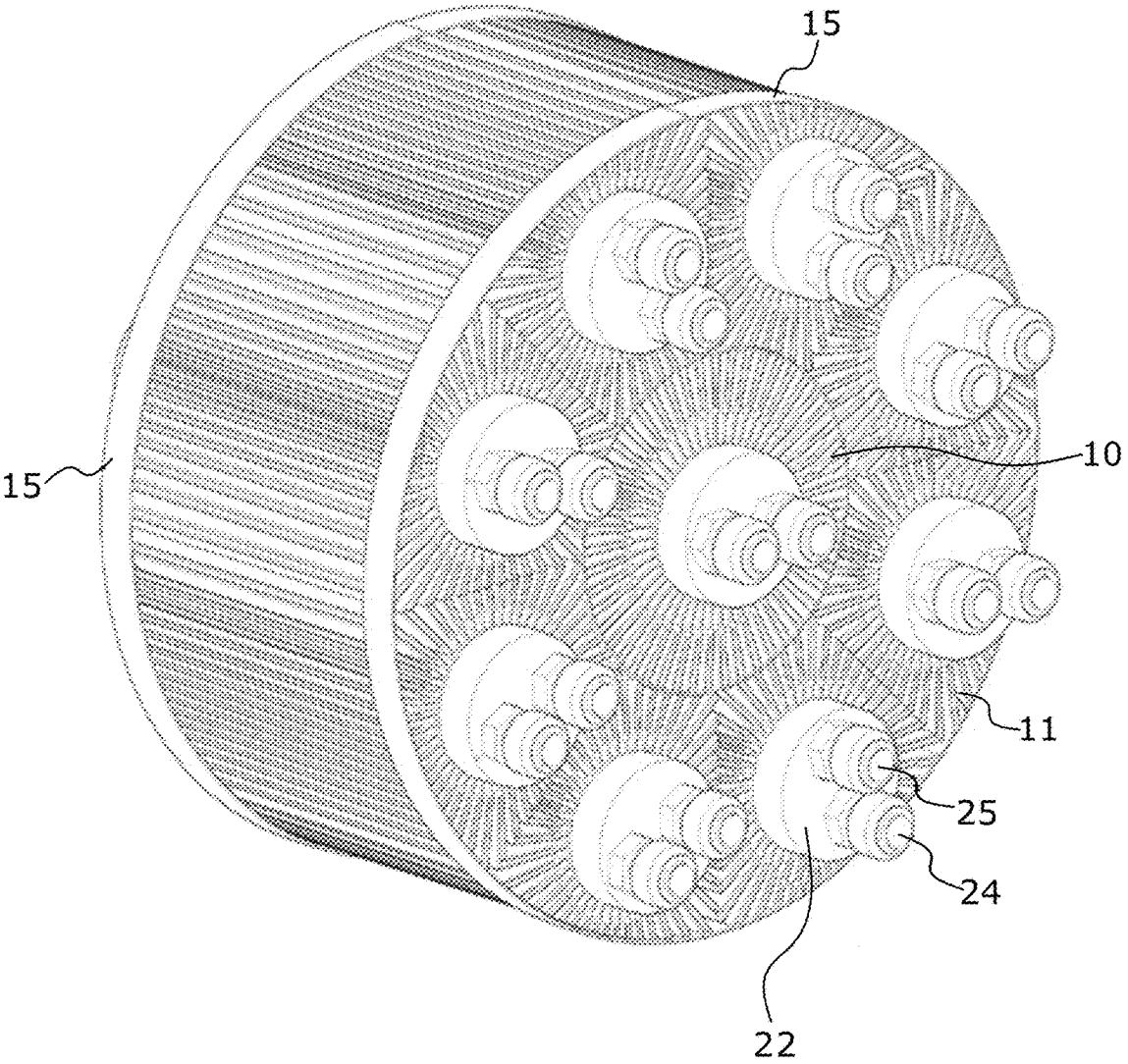
Figure 10:
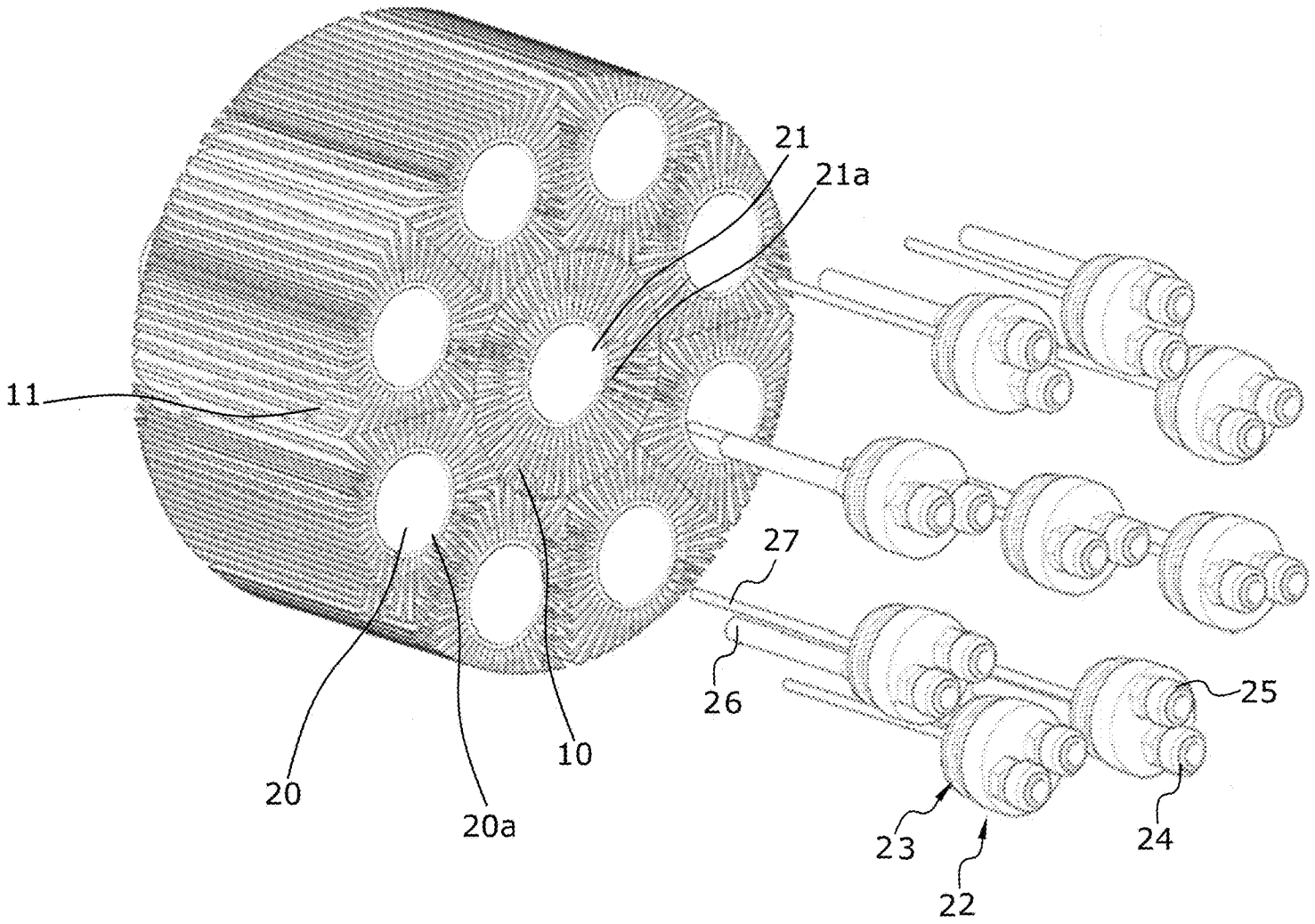
FIG. 10 shows an elevated view of the heat exchange elements and the first plugs and fluid supply arrangement.
Figure 11:
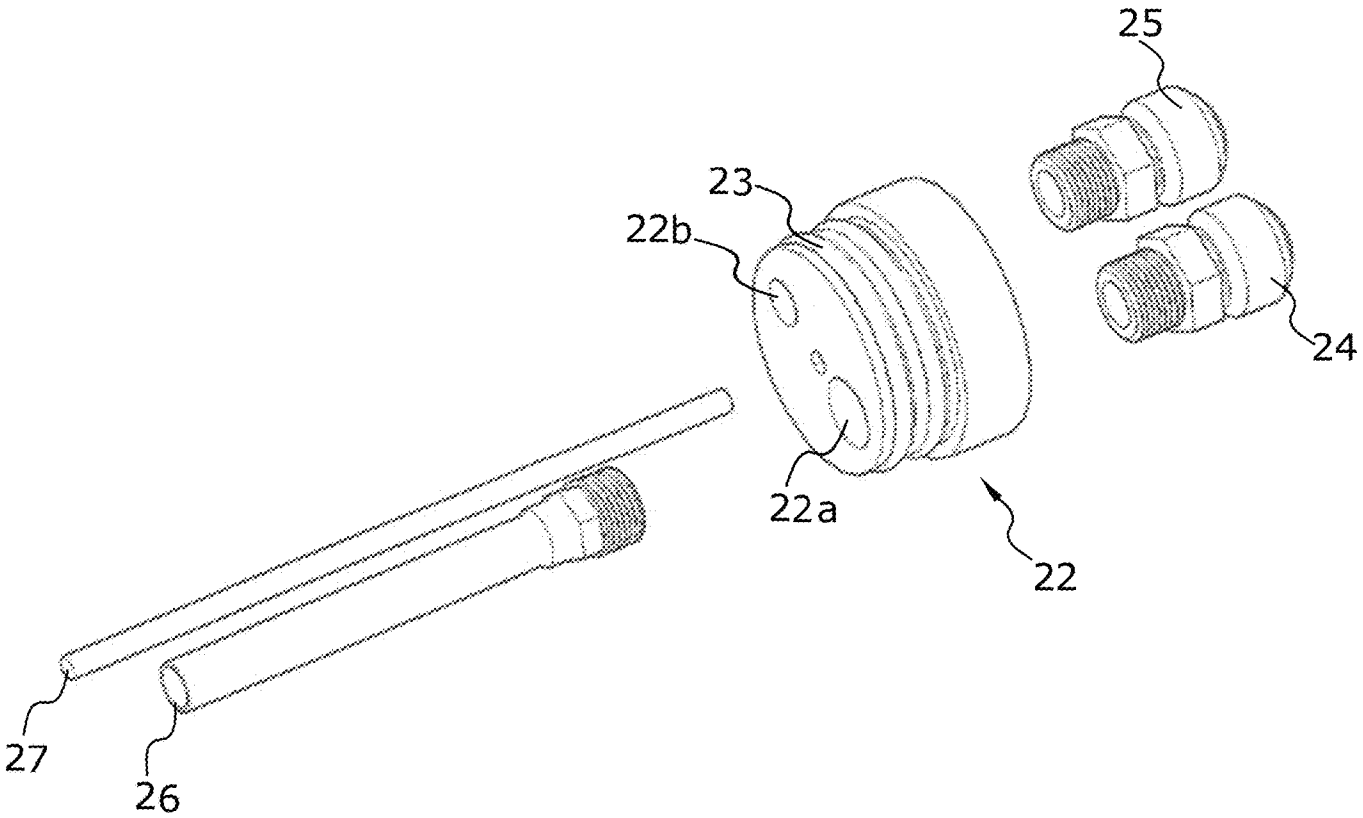
FIG. 11 shows an elevated view of a first plug with inlet and outlet adapter and guiding pipe.

FIGS. 9 and 10 shows the heating element without the pipe or tubes 12*a*, 12*b*, 12*c*. At the first ends of the core cavities 20, 21 there are arranged first plugs 22, each with a sealing packer element 23 (see FIGS. 10 and 11). The first plug 22 has similar configuration as the second plug 13 and is arranged in each of the core cavities 20, 21 at the first end 20*a* and the second end 20*b* to provide a seal tight connection between the core surface 20*c*, 21*c* and the first plug 22 and the second plug 13.

The first plug 22 comprises two openings or holes 22*a*, 22*b*, hereinafter referred to as an inlet port 22*a* and an outlet port 22*b*. The openings or ports are extending through the first plug 22. The ports 22*a*, 22*b* are arranged next to each other. In connection with the respective ports 22*a*, 22*b* there is arranged an inlet adapter 24 and an outlet adapter 25 at the outside of the first plug 22. The inlet and outlet adapters 24, 25 connects the respective inlet pipe or tube 12*a* (FIG. 4) and outlet pipe or tube 12*c* (FIG. 4) together with the first plug 22 and consequently there is a fluid communication established between the pipe or tubes 12*a*, 12*b*, 12*c* and the core cavity 20, 21 through the ports 22*a*, 22*b*.

At the inside of one inlet port 22*a*, at the inside of the first plug 22, there is arranged a small pipe 26 which can be screwed into the inlet port 22*a* for instance in connection to the inlet adaptor 24 of the first plug 22. This pipe 26 is extending towards the second plug 13 at the inside of the core cavity 20, 21 in order to provide circulation of the heating fluid in the core cavity 20, 21. This will be described in further detail below. The first plug 22 and the components attached to the plug 22 is shown in greater detail, in elevated view in FIGS. 11 and 12.

Figure 12:
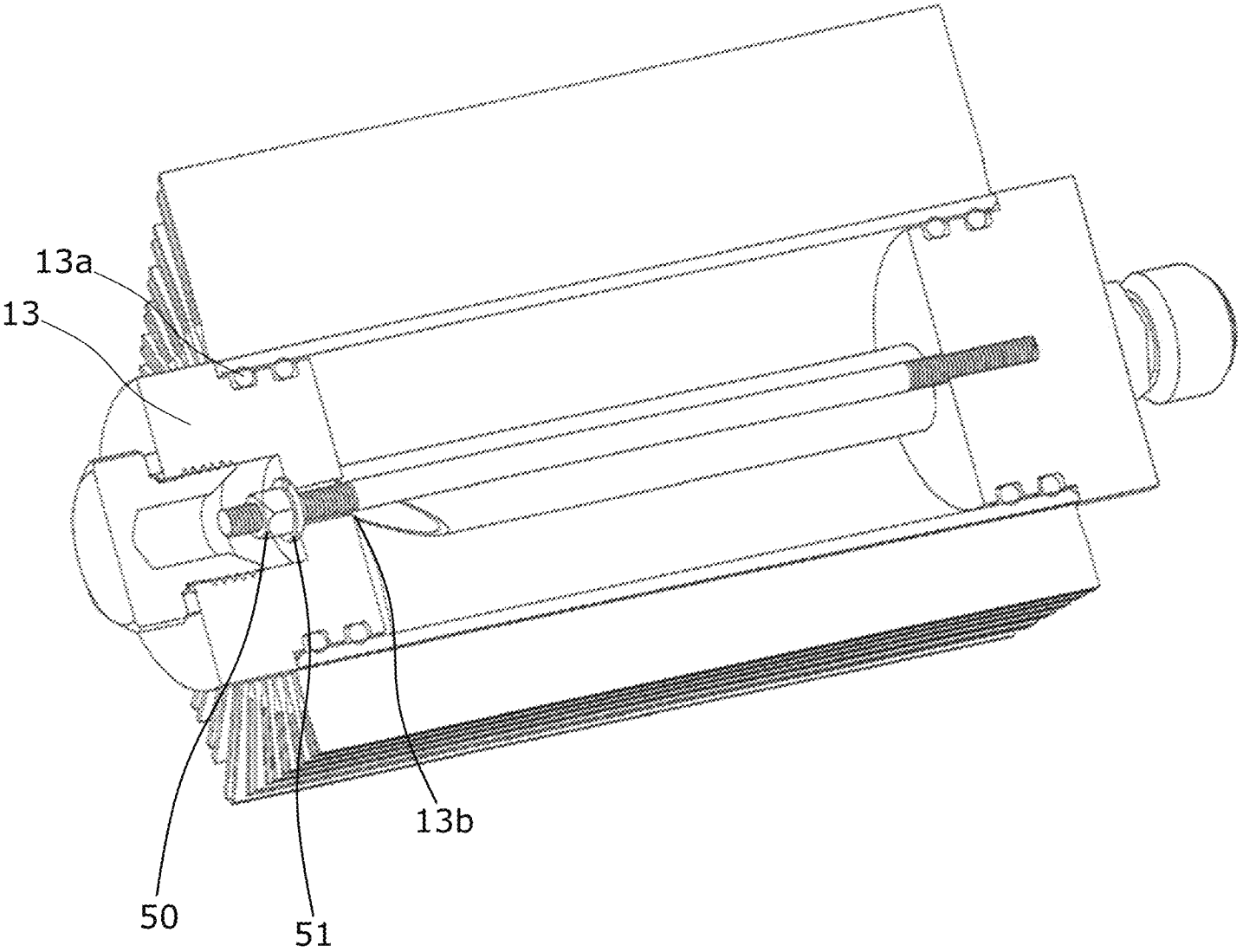
FIG. 12 shows a cross section of the core of the heat exchange element with plugs arranged at both ends of the core and a threaded rod extending between the plug.

A threaded rod 27 extends through the core cavity 20, 21 and is attached to the first plug 22 in a first end. A second end is extending through an opening or hole 13*b* in the second plug 13 (shown in FIG. 12). A nut 50 and washer 51 (FIG. 12) is arranged at the second end of the rod 27 to secure the second plug 13 to the core cavity 20, 21 via the rod 27. The threaded rod 27 is securing the first plug 22 and the second plug 13 (FIG. 6, 12) together at both ends of the core 20*a*, 20*b*, 21*a*, 21*b*. This is shown in FIG. 12.

Figure 13:
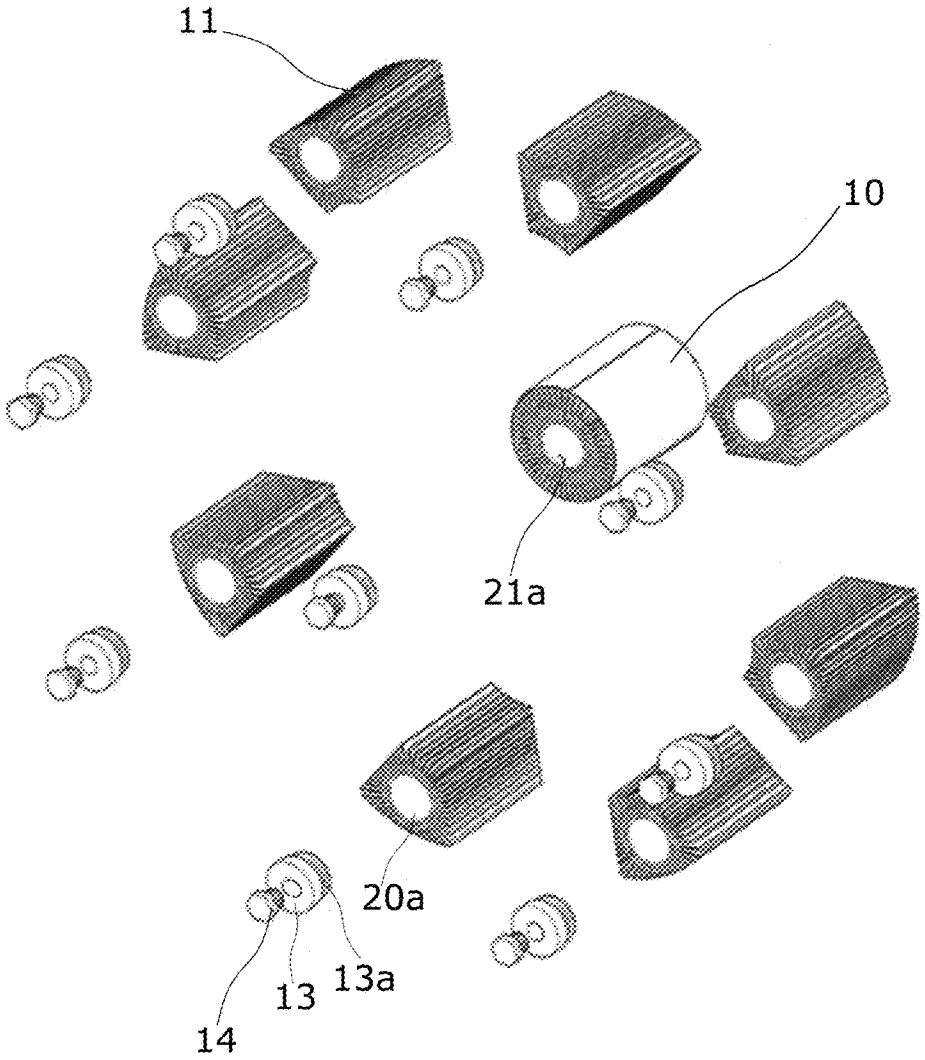
FIG. 13 shows an elevated view of the external heat exchange elements and the centre heat exchange element.

FIG. 13 shows an exploded elevated view of the external heat exchange element 11 and the centre heat exchange elements 10.

The centre heat exchange element 10 is in this embodiment surrounded by external heat exchange element 11 in a circle around the periphery of the centre heat exchange element 10. The surface of the external heat exchange element 11 has at the side facing the centre heat exchange element 10, a curved shape which is complementary to the shape of the outer surface of the centre heat exchange element 10.

Figure 24:
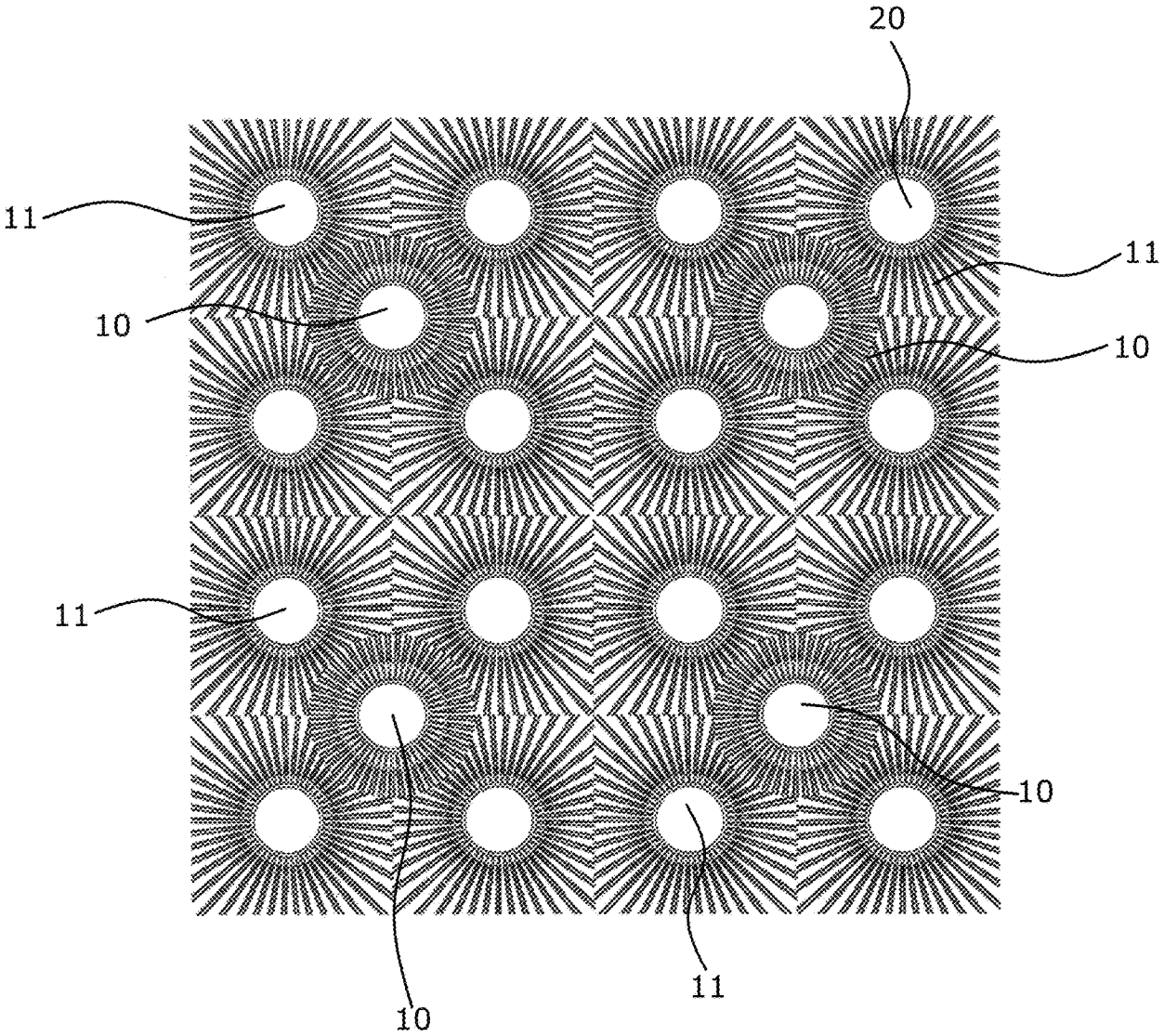
Figure 25:
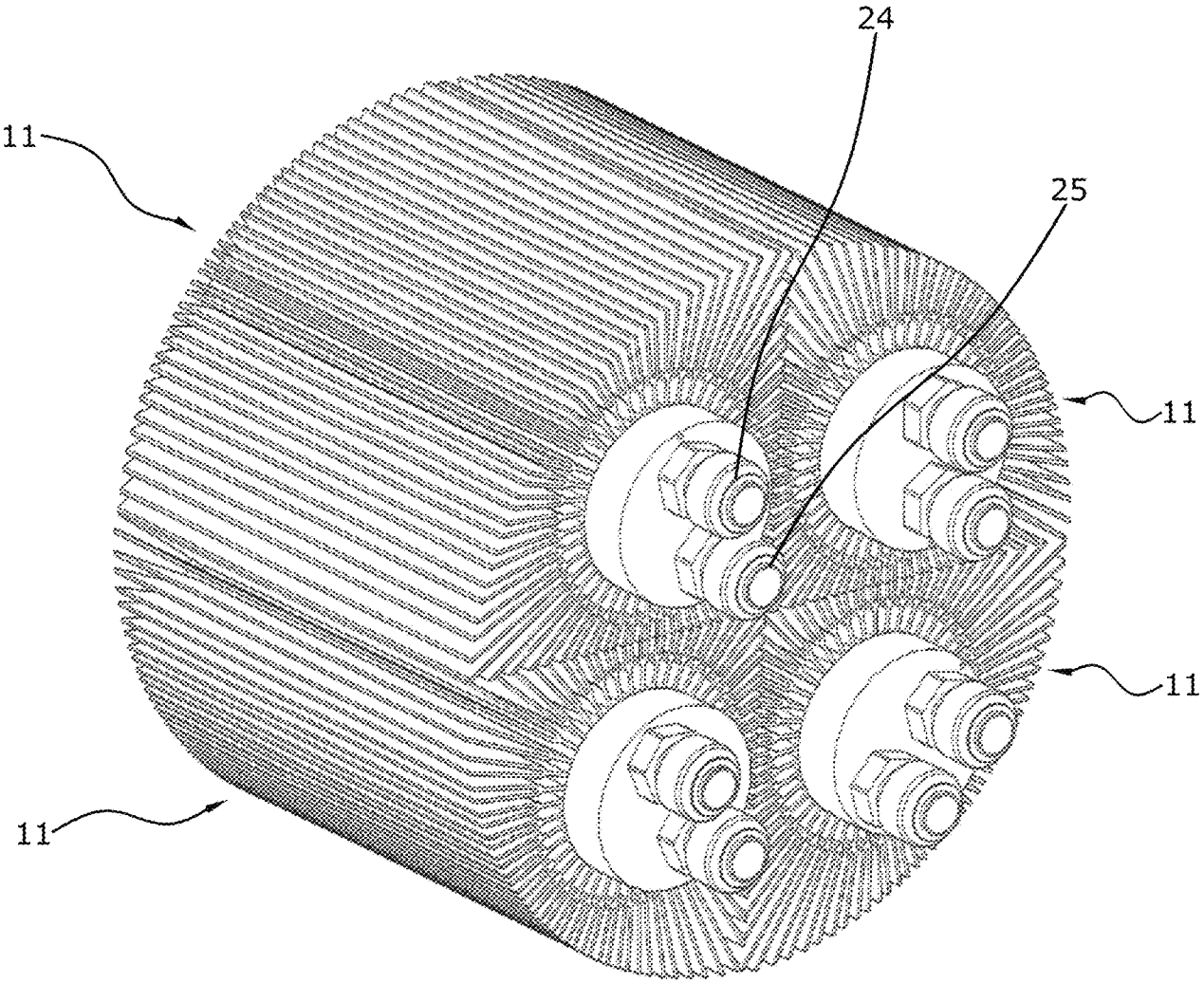
Figure 26:
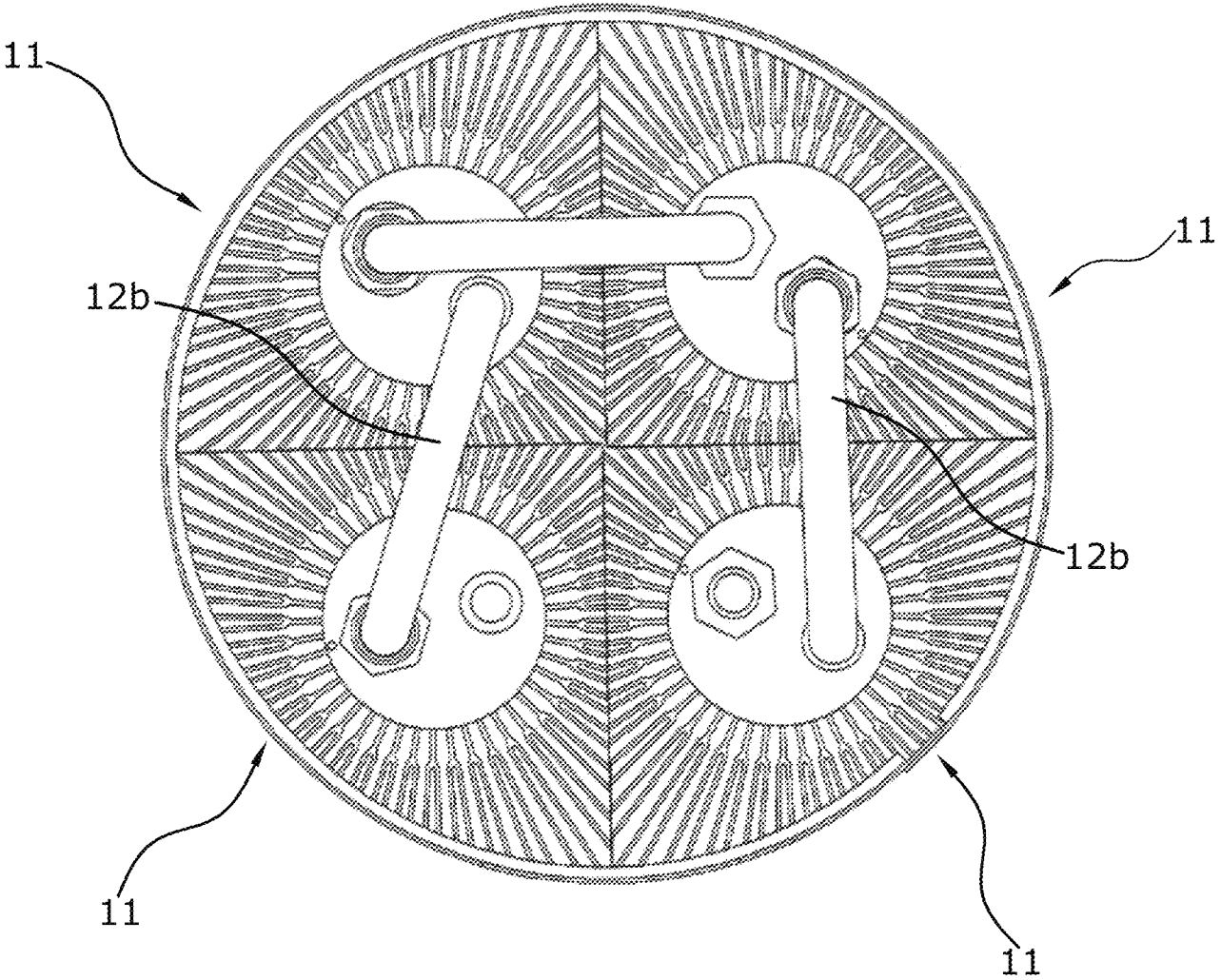

Other embodiments of the invention could have other shapes as shown in the accompanying drawings, as seen particularly in FIG. 25-26 where there is no centre heat exchange element 10. The outer periphery of the external heat exchange element 11 could also have different shapes depending on the shape of the casing surrounding the external heat exchange element 11, such as in particular shown in FIGS. 21-29.

Figure 14:
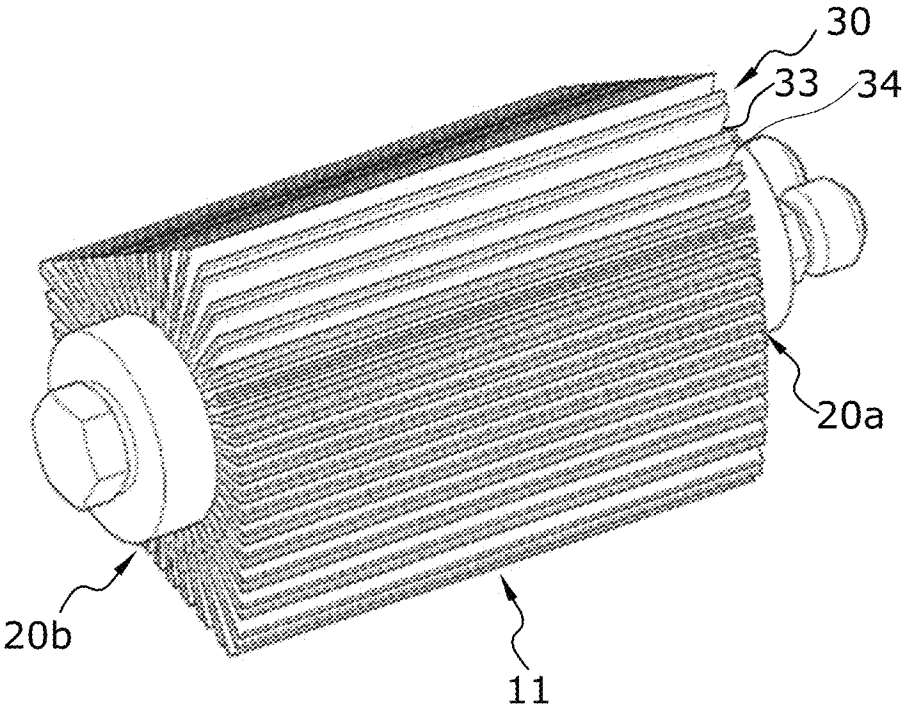
FIG. 14 shows a principle drawing of one single external heat exchange element.

FIG. 14 shows a principle drawing of a single external heat exchange element 11 with a core cavity 20 extending from a first 20*a* end to a second end 20*b*. The core cavity 20 is at the ends delimited by the first plug 22 and the second plug 13. The core cavity 20, 21 has a cylindrical shape, but other shapes are also possible, for instance cubical. This applies both for the centre heat exchange element 10 and the external heat exchange element 11.

The external heat exchange element 11 as well as the centre heat exchange element 10 comprises a plurality of longitudinal ribs 30. Each rib 30, 31 is extending substantially in parallel with the core cavity 20, 21 and radially outwardly from a surface defining the core cavity 20, 21.

Figure 15A:
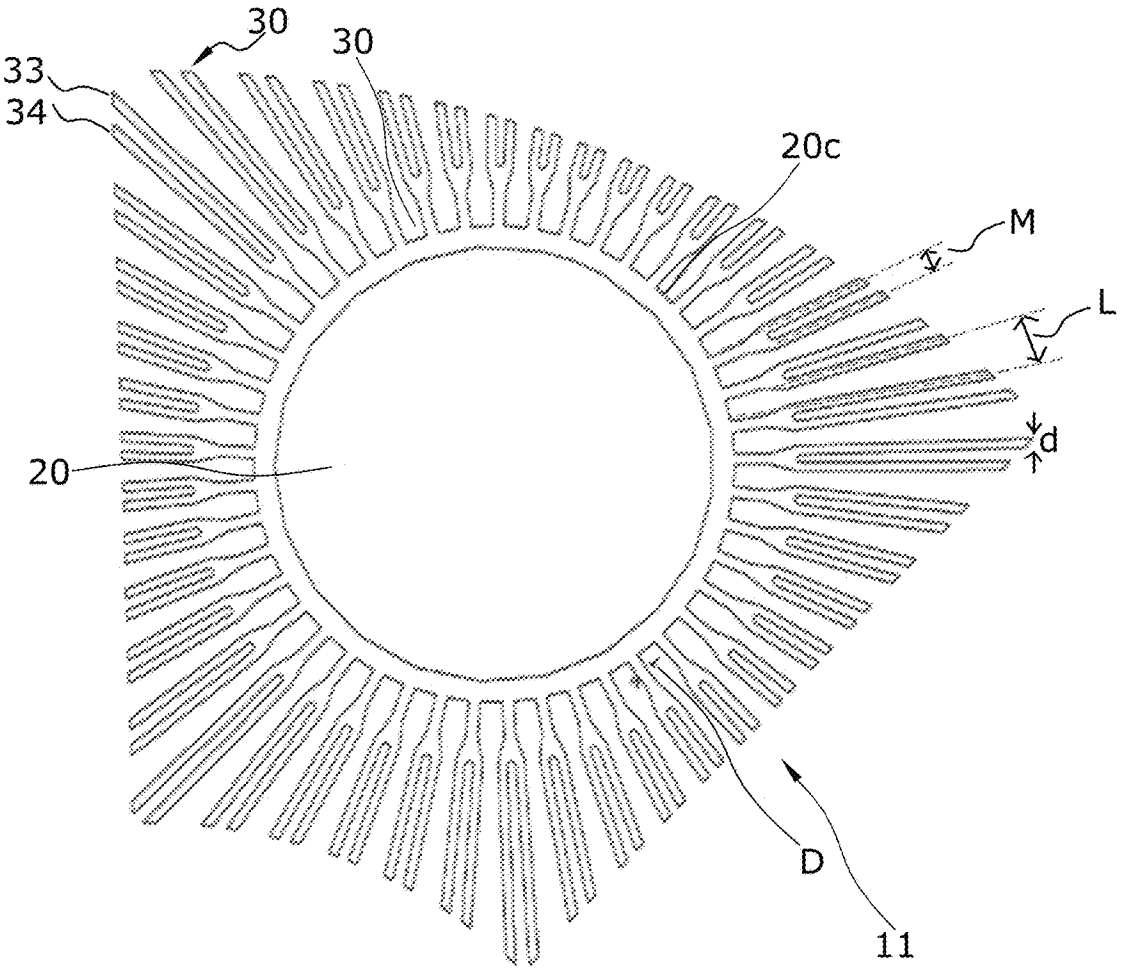
FIGS. 15*a* and 15*b* shows a detailed view of different embodiments of the ribs and fins of the external heat exchange element from FIG. 14.
Figure 15B:
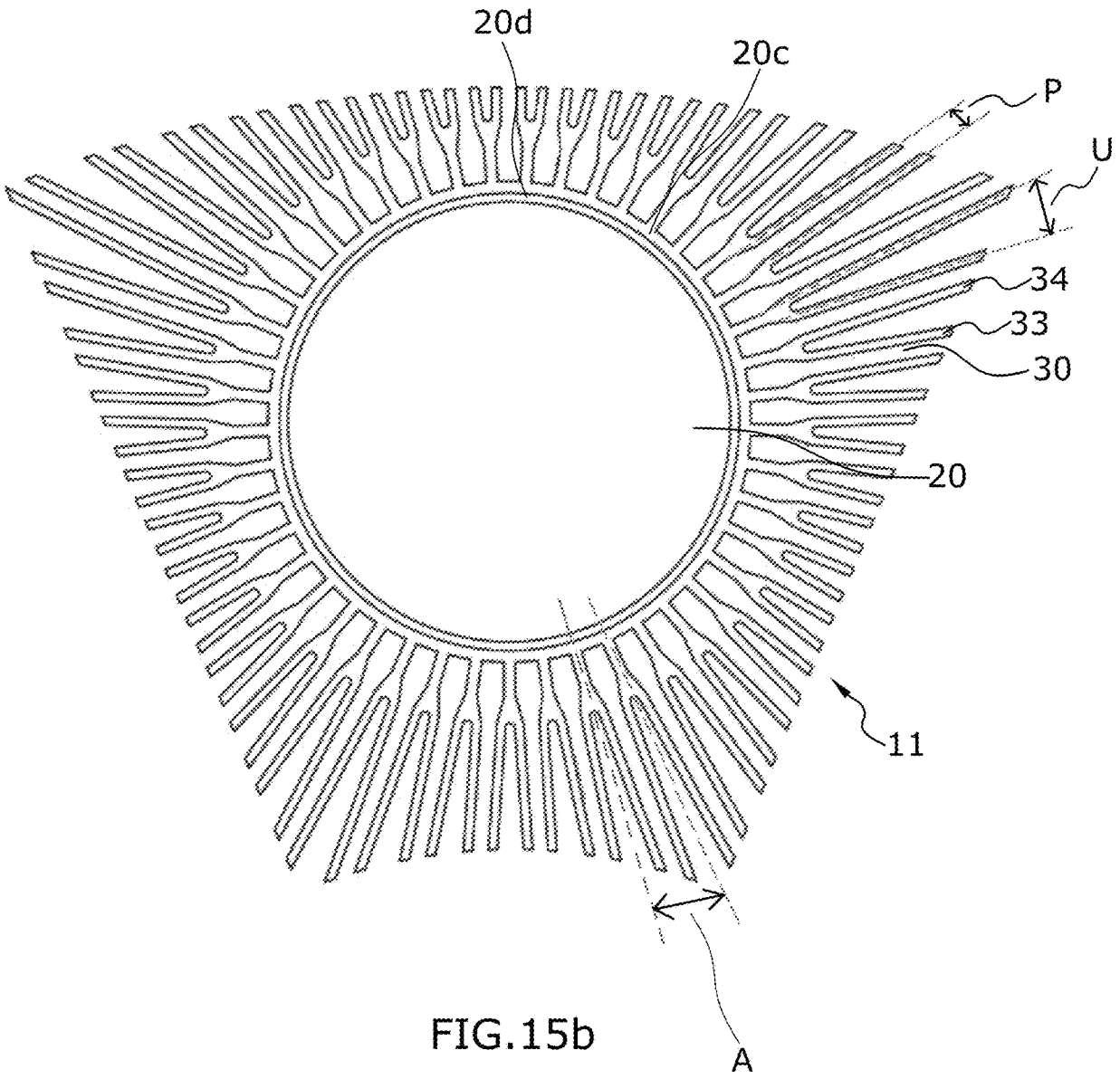

FIGS. 15*a* and 15*b* shows different embodiments of the ribs 30 and fins 33, 34 of the external heat exchange element 11.

FIGS. 16-17 and FIG. 38-39 shows detailed view of different embodiments of the centre heat exchange element 10.

The surface defining the core cavity 20, 21 is shown as a core surface 20*c*. The ribs 30, 31 are extending radially outwardly from the core surface 20*c*.

The ribs 30 are preferably made of metal or with a smooth surface so as to provide low surface friction, enabling the heated or cooled fluid to pass through the heat exchange element with a minimum of resistance from the ribs 30.

At a radial distance from the core surface 20*c* the rib is preferably split into two or more fins 33 and 34 to increase the surface area and thus the area that can transfer heat. FIG. 15 shows a first fin 33 and a second fin 34 that are extending substantially parallel to each other radially outwardly towards an adjacent or heat exchange element 10, 11 or an outer casing 11. The shape of the ribs 30, 31 and fins 33, 34, 35, 36 could be different in different configurations of the heat exchangers 2 and are also depending on the use of the heat exchanger 2, 100.

For instance if the viscosity of fluid, flowing through the gaps between the ribs 30, 31, is high, it is more suitable to have a greater distance between the fins 33, 34, 35, 36 and/or the ribs 30. 31 than if the viscosity of the fluid is lower.

The ribs 30, 31 and fins 33, 34, 35, 36 are preferably extending along the whole length of the core surface 20*c*. The radial extent of the ribs 30, 31 and the fins 33, 34, 35, 36 could also be different in different configurations of the heat exchanger 2, 100 to match with the different configurations of the surrounding elements.

The ribs has preferably a thickness D of 0.5-1.5 mm but other thicknesses are also possible embodiments of the invention.

The fins could have a thickness d of 0.5-1.5 mm but other thicknesses are also possible embodiments of the invention.

The ribs 30, 31 and fins 33, 34, 35, 36 are in the FIG. 15*a* equally disposed around the outer surface 20*c* of the core with a minimum space between the ribs 30, 31 and fins 33, 34, 35, 36.

The shape of each extending ribs 30, 31 and fins 33, 34, 35, 36 is arranged so that there is a minimum of gap between each of the heat exchanger elements 10, 11 or between the casing 16 and the heat exchanger element 10, 11 to provide a uniform transmission of heat between the fluids in the heat exchanger.

The fins 33, 34, 35, 36 could preferably have the same thickness d in the whole radial distance from the core surface 20*c*. The ribs 30, 31 could similarly have the same thickness in the radial distance from the core surface 20*c*. The ribs 30, 31 and the fins 33, 34, 35, 36 could have the same thickness or the thickness of the rib could be different from the fins 33, 34. The two fins 33, 34, 35, 36 extending from one rib 30, 31 could be arranged parallel in the radial direction from the core cavity as shown in the FIG. 15*a*. The two fins 33, 34 attached to one rib 30 having equal distance M in the radial distance from the core surface 20*c*. The fins of one ribe are parallel.

The fins 33, 34, 35, 36 could also be arranged so that there is equal distance P between two neighboring fins 33, 34, 35, 36 which means that the two fins 33, 34, 35, 36 extending from one rib 30, 31 is arranged with an angular distance S which are the same between the fins of one rib. The two neighbouring fins of two different ribs are therefore parallel. This is illustrated in FIG. 15*b*.

Another possibility is that all the fins are disposed with the same angular distance between each of the fins (not shown)

The angular distance A between two ribs 30, 31 arranged on the surface of the core 20*c* could also be equal disposed around the whole surface of the core cavity 20, 21.

There could also be more than two fins (33, 34, 35, 36) extending from each rib (30, 31).

Figure 16:
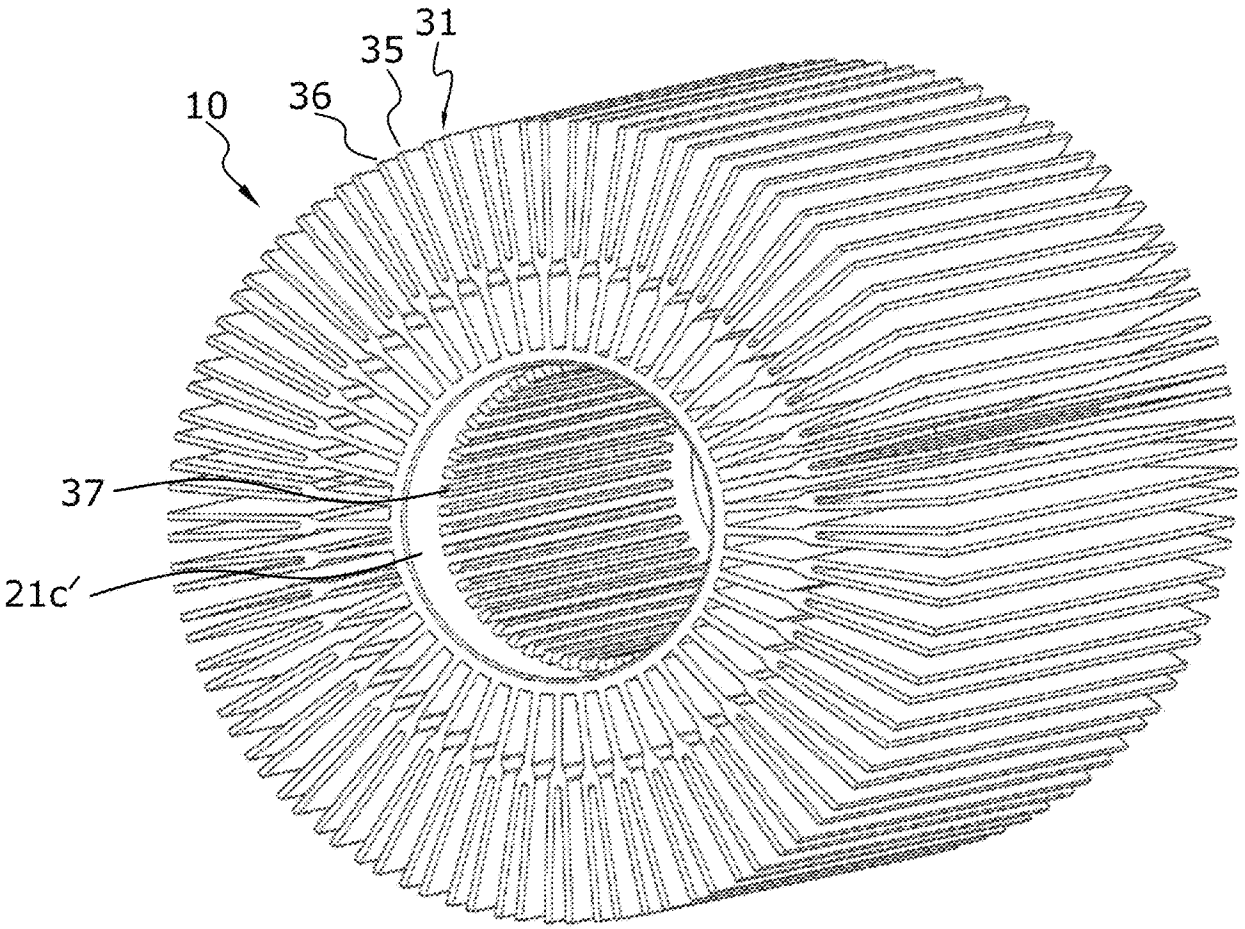
FIG. 16-17 shows a detailed view of different embodiments of the centre heat exchange element.
Figure 17:
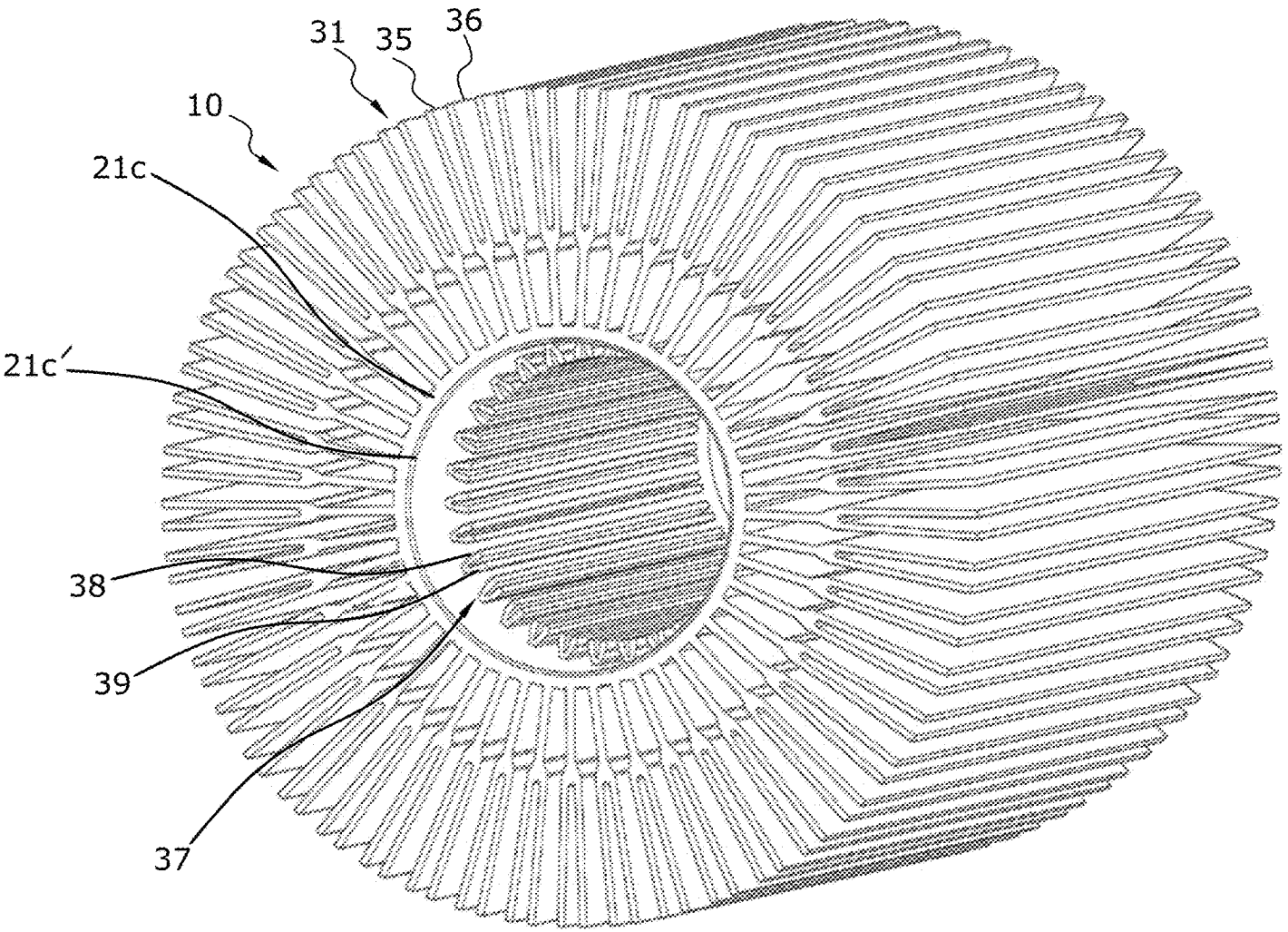

The centre heat exchange element 10 could have similar configuration with ribs 31 and fins 35, 36 as the external heat exchange element 11 described above. FIG. 16-17 shows one embodiment of the ribs 31 and fins 35, 36 with similar shape as described in FIG. 15*a*.

Each of the fins 33, 34, 35, 36 of the centre or the external heat exchanger element 10, 11 that are facing the casing 16 are extending to a proximity of the outer casing 16. The remaining fins 33, 34, 35, 36 are extending to a proximity of the fins 33, 34, 35, 36 of an adjacent or nearby heat exchanger element 10, 11. Each of the fins has thus a shape so that there is a uniform distribution of fins throughout the whole heat exchanger and that there is no voids between the casing 16 and the different heat exchanger elements 10, 11 or between the juxtaposed heat exchanger elements 10, 11. This is illustrated in the FIGS. 2-10 and FIG. 21-30.

The inside surface of both the centre heat exchange element 10 and the external heat exchange element 11 could also have different embodiments.

In FIG. 16-20 there are shown examples with inner ribs 37 extending radially inwards from the inner core surface 20*c*' illustrated on a centre heat exchange element 10. The external heat exchange element 10 could as an option have ribs 37 of different shapes extending radially inwards from the inner core surface 20*c* similar to the embodiments of the centre heat exchange elements 10 shown the FIG. 16-18.

In a further embodiment of the invention, each of the inner ribs 37 could be split into two radially extending fins 38, 39 as shown in FIG. 17.

Figure 18:
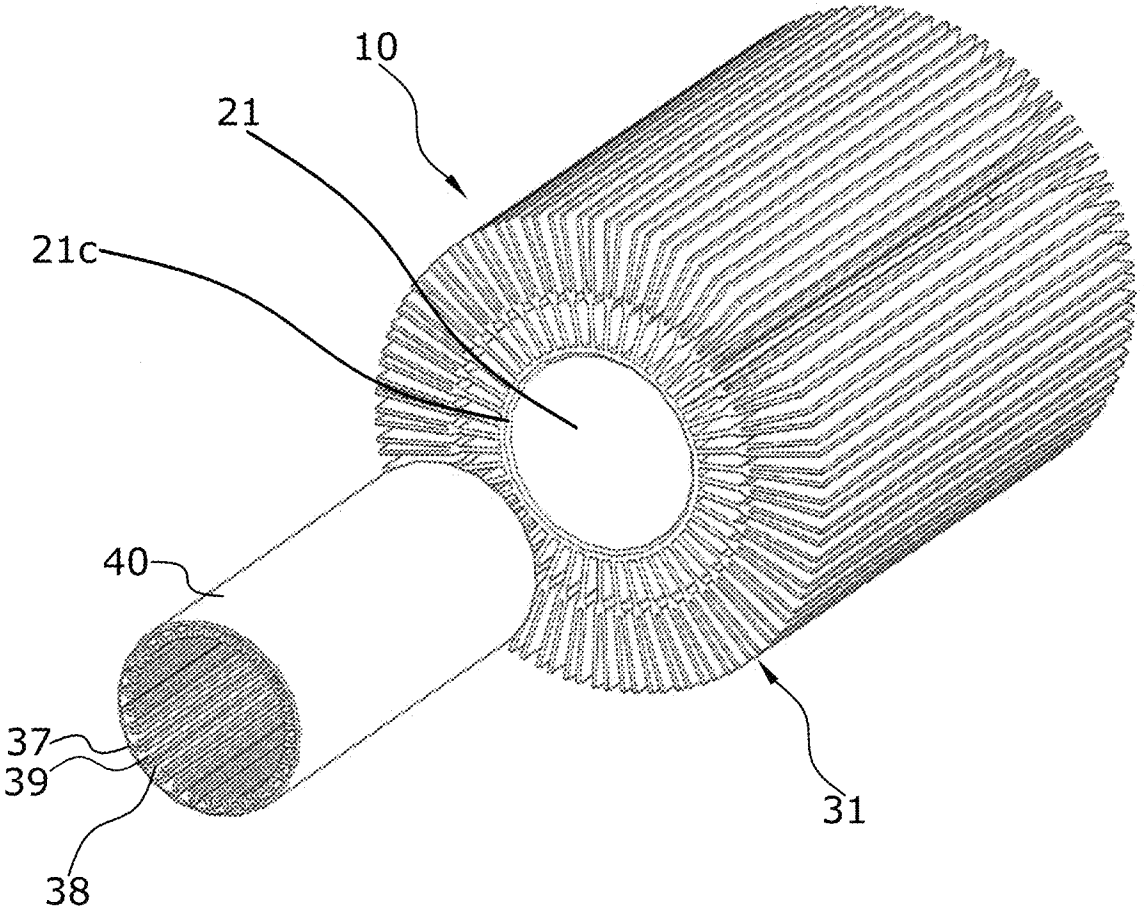
FIG. 18 shows a detailed view of another embodiment of the centre heat exchange element with a separate inner core element with ribs.

The inner ribs 37 could optionally be arranged in a separate inner core element 40 that may be press fit into the centre heat exchange element 10 at the inside of the core surface 21*c*. This is shown in FIG. 18. This separate inner core 40 shown in FIG. 19-20 could also be suitable for use in external heat exchange element 11.

Figure 19:
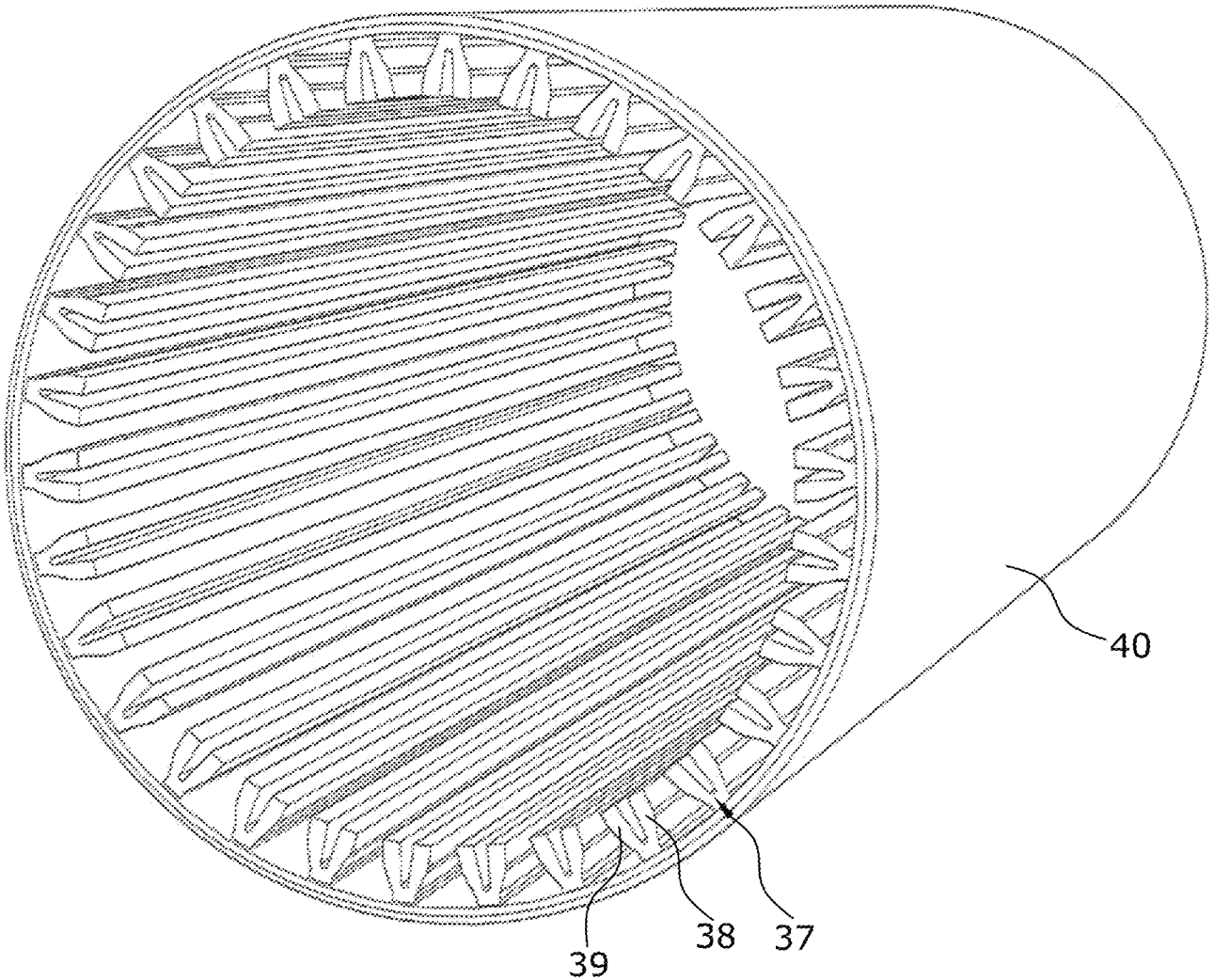
FIGS. 19-20 shows different embodiments of inner core elements with ribs.
Figure 20:
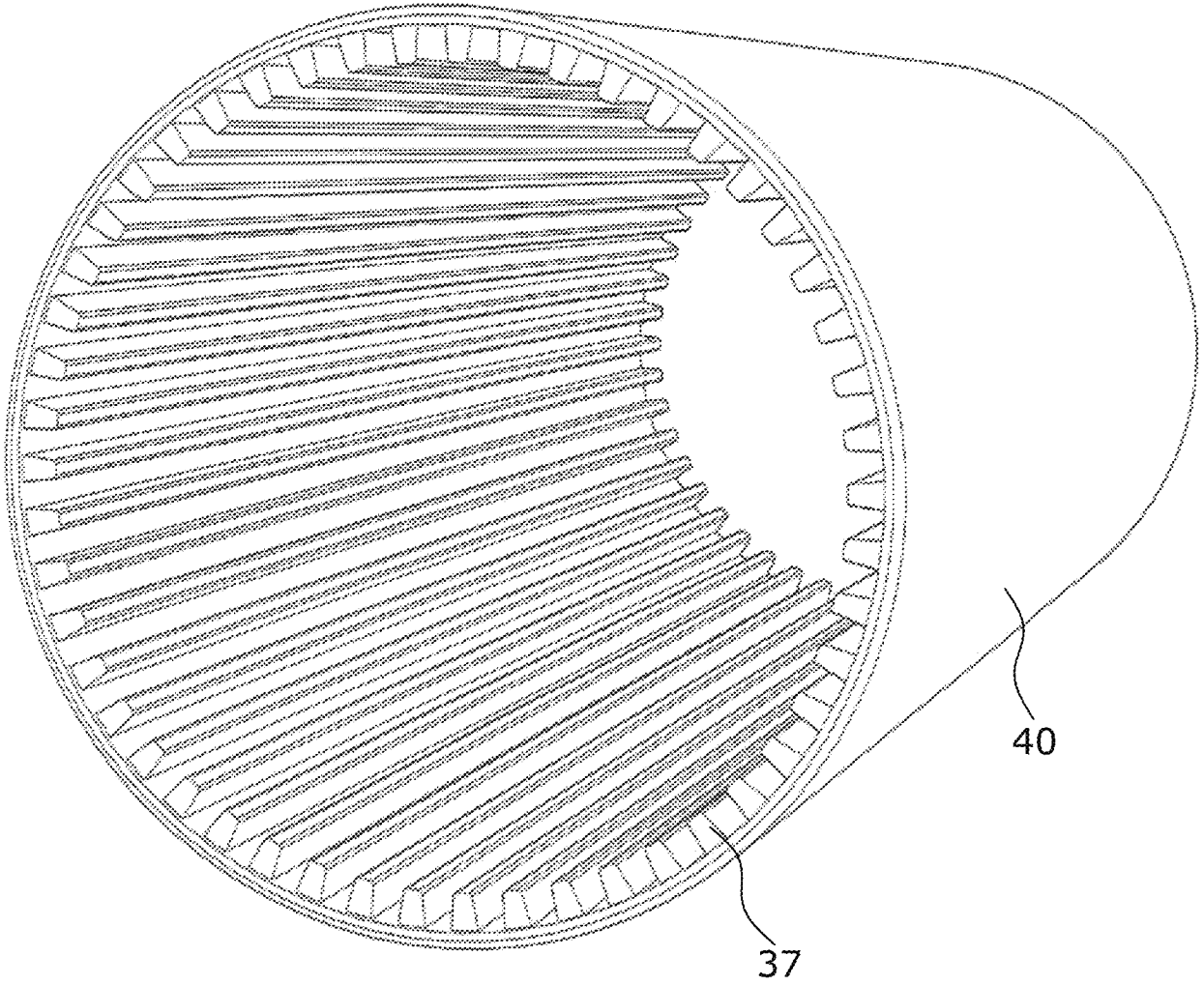

FIGS. 19 and 20 show the inner core element 40 separated from the centre heat exchange element 10 with different configurations of the inner ribs 37.

The inner core surface 21*c*' of the centre heat exchange element 10 could also be smooth as shown in the external heat exchange element 11 as shown for instance in FIGS. 15*a* and 15*b*, this being a possible embodiment of the invention.

The centre and external heat exchange elements 10, 11 and also the inner core element 40 can be extruded, so that the core surface 20*c*, 21*c* and ribs 30, 31 with fins 33, 34, 35, 36 are made in one piece and of one material. Suitable material for the heat exchange elements 10, 11 and inner core element 40 are materials with high thermal conductivity, such as metal, for instance aluminium or copper. Other metals that have good heat conductivity and are suitable for extruding, may also be used.

Figure 21:
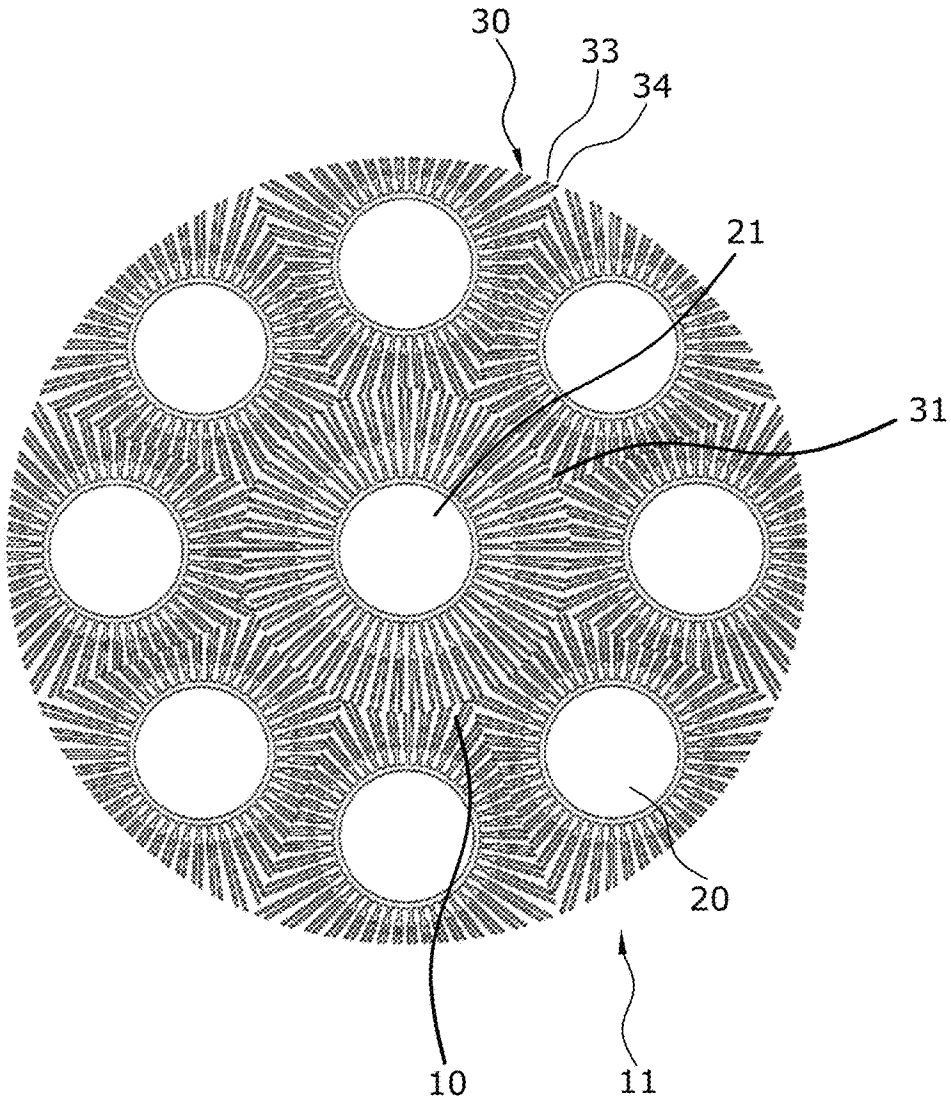
FIGS. 21-29 shows different possible constructions or assemblies of heat exchange elements forming the heat exchanger.
Figure 22:
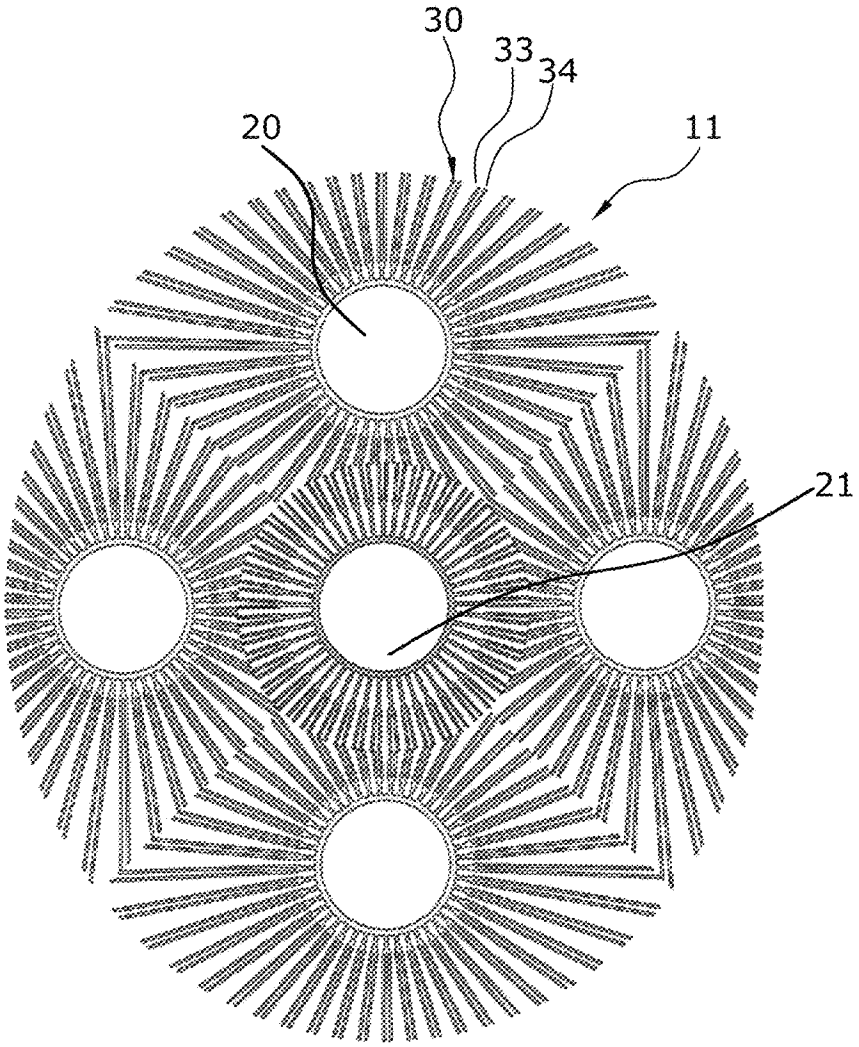

The heat exchanger could also be extruded in one piece with a plurality of cores to a shape as for instance as shown in FIG. 21 or 22.

The plurality of ribs and fins are then extending between two cores and integrally arranged with the core surface at both ends of the ribs or fins.

The heat exchange elements 10, 11 could also possible be made from 3D printing of the heat exchange elements 10, 11 or core element 40. The development of 3D printing is fast and this may prove to be a feasible method in the near future, especially for producing smaller sized heat exchangers 2.

FIGS. 21-29 show different designs of the heat exchange elements 10, 11 and gives examples of different assembly configurations that are possible for the heat exchanger with several heat exchanger elements.

In FIG. 21 the centre heat exchanger element is cylindrical and eight external heat exchange elements 11 are arranged in on the outside of the centre heat exchange element 10 forming a cylindrical ring surrounding the centre heat exchange element 10. This heating element has nine core cavities 20, 21 adapted for the supply of the heating agent or coolant.

In FIG. 22 the centre heat exchange element 10 has a similar cylindrical shape, but there are only four external heat exchange elements 11 on the outside of the centre heat exchange element 10 surrounding the centre heat exchange element 10. The heating element 2 thus having five cores 20, 21 for supply of the heating agent or coolant. The fins extending radially outwardly from the core are also longer than in the embodiment described in FIG. 22. The gap between the ribs 30 at their outer portions will therefore be larger.

Figure 23:
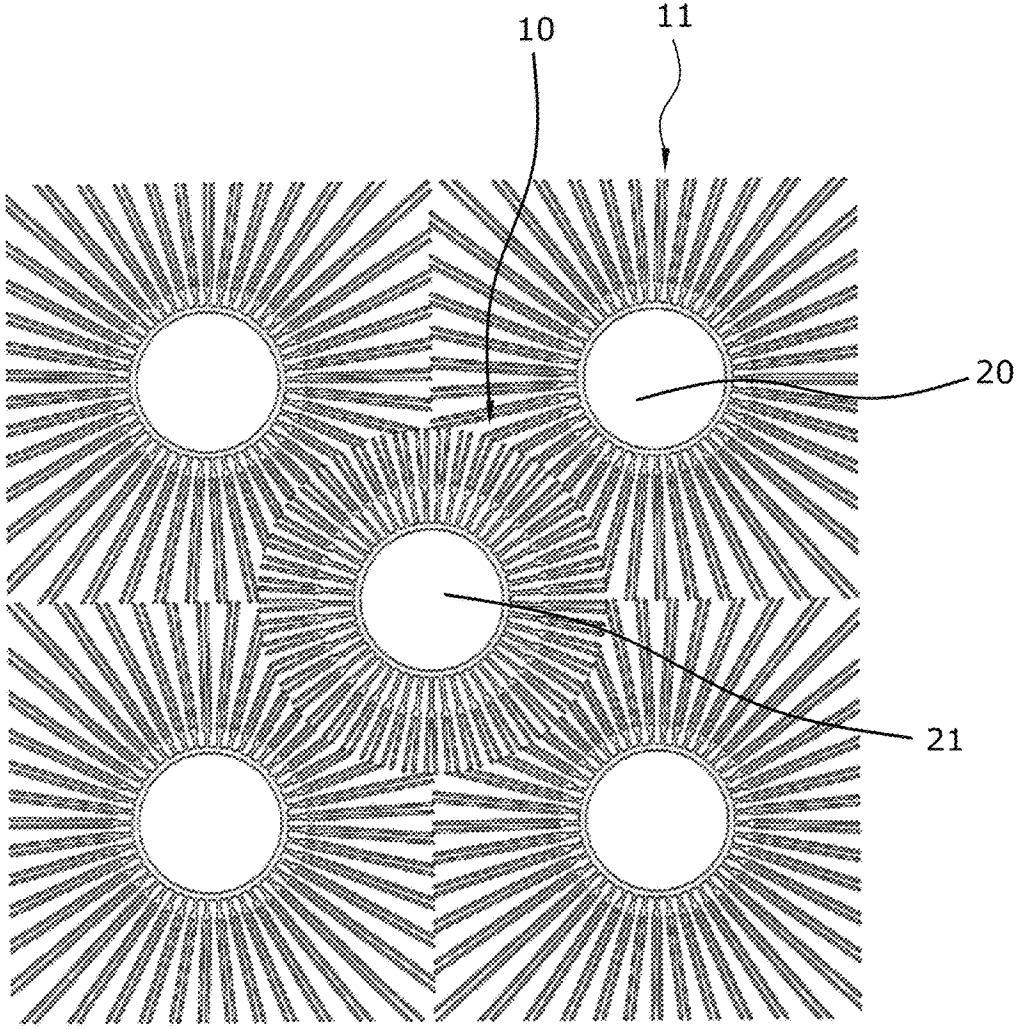

FIG. 23 shows yet another embodiment of the invention with different shape of the heat exchanger. This results in a different shape of the external heat exchange elements 11. In this embodiment, the heat exchanger has a cubic shape. The outer surfaces of the external heat exchange elements 11 are straight and perpendicular to each other. The centre heat exchange elements 10 is cylindrical, resulting in that the surface of the external heat exchange elements 11 is concave and has a corresponding curved shape as the outer surface of the centre heat exchange element 10.

FIG. 24 shows yet another possible embodiment of the invention, where a plurality of the heat exchange elements shown in FIG. 24 are assembled to form a heat exchanger with a plurality of centre heat exchange elements 10 and a plurality of external heat exchange elements 11.

FIGS. 25-26 show another embodiment of the invention where the heat exchanger is composed of four external heat exchanger elements 11. In this embodiment, there is no centre heat exchange element 10.

Figure 27:
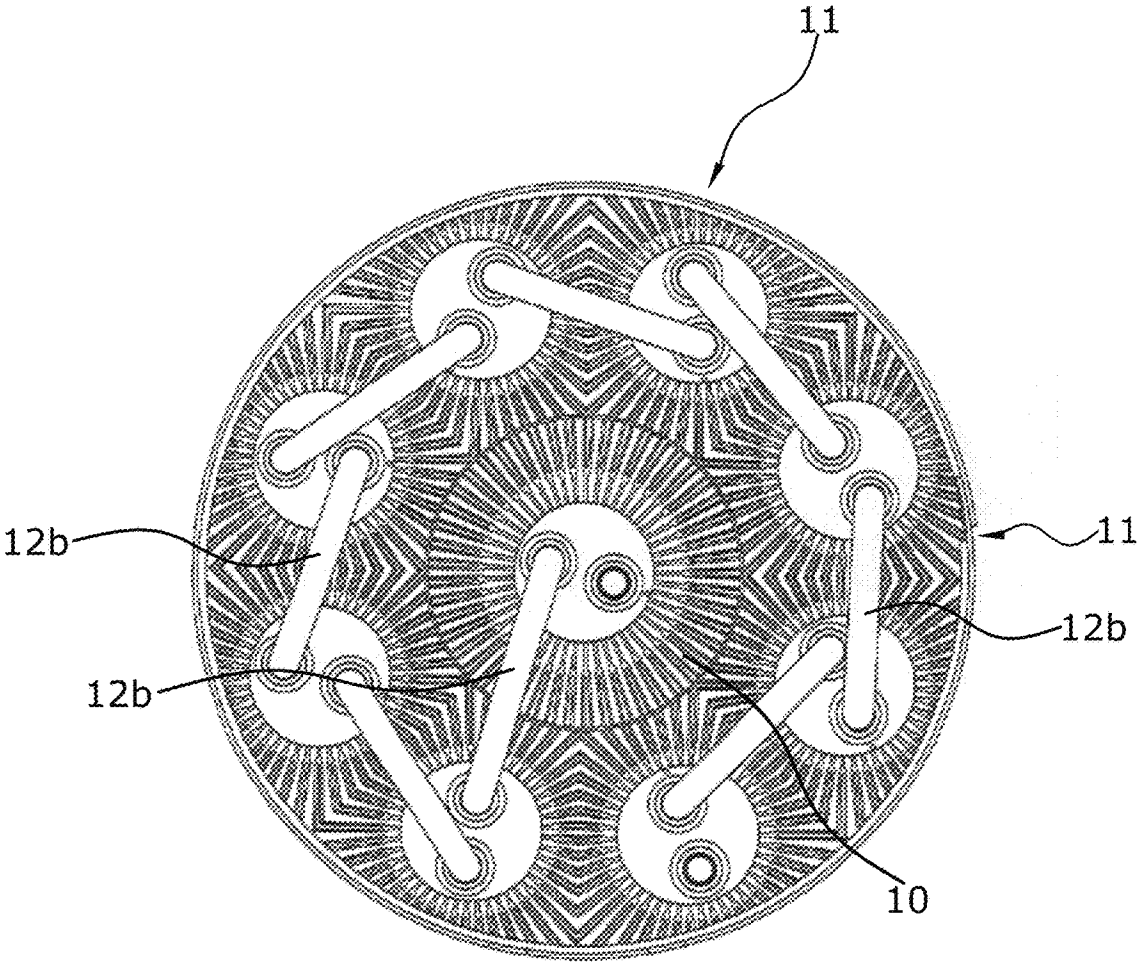
Figure 28:
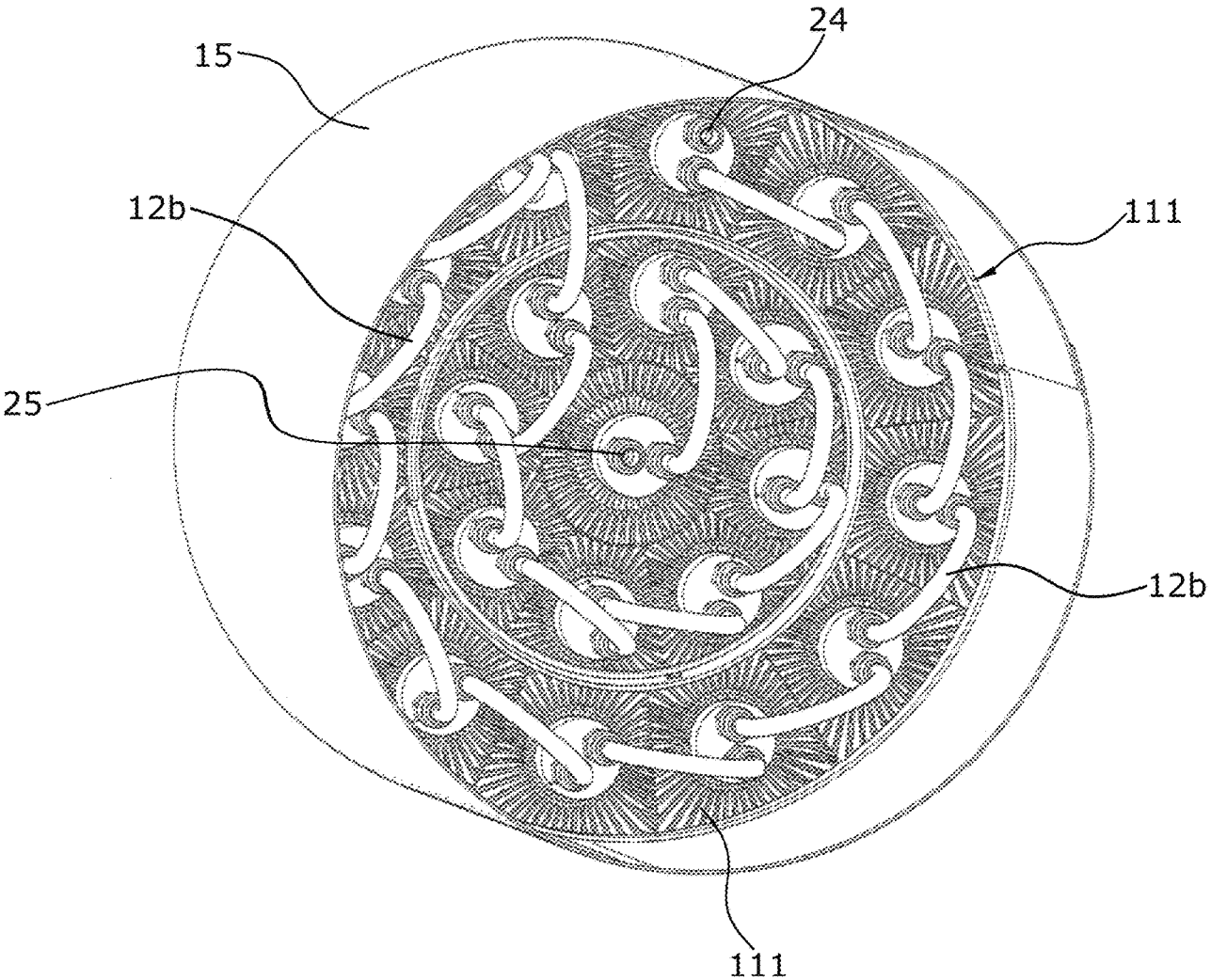
Figure 29:
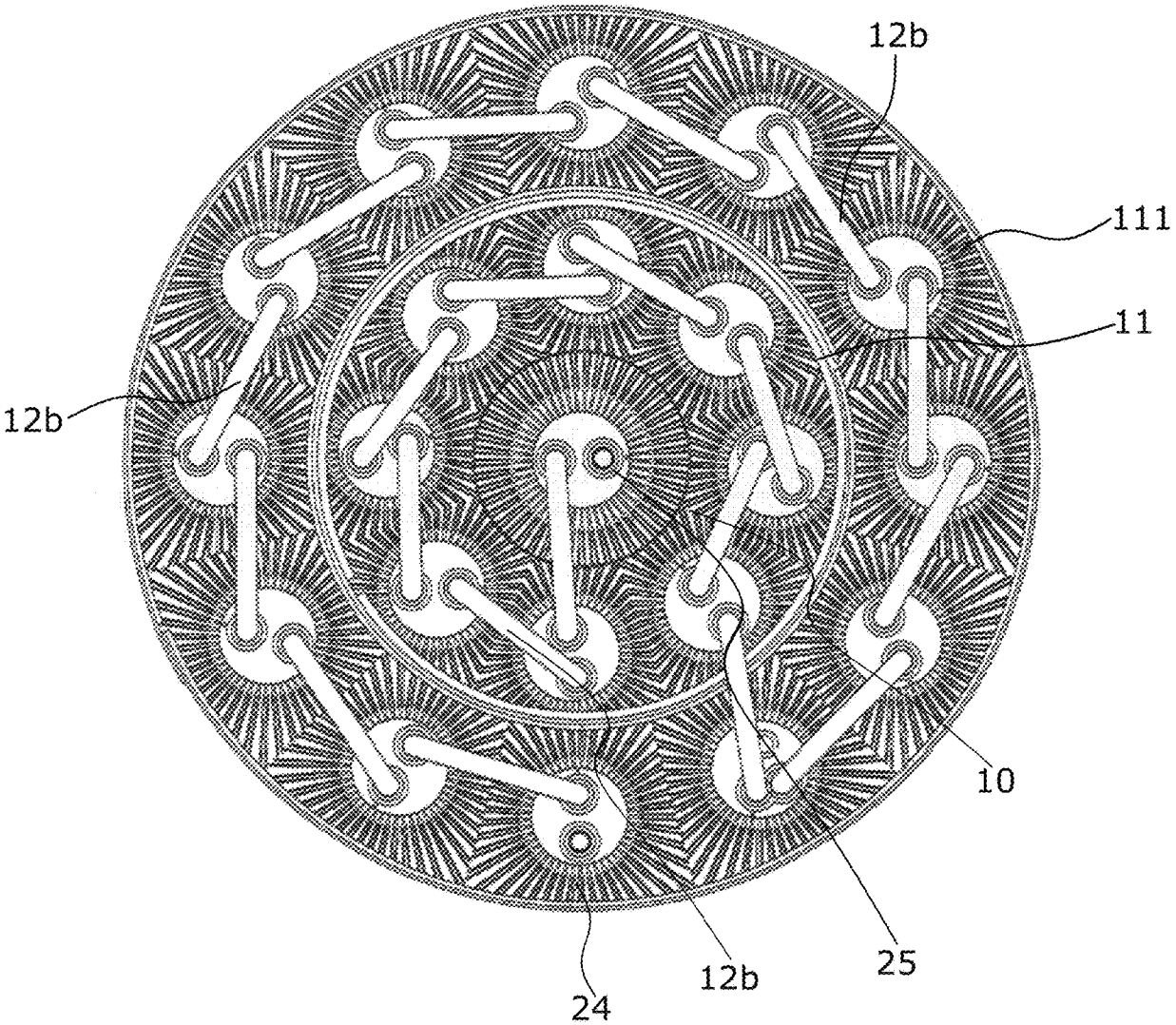
Figure 30:
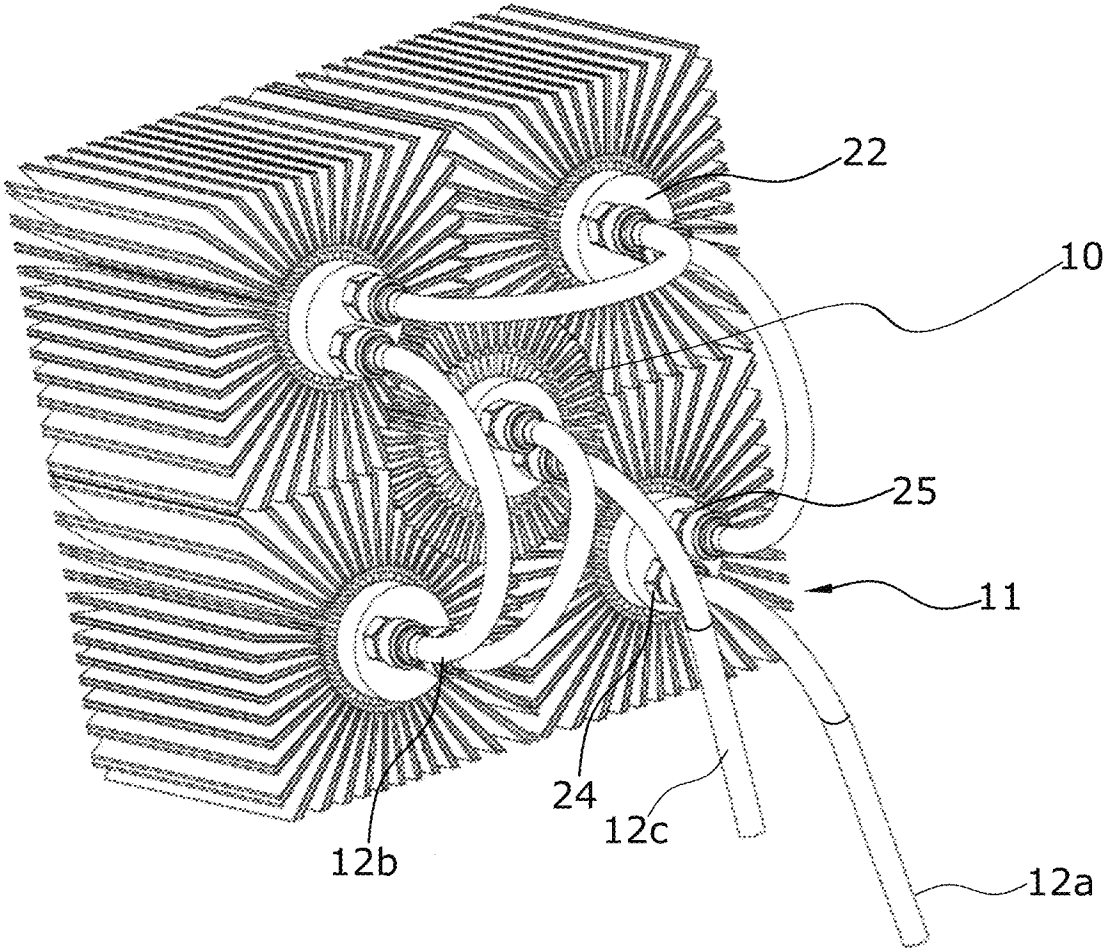
FIGS. 30-31 shows different embodiments of the arrangement of the supply of fluid in the heat exchanger and between the heating or cooling elements.

FIG. 27 shows the same embodiment of the invention as shown in FIG. 21 with tubes or pipes 12*b* arranged between the cores In FIGS. 28 and 29 there is an additional layer of external exchange elements 111 arranged in a circle around the initial layer of external exchange elements 11.

The number of external heat exchange elements 11 is not limited to the embodiments of the drawings. Other numbers of external heat exchange elements 11, 111 suitable for the invention is also possible.

Each of the heat exchange element 10, 11, 111 forming the heat exchanger in the FIG. 21-29 could be assembled by separate heat exchanger elements that are adjoining each other in a preferred shape so that the heat exchanger elements creates a heat exchanger where the ribs and fins are extending in the whole cross sectional area of the heat exchanger and that there is no voids.

It is also possible within the invention to make a heat exchanger element 10 with a plurality of cores 20, 21 integrated in one heat exchange element, like for instance a shape similar to the shape in FIG. 21.

FIGS. 26-30 also show a possible fluid communication between the different heat exchange elements 10, 11. There is shown a transfer of fluid from the core cavity 20, 21 of one heat exchange element 10, 11 to the core cavity 20, 21 of the adjacent heat exchange element 20, 21. The fluid is transferred through pipes or tubes 12*b* and openings 24 as shown in FIGS. 4 and 9-10.

The fluid could be supplied to the centre heat exchanger 10 and thereafter through all of the external heat exchangers 11, 111 before the fluid is discharged from the heat exchanger 2. The fluid could optionally be supplied to one of the external heat exchange element 11, 111 and thereafter through all of the external exchanger element 11, 111 before it is discharged from the centre heat exchange element 10 or from one of the other external exchange element if there are no centre exchange element 10 as in FIG. 26.

FIG. 31 shows another configuration of the supply of fluid to and the return of fluid from the heat exchanger 2. In this Figure, there is no pipes or tubes 12*b*, i.e. no fluid connection, between the cores cavities 20, 21 of the heat exchange elements 10, 11. The heat exchange elements 10, 11 have each a supply of fluid from a separate supply tube or pipe 12*a* and a separate outlet pipe or tube 12*c* for the return of fluid from the core cavity 20, 21. The supply pipes 12*a* and the outlet pipes 12*c* are coupled to a common delivery and return pipe through a respective manifold. Consequently, the fluid systems are arranged in parallel.

Another arrangement of the supply and distribution of the fluid between the cores 20, 21 could be that the inlet and outlet ports 24, 25 are arranged at opposite ends. This means that the supply tube or pipe 12*a*, outlet tube or pipe 12*c* and the pipes or tubes 12*b* between the heat exchange elements are arranged at both ends of the heat exchanger elements 10, 11.

Figure 32:
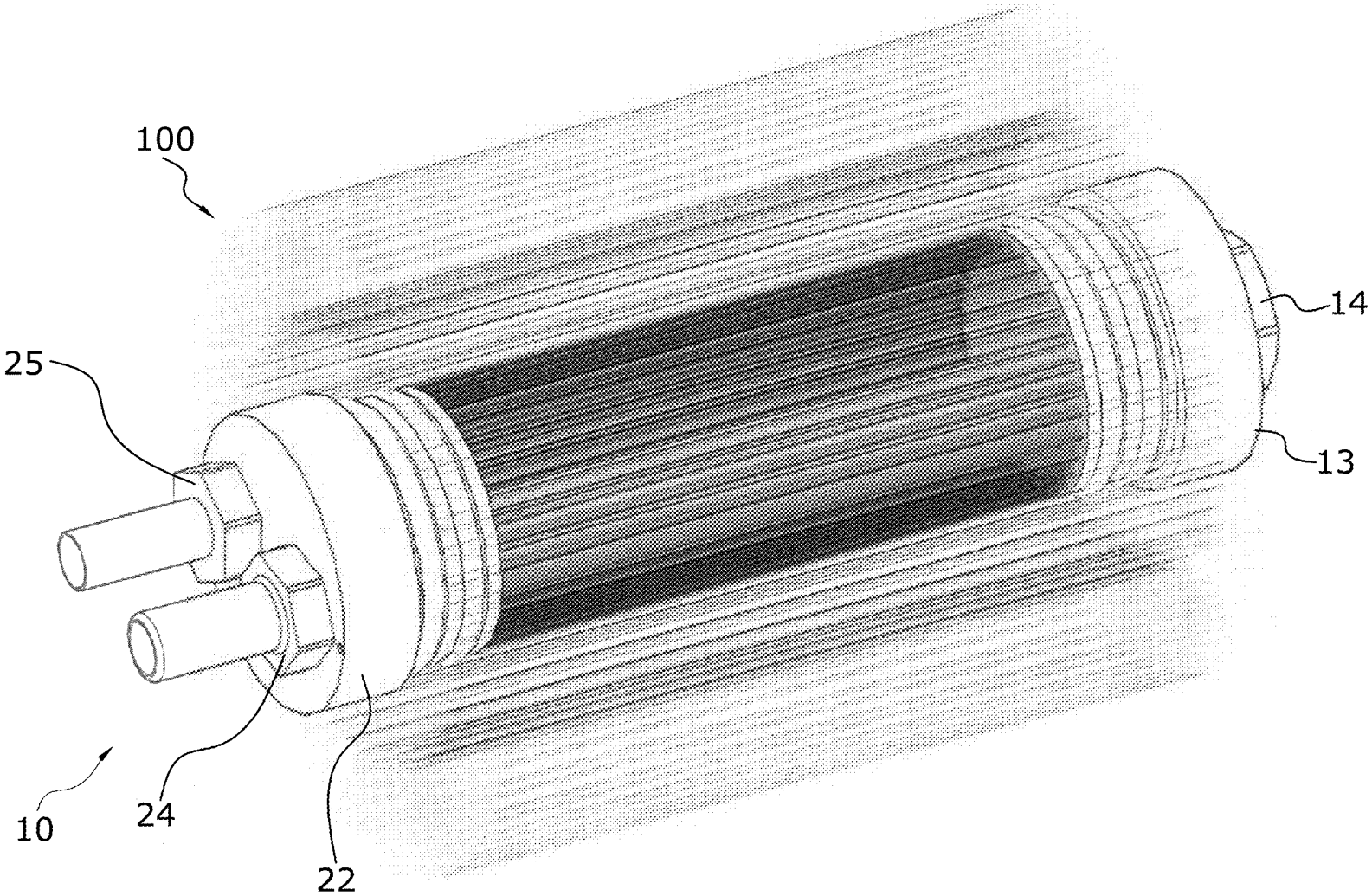
FIGS. 32-34 shows detailed views of different embodiments of a heat exchanger which only have one centre heat exchange element and no surrounding external heat exchange elements according to the invention.
Figure 33:
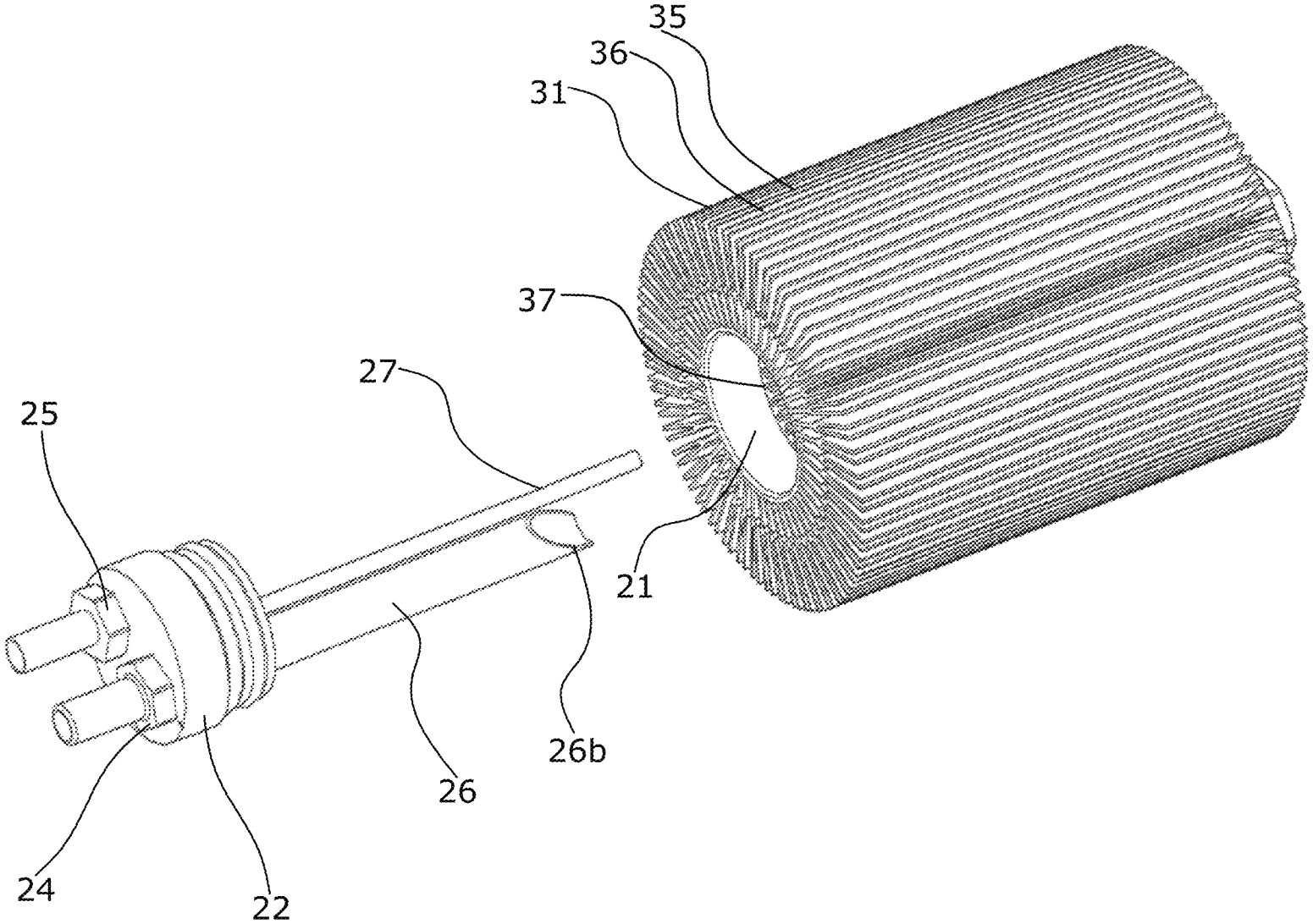
Figure 34:
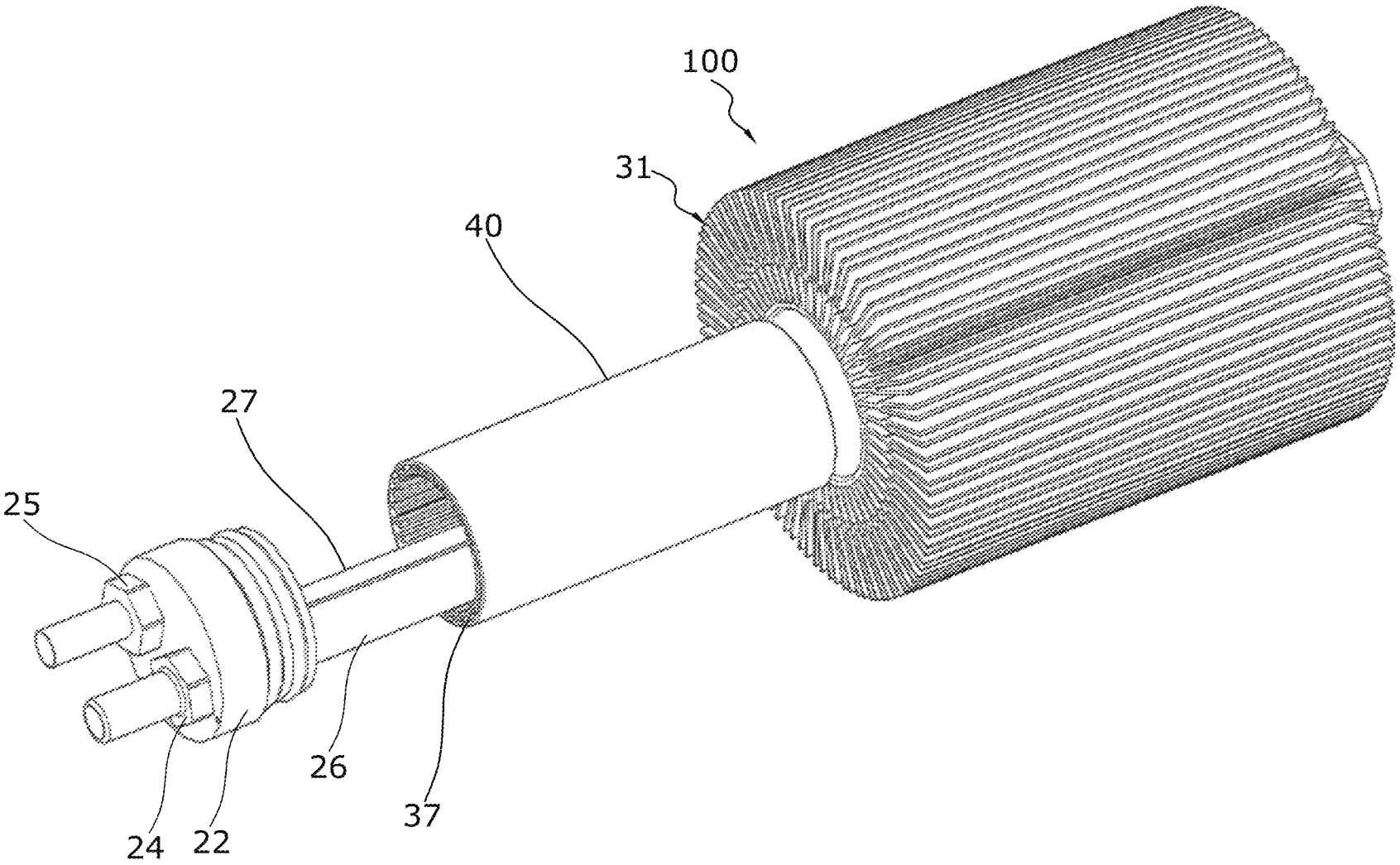

FIGS. 32-34 show yet another embodiment of the invention. In this embodiment, the structure of the heat exchanger 100 is similar to the centre heat exchange element 10 as described in previous drawings. The core cavity 21 has plugs 13, 22 arranged at both ends, the first plug 22 has openings with an inlet port 24 and an outlet adapted 25, to let the heating medium or coolant flow into and out of the core cavity 21. A threaded rod 27 is attached at both ends to the first plug 22 and second plug 13 to secure the plugs 13, 24 at the core ends 21*a*, 21*b*, preferably along a centre axis of the core cavity 20, 21. The figures also show the pipe 26 extending from the inlet port 22*a* towards the second plug 13 to provide circulation of fluid along the full length of the core cavity 21. The pipe 26 has a free end arranged at the proximity or a suitable distance from the second plug 13. This second end 26*a* has an inclined opening as shown in the FIG. 34. The inclined opening is preferably oriented towards the inner core surface 20*c*, but could as an option have other orientations.

The pipe 26 is arranged offset of the centre axis of the core cavity 20. This arrangement of the pipe 26 gives a better heat transfer through the core cavity 21 because the pipe outlet shape creates cavitation at the end which results in a turbulence in the fluid towards the inner surface of the inner core surface 21*c*.

This will result in a better heat transfer.

The principle is shown in relation to the centre heat exchange element, but the arrangement with an inclined end pipe 26*a* is also possible in the external heat exchanger 11 (not shown).

The heat exchange element 100 has also ribs 31 and fins 35, 36 extending radially outwardly from the core cavity 21.

In FIG. 33 there is also shown an embodiment with the inner ribs 37 as described in FIG. 16-18 but the heat exchanger element 100 could also function without the inner ribs 37.

FIGS. 33 and 34 show both ribs 37 that are attached to the inner core surface 20*c* and separate inner core element 40 that is arranged at the inside of the core.

FIGS. 35-51 show different use of heat exchange according to the invention.

Figure 35:
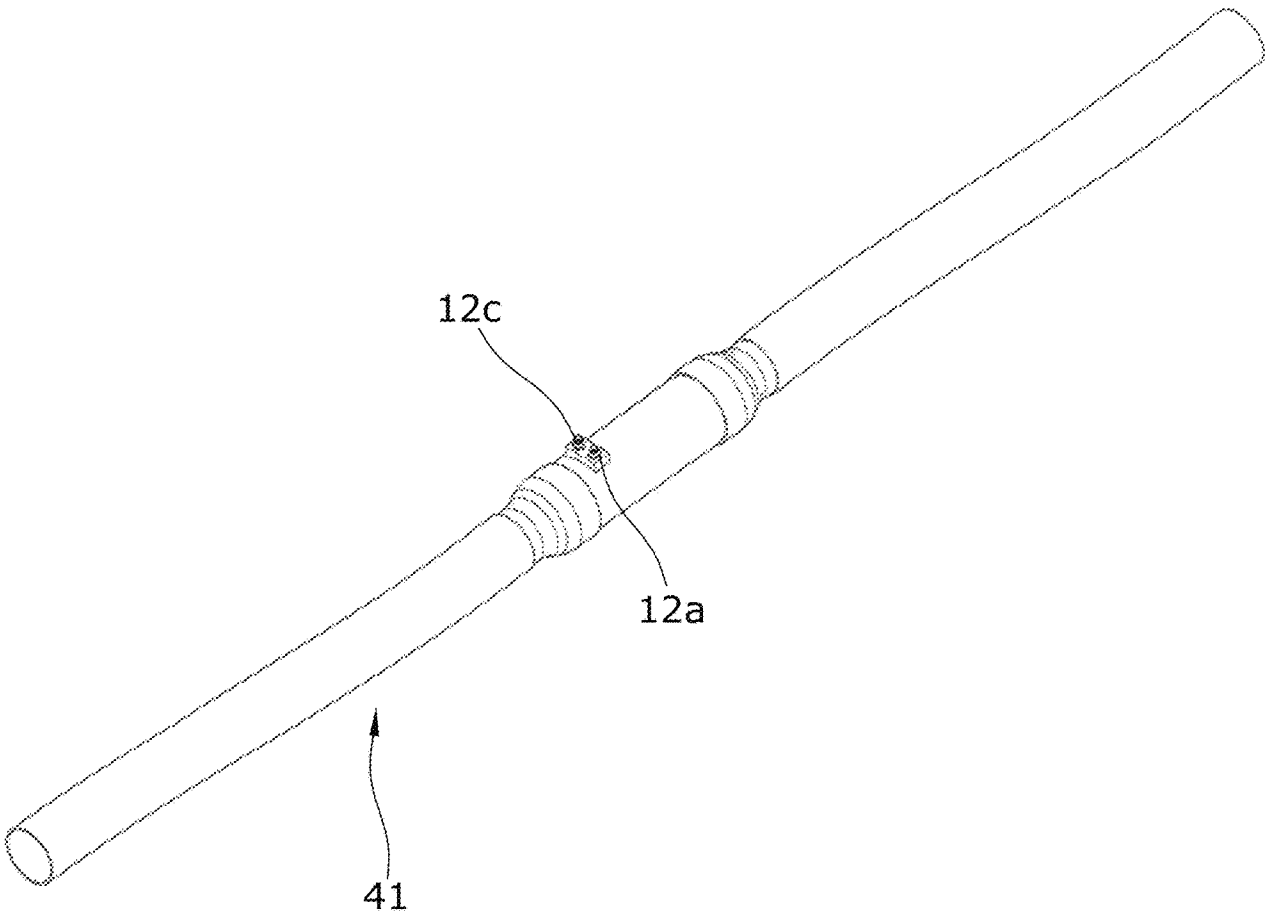
FIGS. 35-50 show different embodiments of the invention where the heat exchanger view in FIG. 32-34 is arranged inside a duct for transferring heat between two fluids.
Figure 36:
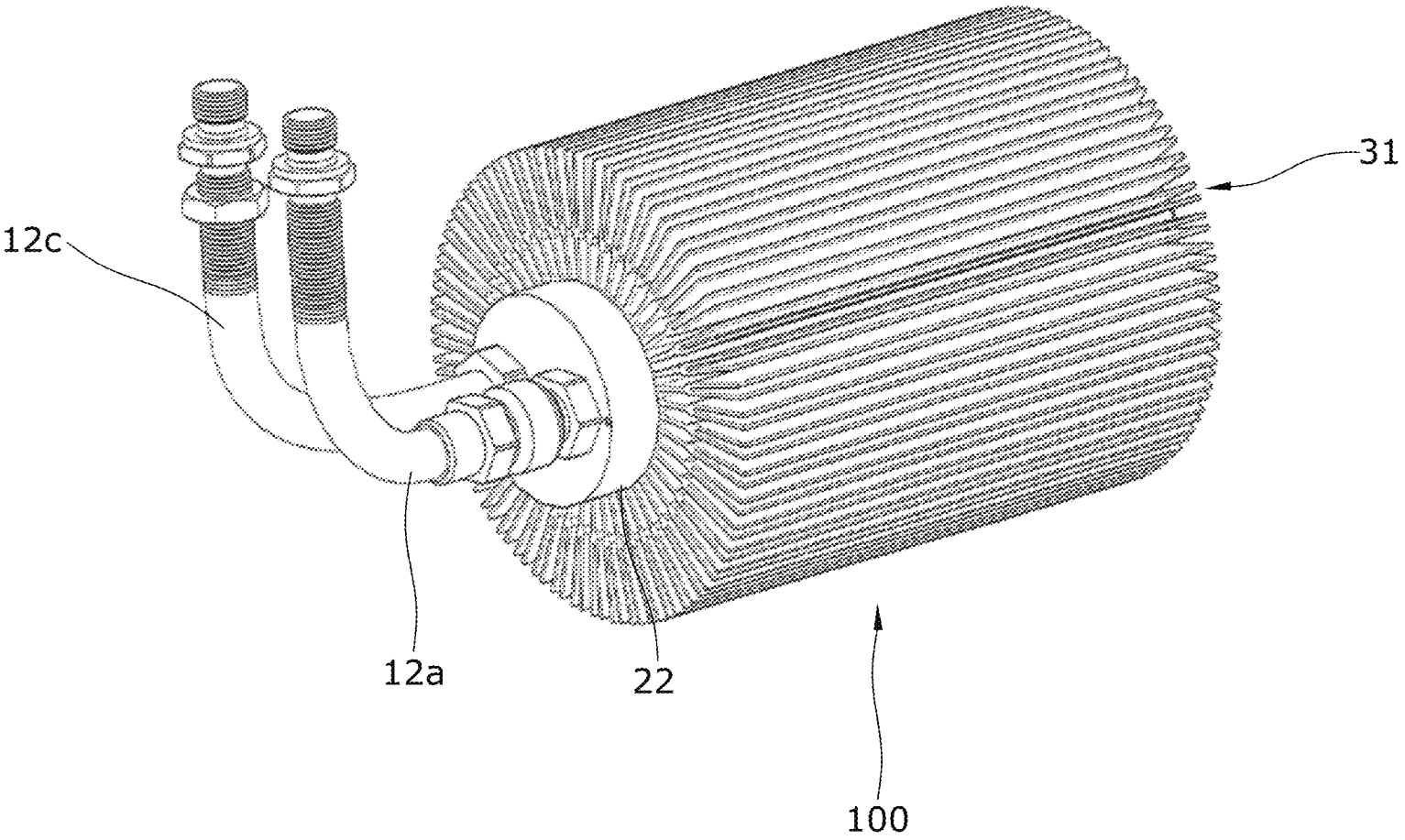
Figure 37:
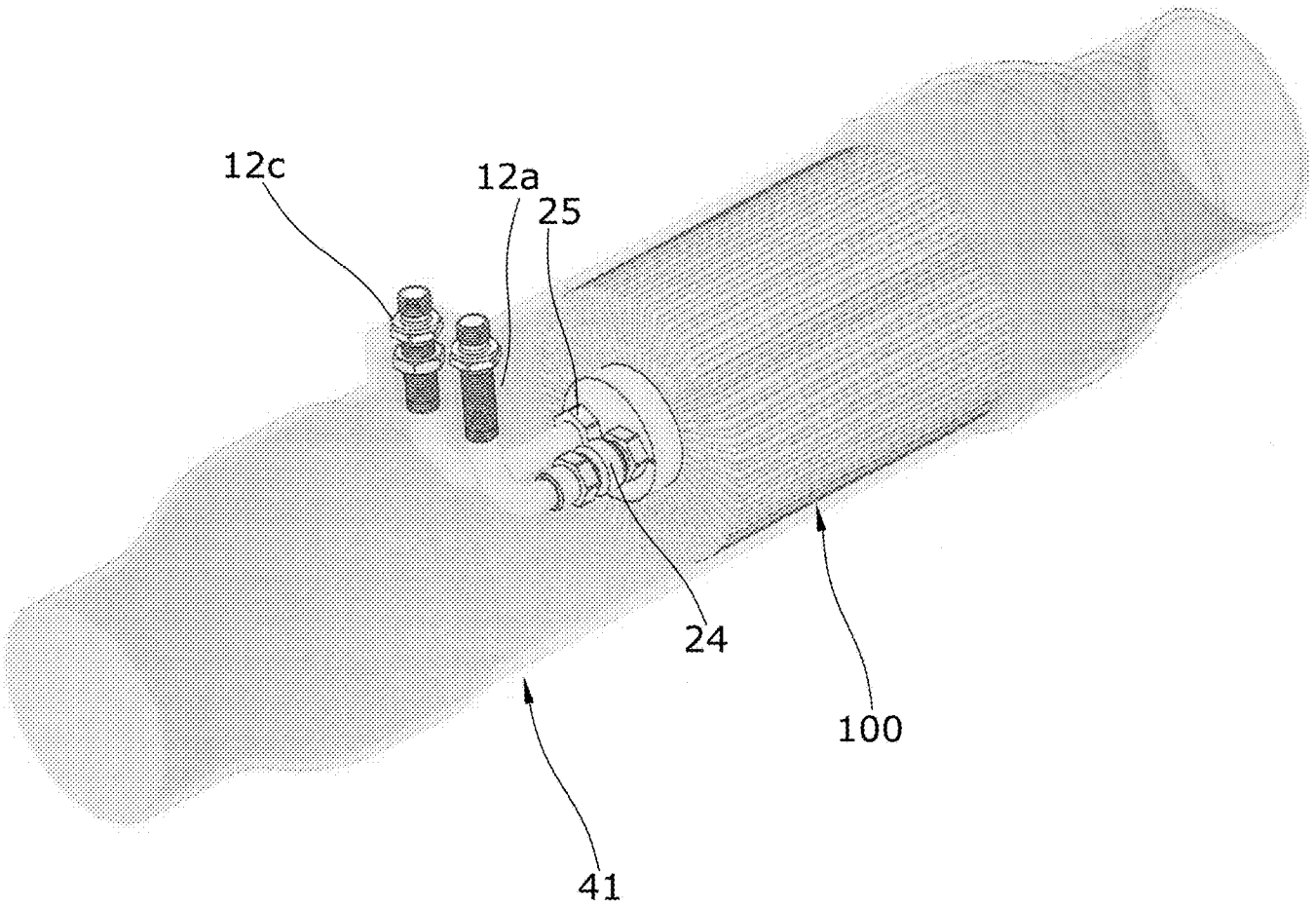

FIGS. 35-37 shows an embodiment of the heat exchanger where the heat exchanger 100, as described in FIG. 33-34, is arranged within a duct 41. The heating medium or coolant is supplied and discharged via pipelines 12*a*, 12*c* connected to couplings that extends through openings in the walls of the duct 41. This arrangement is particularly suitable for heat exchanging liquid, such as cooling of oil. The duct 41 is liquid tight and the liquid to be heated or cooled down flows through the duct 41 in the longitudinal direction thereof.

Figure 38:
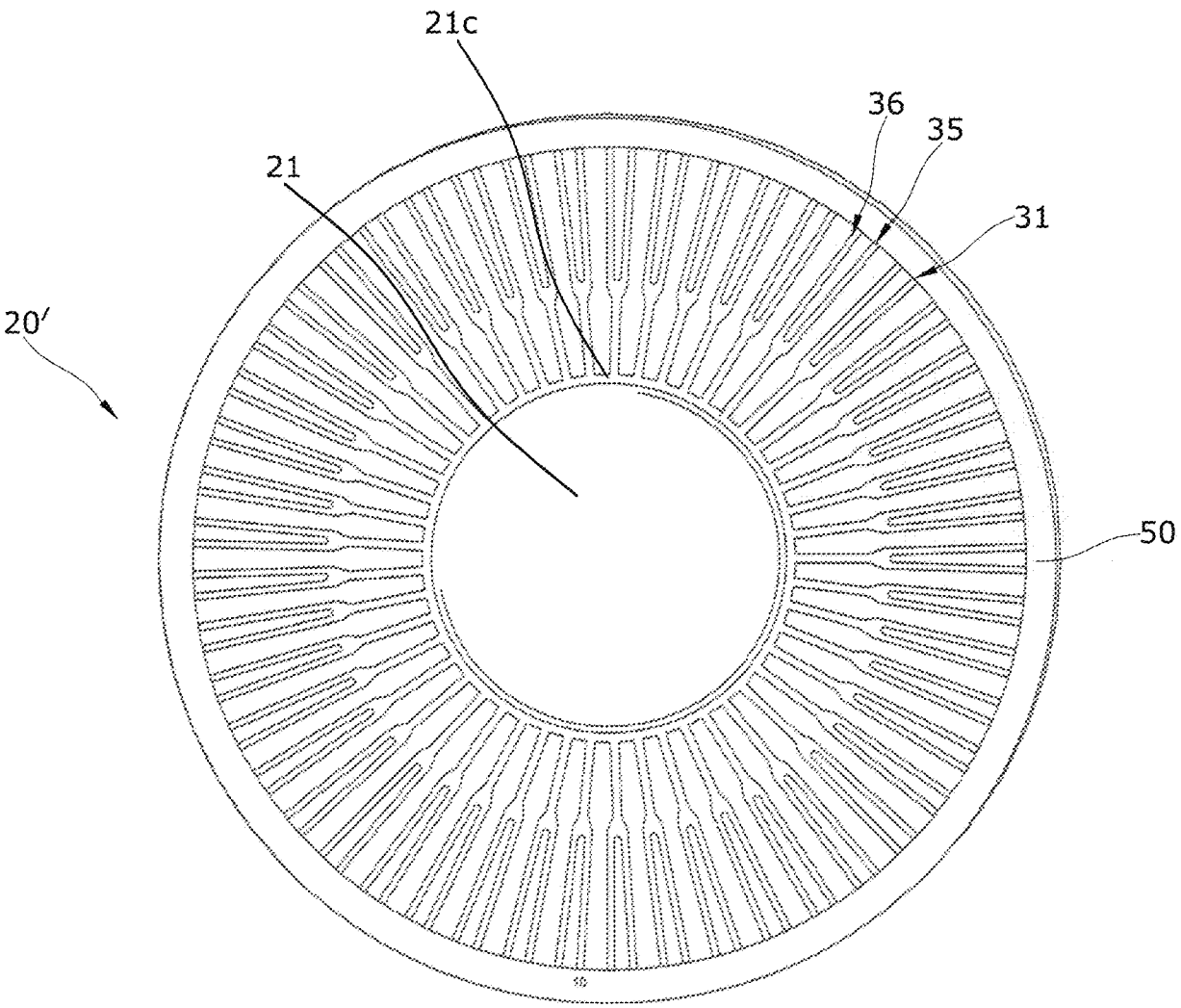
Figure 39:
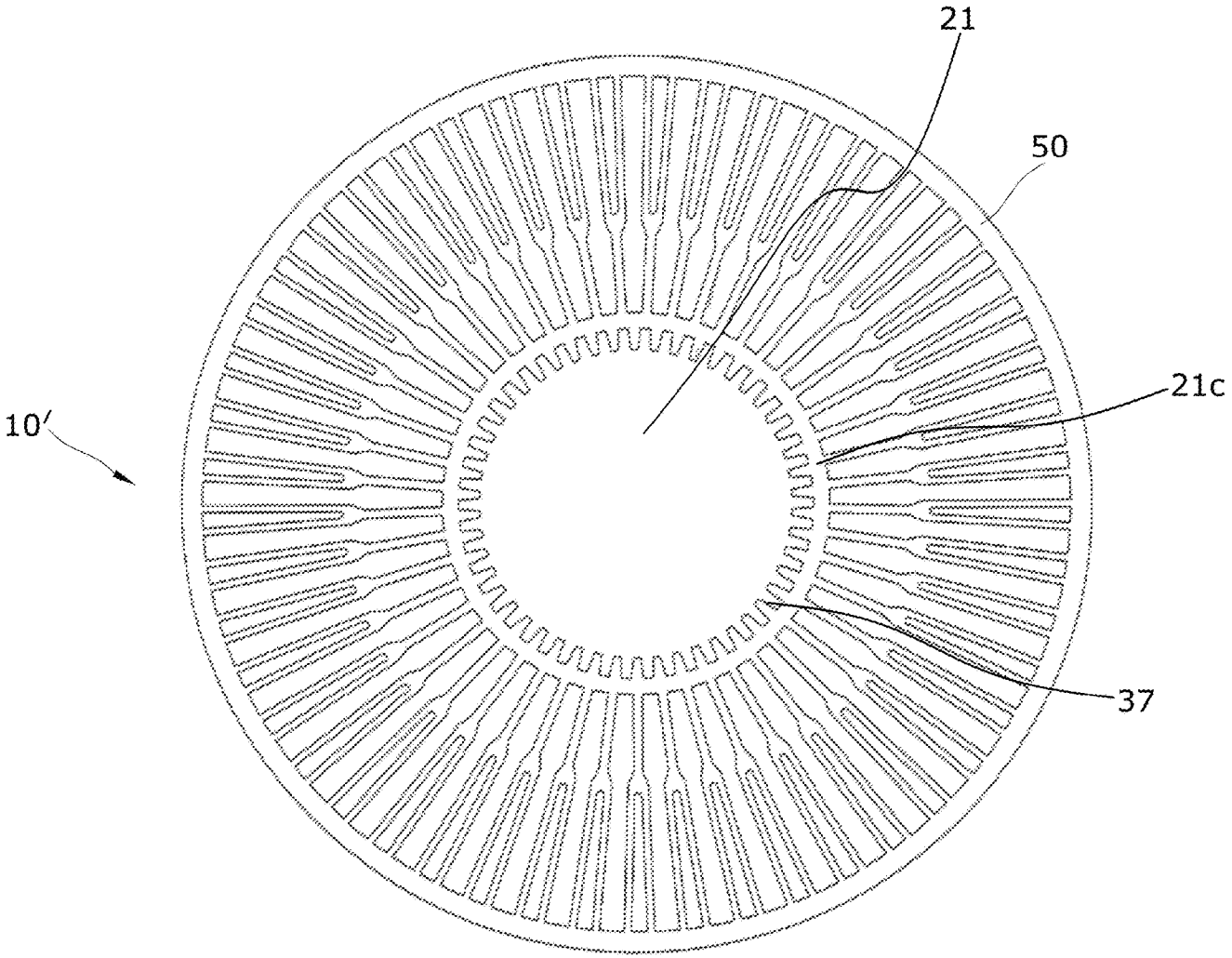
Figure 40:
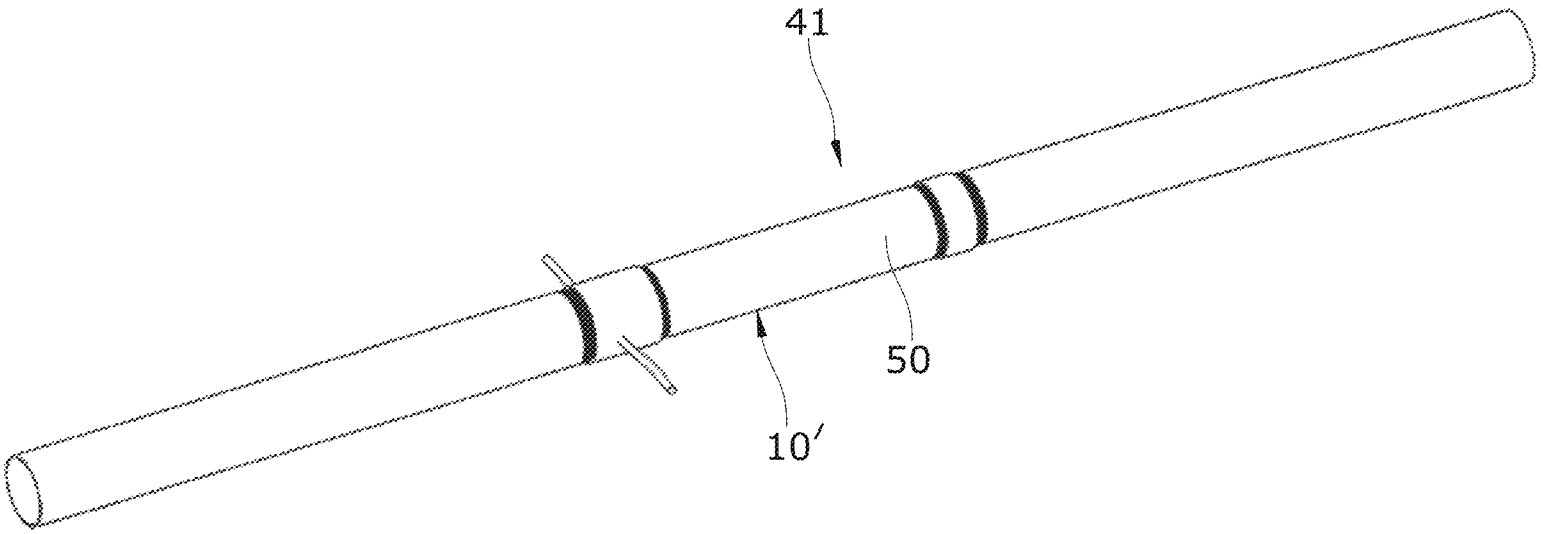
Figure 41:
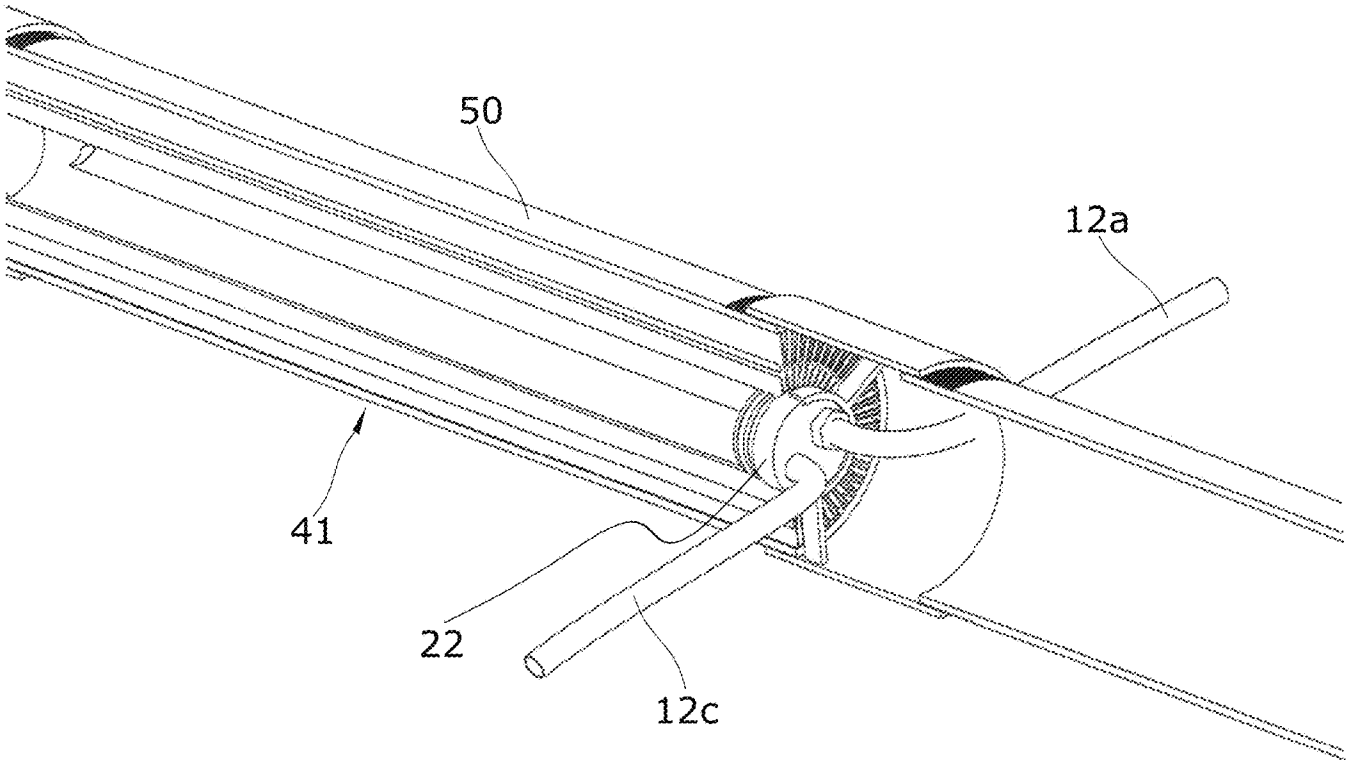

FIG. 38-39 shows another embodiment of a centre heat exchange element 10'. In this embodiment there is a cylinder 50 attached on the outside of the centre heat exchange element 10'. The ribs 31 with fins 35, 36 are extending from the inner core to the outer cylinder 50. This is different from the embodiment of the heat exchange element 10 from FIG. 16-18 where the centre heat exchange element 10 do not have this outer cylinder 50.

The centre heat exchange element 10' could have inner ribs 37 extending radially inwards from the core surface 21*c* as shown in FIG. 39 or a smooth inner surface as shown in FIG. 38. The inner ribs 37 will increase the inner surface area of the core 21*c* and hence increase the heat transfer. This embodiment is particularly suitable for use as a terrestrial heat exchanger.

FIGS. 40-46 shows a heat exchanger using the centre heat exchange elements 10' from FIG. 38-39. The centre heat exchange element 10' with the outer cylindrical plate 50 cylindrical part forms a cylindrical part that could in both ends be connected to pipelines 102 by for instance a pipe fitting 101. This differs from the embodiment of FIG. 36-38 where the centre heat exchange element 10 is arranged within the duct 41 and not forming part of the outer surface of the pipeline. The centre heat exchange element 10' do not have an additional outer cylinder fixedly attached to the fins 35, 36, the outer cylinder forms part of the heat exchanger 10'.

Figure 42:
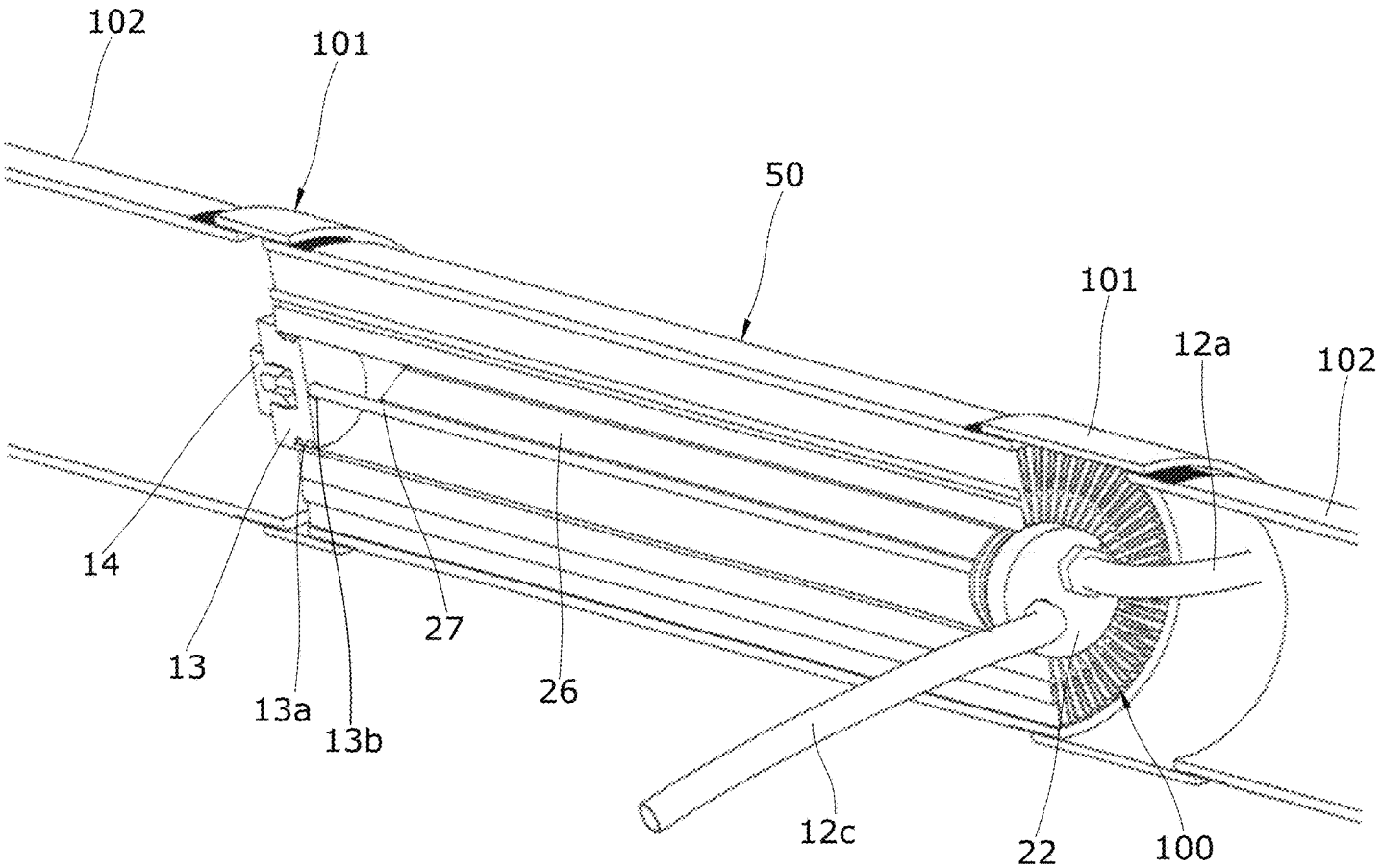
Figure 43:
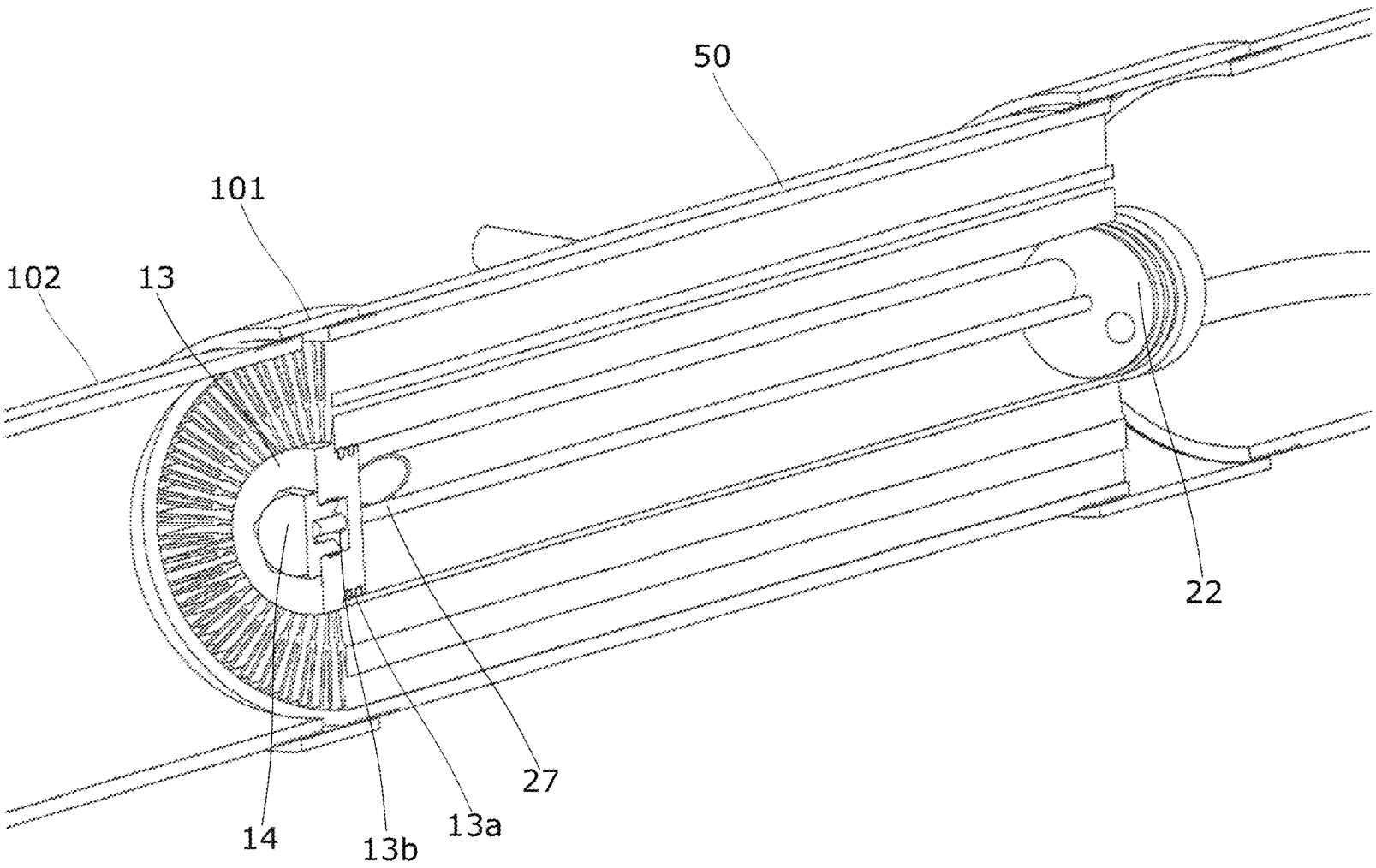
Figure 44:
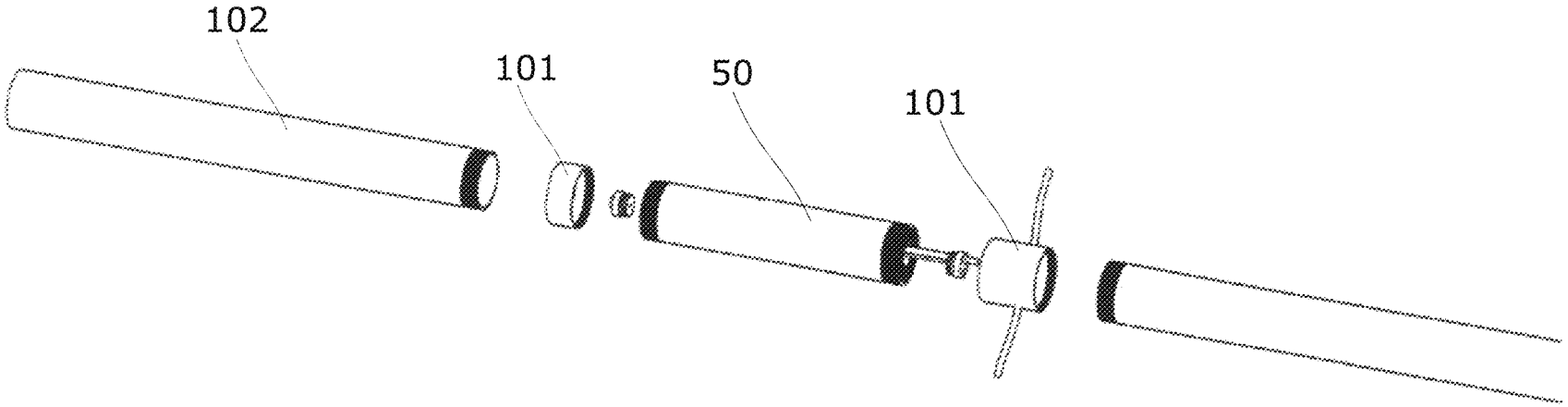

FIGS. 42-43 show the second plug 13 and a cap 14 in greater detail. The second plug 13 has arrangement for bleeding or aeration of the core cavity 20, 21. The core cavity 20, 21 is normally filled with a heating agent or coolant but there could also be air bubbles together with the coolant or heating agent in the core cavity 20, 21.

These bubbles could be removed from the core cavity 20, 21 through a clearance between an opening 13*b* in the second plug 13 and the threaded rod 27 that extends through the opening in the second plug as shown in FIG. 42-43. To release the air it is possible to loosen the cap 14 that is screwed onto the threaded rod 27. This is shown in detail in FIG. 12.

Figure 45:
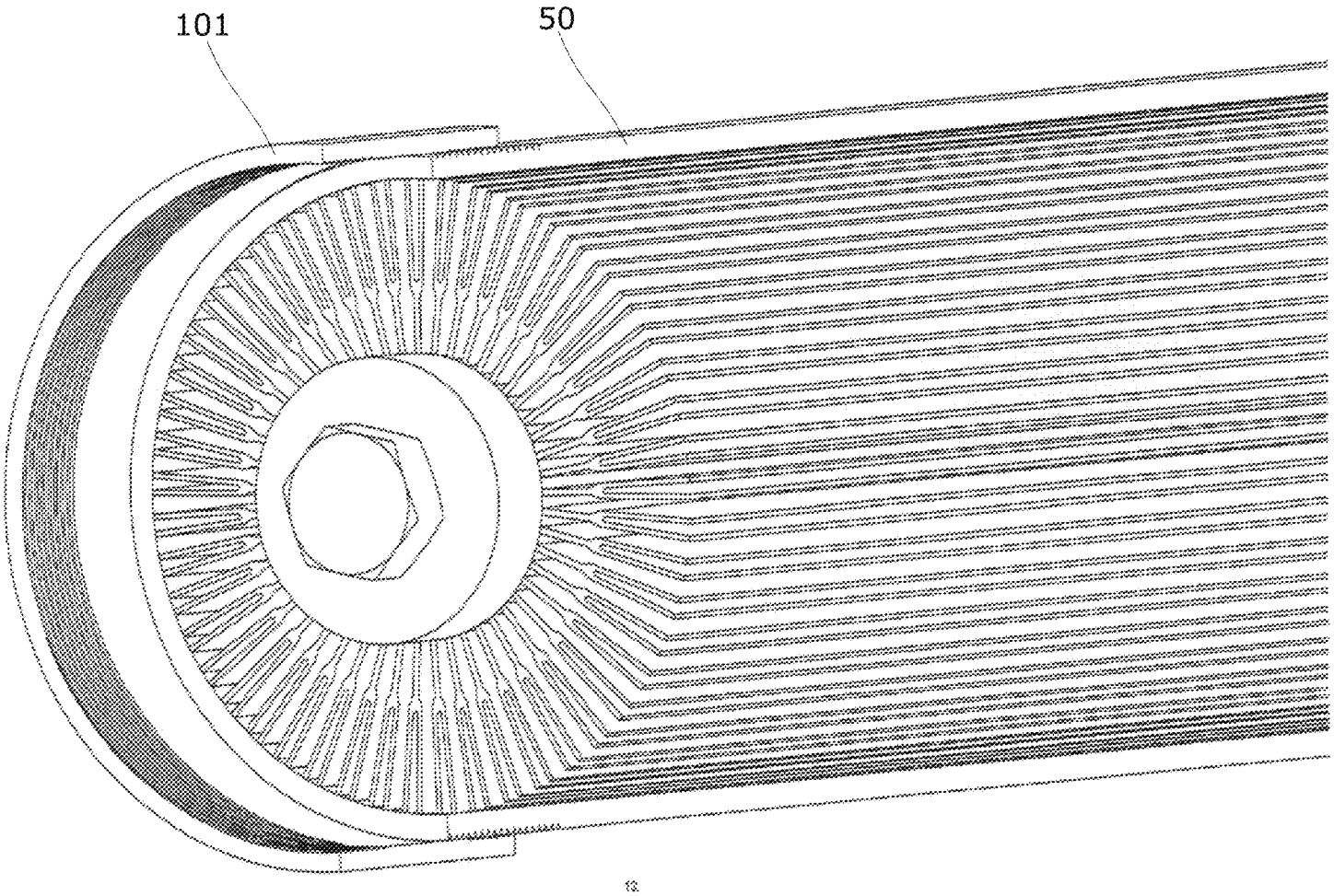
Figure 46:
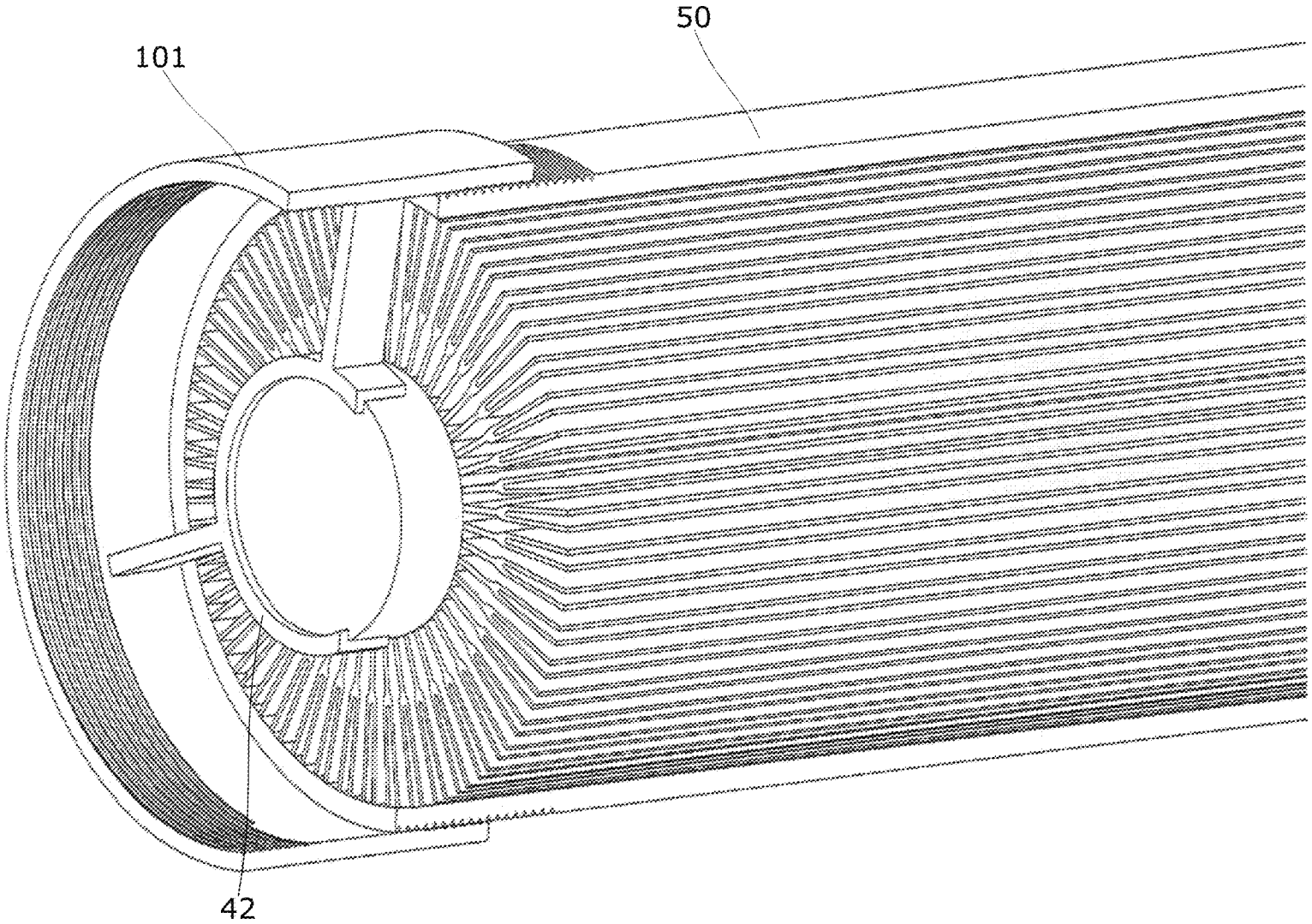
Figure 47:
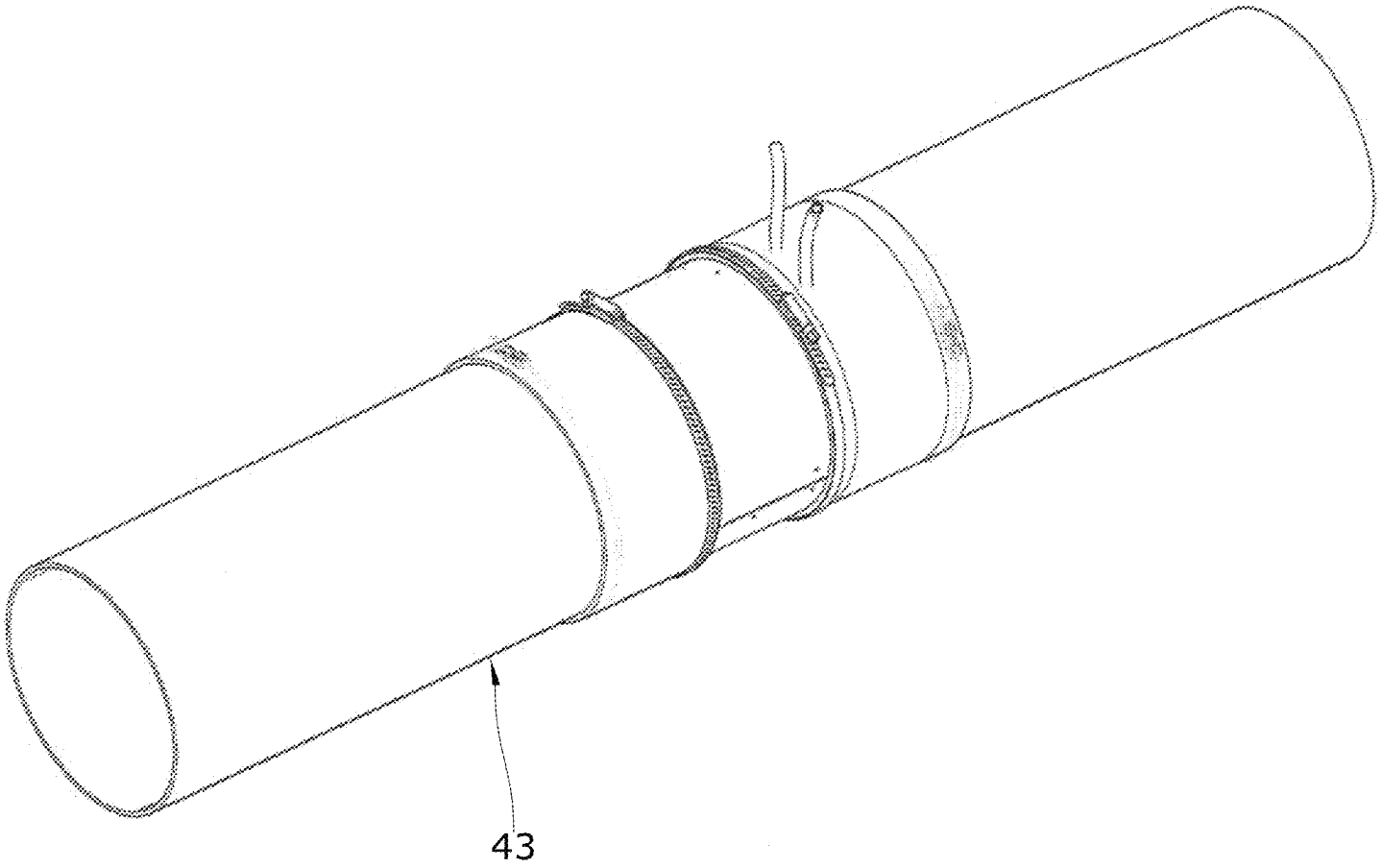
Figure 48:
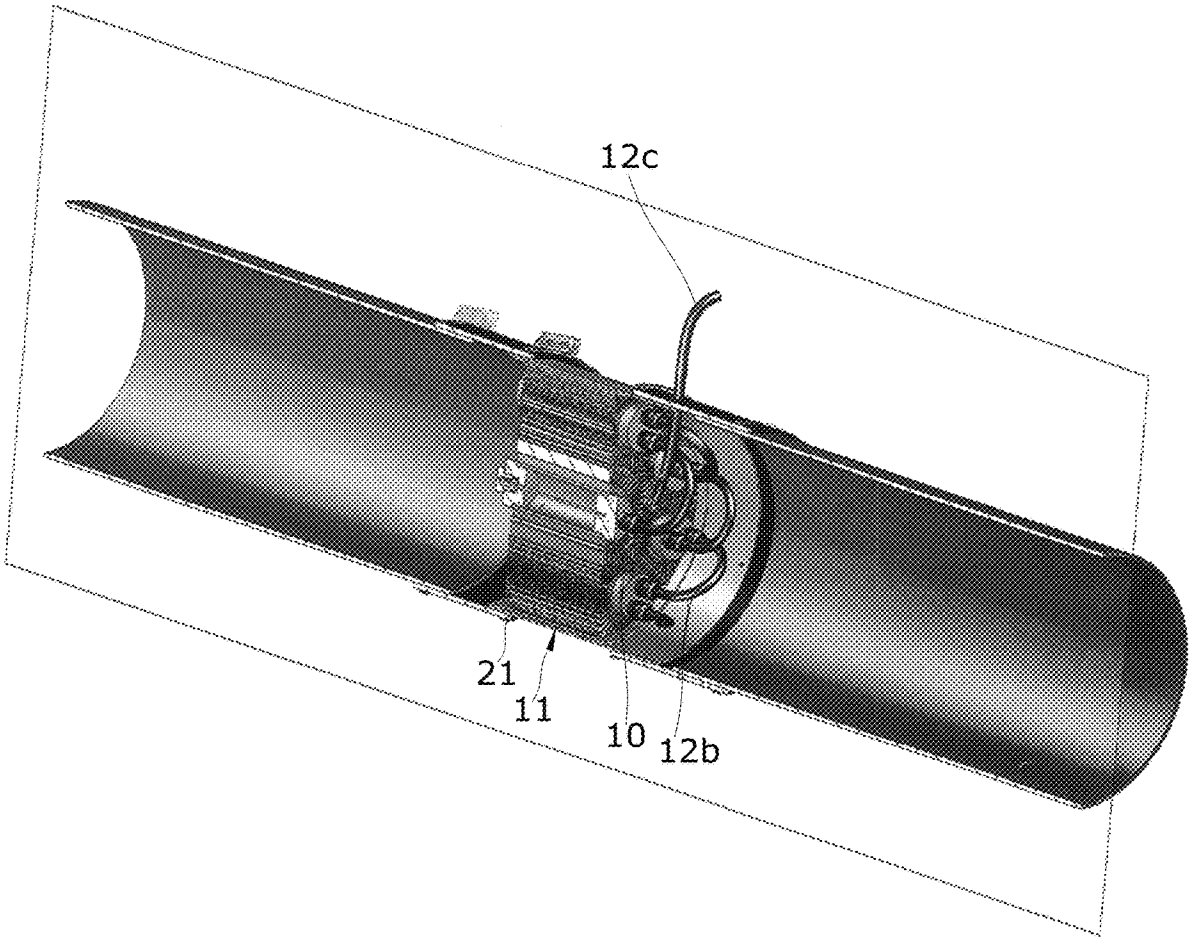
Figure 49:
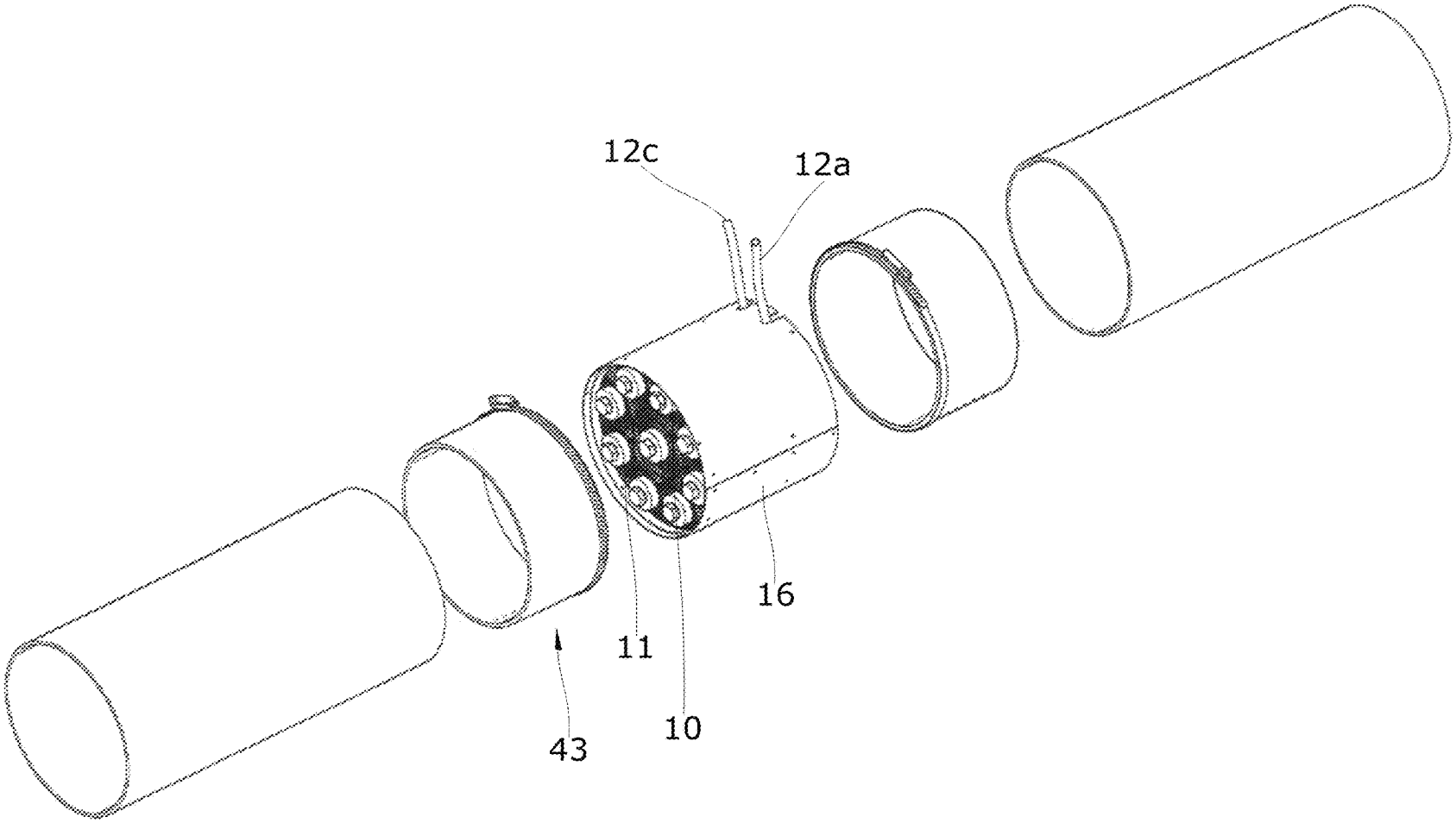
Figure 50:
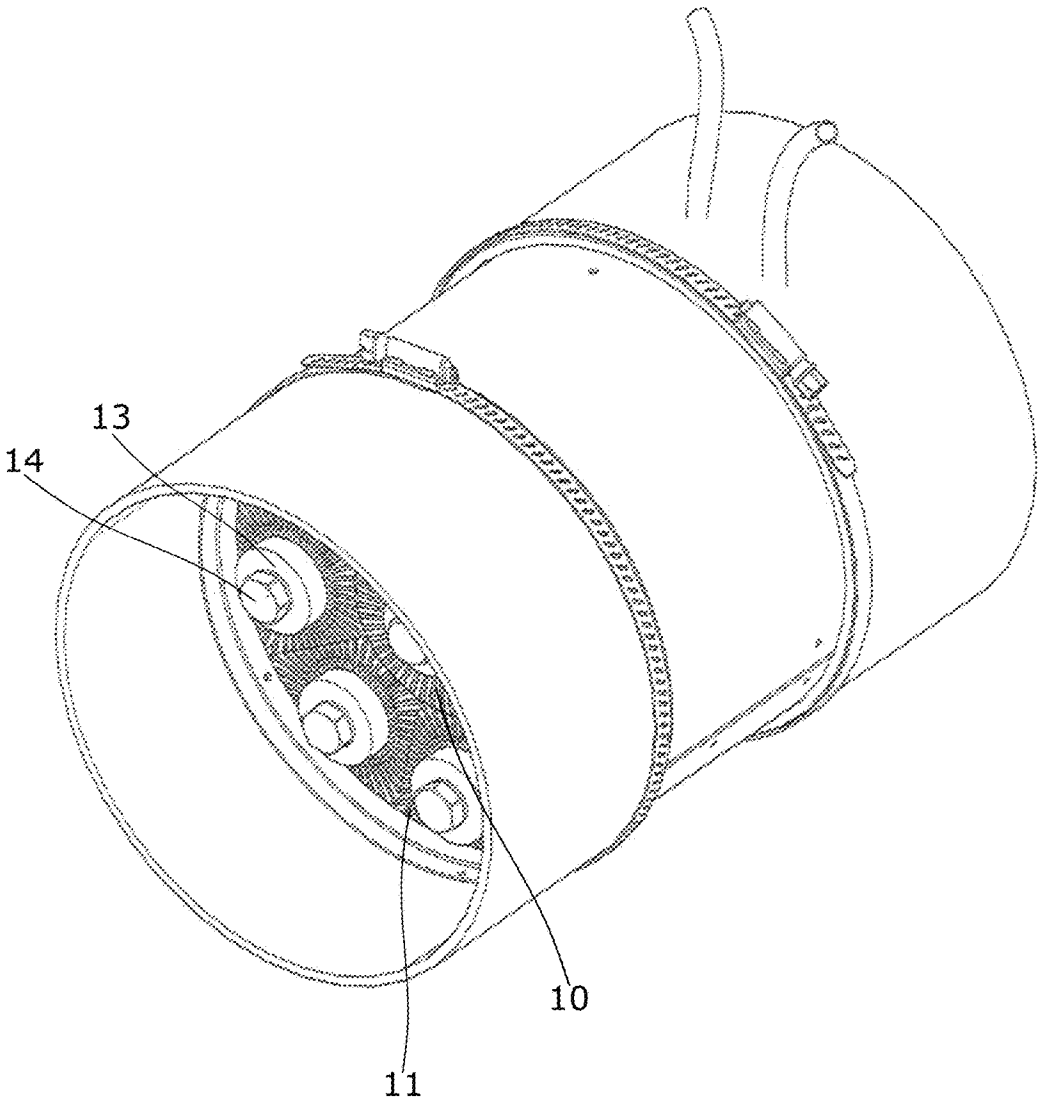

The heat exchanger 100 could be secured to the pipe fittings 101 in different ways as shown in FIGS. 45-46. In FIG. 46 the first plug 22 and second plug 13 are arranged in mountings 42 that are fixed to the inner walls of the fittings 101.

FIGS. 47-51 show another embodiment of the heat exchanger according to the invention, which is arranged within a duct 43. In this embodiment, the heat exchanger 2 comprises a centre heat exchange element 10 and a plurality of external heat exchange element 11 as described in FIG. 3-10. This arrangement is also suitable for heat exchanging liquids but could also heat of cool air.

In yet another embodiment of the heat exchanger according to the invention, there is arranged an electrical heating coil within the core of the heat exchange element 10, 11 to heat the fluid in the core 20, 21 instead of supplying warm fluid externally through pipes or tubes 12*a*, 12*b*, 12*c* as shown in the previous drawings. This is particularly useful in smaller scale as a heating element or where there is not possible to heat the fluid by an external heating source. This could be applied in system for heating gases or system for heating liquid as described in the embodiments above.

Figure 51:
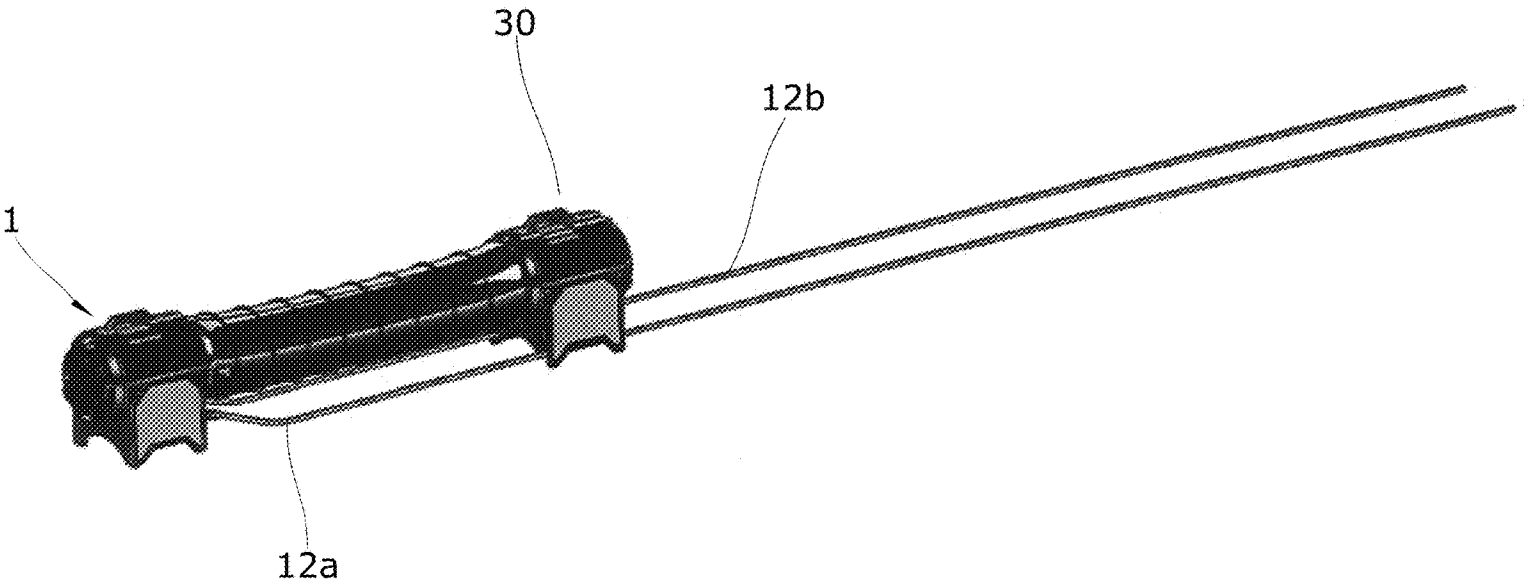
FIG. 51 shows another use of the heat exchanger according to the invention where the heat exchanger is used to heat air that is led trough the heat exchanger by a fan.

FIG. 51 shows another example of use of the heat exchanger. The heat exchanger is in this embodiment arranged in connection with a fan or other type of blower 30 for blowing air through the heat exchanger, and hence blowing heated air into e.g. a building. This illustrates just an example of the use. There are other possibilities of use, being embodiments of the invention Based on the accompanying drawing and the description of the different parts, a functional explanation of the invention is described hereinafter.

A heating agent or coolant is supplied to the core 20, 21 from the supply source to the core 20, 21. The heating agent or coolant is supplied via the inlet pipe or tube 12*a*, through the inlet opening 22*a* of the first plug 22 and through the pipe 26 so that the heating agent or coolant is led to the opposite end of the core 20, 21, i.e. towards the second plug 13 (as shown in different figures for instance FIG. 42) The heating agent or coolant that enters the core 20, 21 will push the heating agent or the coolant already present in the core 20, 21 towards the outlet opening 22*b* and it will flow out of the core 20, 21 towards another core 20, 21 or through the outlet pipe of tube 12*c*.

Optionally the heating agent of coolant could be warmed or cooled by a heating coil or cooling arrangement arranged within the core 20, 21.

The heating agent or coolant could be either a gas or a liquid. The inside of the core 20, 21 preferably have smooth walls to reduce friction.

In an optional embodiment inner ribs 37 are formed on the inside of the core surface 20*c* or a removable inner core element 40. This can be done for instance by milling. The ribs 37 increase the surface area and thereby transmission of heat from the heating fluid.

A fluid to be heated or cooled is conducted lengthwise of the ribs 30 through the heat exchange elements 10, 11 from a first or second end of the heating element towards the opposite end of the heating element 2, 100.

The fluid is heated or cooled by the transmission of energy through the surface of the core 20*c*, the ribs and the fins.

There is described both a transmission of heat from a heating fluid in the core to a heated fluid throughout the description as well as a cooling process where a coolant is supplied to the core and a fluid to be heated is conducted along the ribs.

The present invention has been described with reference to preferred embodiments and aspects thereof and related to the accompanying drawings for the sake of understanding only and it should be obvious to persons skilled in the art that the present invention includes all legitimate modifications within the ambit of what has been described hereinbefore and claimed in the attached claims.

The invention claimed is:

1. A heat exchanger for transferring heat between two flowing fluids with different temperature, the heat exchanger comprising:

a plurality of heat exchange elements disposed within an outer casing;

wherein each heat exchange element of the plurality of heat exchange elements comprises:

at least one core extending longitudinally through the heat exchange element, the at least one core defining a core cavity, the core cavity being configured to be coupled with an inlet port and an outlet port to permit a first fluid to flow therethrough, the inlet port and the outlet port being coupled to the core cavity at a same end of the core cavity;

a plurality of ribs extending along a length of the core, the plurality of ribs being evenly spaced around an outer surface of the core and extending radially outwardly from the core, said ribs being positioned for contact with a second fluid; and wherein each rib of the plurality of ribs is divided into at least two radially extending fins at a radial distance from the core and wherein each fin of the at least two radially extending fins is spaced apart from adjacent fins of the at least two radially extending fins so that the second fluid may flow between the radially extending fins; and wherein the radial extremities of the fins of each of the plurality of heat exchange elements defines an outer periphery;

wherein the entire periphery of each heat exchange element extends to the outer casing, the periphery of an adjacent heat exchange element, or a combination of both; and wherein the heat exchanger is configured to allow the second fluid to flow lengthwise along a surface of the plurality of ribs or the at least two radially extending fins from an inlet of the heat exchanger located at a first end of the heat exchanger to an outlet of the heat exchanger located at a second end of the heat exchanger.

2. The heat exchanger according to claim 1, the core further comprising a pipe extending from the inlet port towards an opposite end of the core, the pipe having a free end with an inclined opening.

3. The heat exchanger according to claim 2, wherein the pipe is arranged offset from a longitudinal centre axis of the core cavity.

4. The heat exchanger according to claim 1, wherein each fin of the at least two radially extending fins has a thickness that is the same throughout a radial length of the at least two radially extending fins.

5. The heat exchanger according to claim 1, wherein an angle between two juxtaposed ribs of the plurality of ribs is the same throughout each heat exchange element.

6. The heat exchanger according to claim 1, wherein each radially extending fin of the at least two radially extending fins are parallel.

7. The heat exchanger according to claim 1, wherein an angle formed between the at least two radially extending fins is the same for each heat exchange element of the heat exchanger.

8. The heat exchanger according to claim 1, wherein each heat exchange element of the plurality of heat exchange elements is made by extrusion.

9. The heat exchanger according to claim 1, wherein each rib of the plurality of ribs comprises a smooth surface.

10. The heat exchanger according to claim 1, wherein the plurality of heat exchange elements comprises at least three heat exchange elements, wherein a first heat exchange element of the at least three heat exchange elements is a centre heat exchange element and a second and a third heat exchange element of the at least three heat exchange elements are arranged around the outer periphery of the centre heat exchange element.

11. The heat exchanger according to claim 1, wherein an inner surface of the core cavity comprises ribs extending longitudinally along a length of the core cavity and extending radially into the core cavity.

12. The heat exchanger according to claim 1, wherein the first fluid received by the core cavity, is heated by an external heating source.

13. The heat exchanger according to claim 1, wherein the plurality of ribs extend along a whole length of the core.

* * * * *